US012735913B2

(12) United States Patent
Peavy et al.

(10) Patent No.: US 12,735,913 B2
(45) Date of Patent: Sep. 15, 2026

(54) DEPLOYABLE CANOPY SYSTEM

(71) Applicant: Disney Enterprises, Inc., Burbank, CA (US)

(72) Inventors: Joel Peavy, Poway, CA (US); Dexter Dickinson, Los Angeles, CA (US); Robert J. Bristow, Shadow Hills, CA (US); Maeis Heshmati, Tujunga, CA (US); Bryan S. Tye, Santa Clarita, CA (US); Colleen Bristow, Shadow Hills, CA (US); Mar C. Ricketts, Portland, OR (US); Trevor S. Blackann, Portland, OR (US)

(73) Assignee: Disney Enterprises, Inc., Burbank, CA (US)

( * ) Notice: Subject to any disclaimer, the term of this patent is extended or adjusted under 35 U.S.C. 154(b) by 56 days.

(21) Appl. No.: 18/823,390

(22) Filed: Sep. 3, 2024

(65) Prior Publication Data

US 2026/0062950 A1 Mar. 5, 2026

(51) Int. Cl.
*E04H 15/32* (2006.01)
*E04H 15/60* (2006.01)

(52) U.S. Cl.
CPC ..... *E04H 15/322* (2013.01); *E04H 15/60* (2013.01)

(58) Field of Classification Search
CPC ..... E04H 15/322
See application file for complete search history.

(56) References Cited

U.S. PATENT DOCUMENTS 2,886,047 A * 5/1959 Healy ..... E04H 15/003 135/904
4,480,800 A * 11/1984 Oberg ..... E02B 15/0814 242/615.3
5,086,988 A * 2/1992 LaPoint ..... B65H 75/406 242/405

(Continued)

FOREIGN PATENT DOCUMENTS

AU 2008217599 B2 12/2013
DE 202010011307 U1 11/2010

(Continued)

OTHER PUBLICATIONS

International Search Report and Written Opinion dated Nov. 7, 2025 in connection with International Patent Application No. PCT/US2025/035638, 12 pages.

(Continued)

*Primary Examiner* — Noah Chandler Hawk
(74) *Attorney, Agent, or Firm* — Dorsey & Whitney LLP

(57) ABSTRACT

A canopy system includes a canopy, cables respectively connected to the canopy, and a plurality of columns spaced from one another. The columns include a canopy column and at least two cable columns. Each column has a drive assembly arranged to wind-in, wind-out, or hold in place respective ones of the cables. The drive assemblies are controllable in a coordinated manner to wind-in, wind-out, or hold in place their respective ones of the cables to deploy or retract the canopy to one of a plurality of positions, including a deployed position in which the canopy provides covered protection and a retracted position in which the canopy is, at least in part, retracted within an inner chamber defined by the canopy column.

17 Claims, 24 Drawing Sheets

(56) References Cited

U.S. PATENT DOCUMENTS

| | | | | |
|---|---|---|---|---|
| 5,622,197 | A * | 4/1997 | Valaire | E04H 15/58 114/106 |
| 6,012,505 | A * | 1/2000 | Wurz | E04F 10/0681 242/594 |
| 6,341,638 | B1 | 1/2002 | Thompson et al. | |
| 6,971,433 | B2 | 12/2005 | Wagner et al. | |
| 8,051,866 | B2 | 11/2011 | Cutler | |
| 8,281,795 | B2 | 10/2012 | Cutler | |
| 10,301,840 | B1 * | 5/2019 | Jin | F16H 31/001 |
| 11,629,521 | B2 | 4/2023 | Zarkesh-Ha et al. | |
| 11,933,064 | B2 * | 3/2024 | Lynn Brouwers | E04H 15/58 |
| 2006/0175019 | A1 * | 8/2006 | Rewak | E04H 15/58 160/67 |
| 2009/0301534 | A1 * | 12/2009 | Bettega | E04H 15/58 242/378.1 |

FOREIGN PATENT DOCUMENTS

| | | | |
|---|---|---|---|
| WO | 2016023110 | A1 | 2/2016 |
| WO | 2016032409 | A1 | 3/2016 |

OTHER PUBLICATIONS

The Shading Company, "C Shade Sail", https://theshadingcompany.ae/product/c-shade-sail/, 4 pages.

Eibe Produktion + Vertrieb GmbH & Co. KG, "Triangular sun awning, retractable", https://shop.eibe.net/Triangular-sun-awning-retractable/56022850, 3 pages.

* cited by examiner

DEPLOYABLE CANOPY SYSTEM

FIELD

The present disclosure relates to a deployable canopy system that can selectively provide covered protection from adverse environmental conditions.

BACKGROUND

There are many applications and situations where it may be desirable to provide people with covered protection from adverse environmental conditions in large open outdoor spaces, such as covered protection from the sun on a hot day or rain during a sudden downpour. For instance, it may be desirable to provide shade for visitors of theme and amusement parks, stadiums, city parks, and outdoor malls, especially in the heat of summer, to make their visit a more enjoyable experience and to encourage the visitors to stay even during the sunniest and hottest portions of the day or when raining. However, constructing such shelters with a permanent roof may not be a desirable option, namely because these structures tend to obstruct the views and sight lines of guests and are generally not compatible with the creative aesthetics of themed spaces.

SUMMARY

In one example aspect, a canopy system is provided. The canopy system includes a canopy, cables respectively connected to the canopy, and a plurality of columns spaced from one another and including a canopy column and at least two cable columns. Each one of the plurality of columns has a drive assembly arranged to wind-in, wind-out, or hold in place respective ones of the cables. The drive assemblies are controllable in a coordinated manner to wind-in, wind-out, or hold in place their respective ones of the cables to deploy or retract the canopy to one of a plurality of positions, including a deployed position in which the canopy provides covered protection and a retracted position in which the canopy is, at least in part, retracted within an inner chamber defined by the canopy column.

In another example aspect, a non-transitory computer readable medium is provided. The non-transitory computer readable medium stores a program, which, when executed by any combination of one or more processors of a canopy system, causes the one or more processors to perform an operation, the operation comprising: receiving an input indicating an instruction to move a canopy to one of a plurality of positions, the plurality of positions including at least a deployed position in which the canopy provides covered protection and a retracted position in which the canopy is, at least in part, retracted within an inner chamber defined by a canopy column, wherein the canopy column is one of a plurality of columns; and controlling a drive assembly of each column of the plurality of columns in a coordinated manner to move the canopy to one of the plurality of positions based at least in part on the input, and wherein, to move the canopy to one of the plurality of positions, the drive assembly of each column of the plurality of columns is controlled to wind-in, wind-out, or hold in place respective cables that are connected to respective corners of the canopy.

In a further example aspect, a canopy system is provided. The canopy system includes a canopy, cables respectively connected to the canopy, and a canopy column defining an inner chamber in which a storage drum is disposed. The canopy system also includes drive assemblies each arranged to wind-in, wind-out, or hold in place respective ones of the cables in coordination to deploy or retract the canopy to one of a plurality of positions, including a deployed position in which the canopy provides covered protection and a retracted position in which the canopy is, at least in part, retracted within the inner chamber of the canopy column and wound on the storage drum, and wherein one of the drive assemblies is disposed within the inner chamber of the canopy column and rotatably drives the storage drum.

In yet a further example aspect, a method is provided. The method includes receiving an input indicating an instruction to move a canopy to one of a plurality of positions, the plurality of positions including at least a deployed position in which the canopy provides covered protection and a retracted position in which the canopy is, at least in part, retracted within an inner chamber defined by a canopy column, wherein the canopy column is one of a plurality of columns. Further, the method includes controlling a drive assembly of each column of the plurality of columns in a coordinated manner to move the canopy to one of the plurality of positions based at least in part on the input, and wherein, to move the canopy to one of the plurality of positions, the drive assembly of each column of the plurality of columns is controlled to wind-in, wind-out, or hold in place respective cables that are connected to respective corners of the canopy.

BRIEF DESCRIPTION OF THE DRAWINGS

So that the manner in which the above recited aspects are attained and can be understood in detail, a more particular description of embodiments described herein, briefly summarized above, may be had by reference to the appended drawings. It is to be noted, however, that the appended drawings illustrate typical embodiments and are therefore not to be considered limiting; other equally effective embodiments are contemplated.

DETAILED DESCRIPTION

Various embodiments of a canopy system are disclosed herein. The canopy system disclosed herein includes a canopy that can be selectively moved in a coordinated manner to various positions, including a deployed position and a retracted position. In deployed position, the canopy provides covered protection for guests, e.g., from adverse environmental conditions (sun, rain, snow, hail, etc.). In the retracted position, the canopy can be hidden from view, e.g., to keep sight lines open for guests when covered protection is not needed or desired. The canopy can also be strategically moved to one or more maintenance positions to make the canopy readily available for maintenance, such as for cleaning. Cables are connected to respective corners of the canopy and can be wound-in, wound-out, or held in place by respective drive assemblies arranged in respective columns. One of the columns, or a canopy column, is arranged to receive the canopy therein when the canopy is moved to the retracted position. The canopy can be wound on a storage drum disposed within an inner chamber of the canopy column. The canopy column can include a canopy guide to manage a shape of the canopy as the canopy enters the canopy column. In this way, the canopy can be stored in an organized and efficient manner within the canopy column.

The canopy system of the present disclosure can provide advantages, benefits, and/or technical effects. Specifically, the canopy of the canopy system can be selectively deployed to provide covered protection and can be retracted to minimize sight line obstructions for guests when covered protection is not needed or desired. Deployment and retraction can occur automatically (or manually) based on environmental conditions and in a coordinated manner by controlling the drive assemblies to strategically wind-in, wind-out, or hold in place their respective cables. The canopy can also be strategically moved for maintenance. In this regard, movement of the canopy is flexible. Moreover, the canopy system can include minimal support structures for supporting the canopy, which further reduces the obstruction of sight lines. In some further aspects, the columns can be selectively extendable based on an environmental condition, the columns can be multifunctional, one or more columns can be shared between different canopy sets, one or more of the columns can be themed to disguise their utilitarian aspects, or some combination of the foregoing. Example embodiments of the canopy system are provided below.

Canopy System Overview

Figure 1:
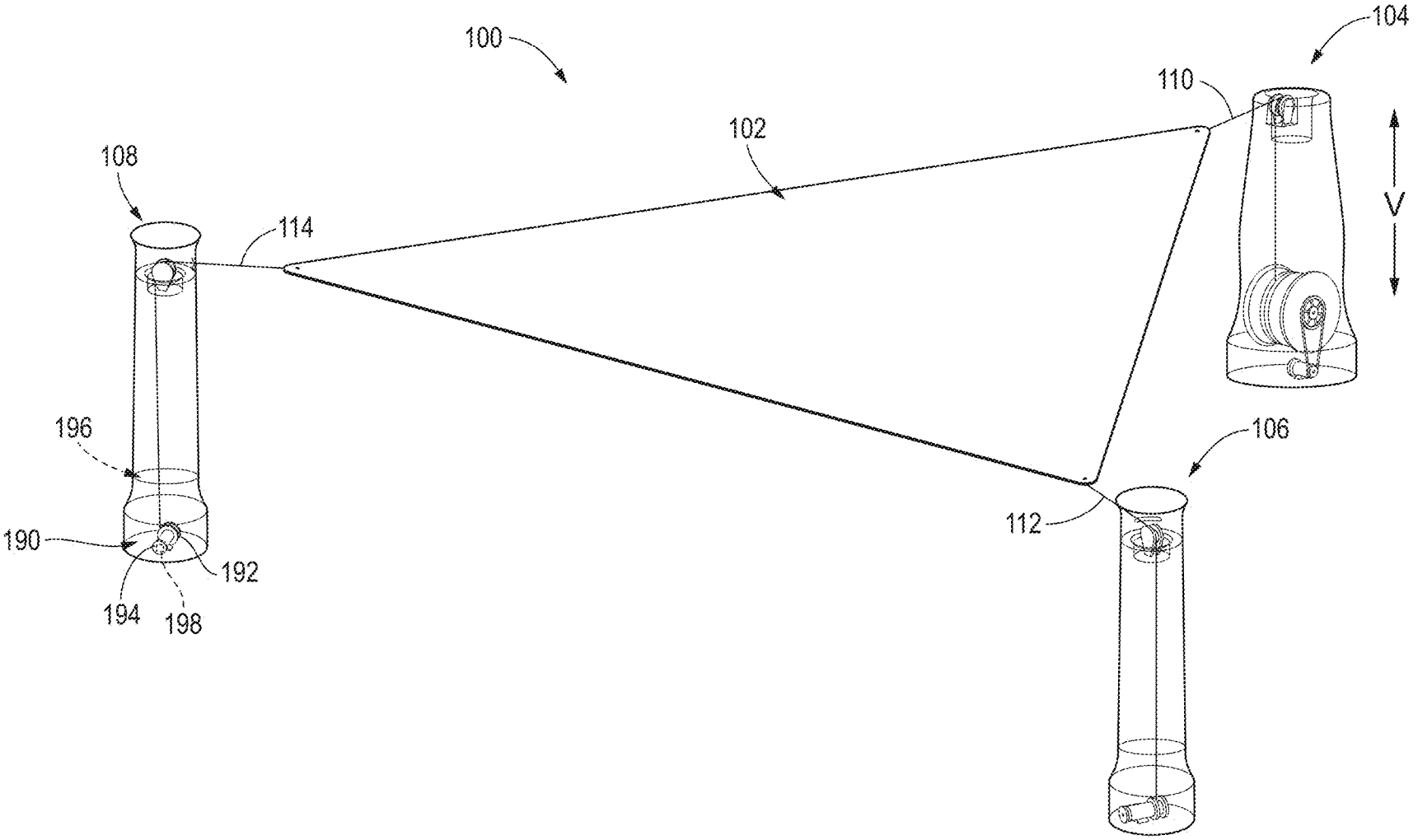
FIGS. 1, 2, and 3 are perspective views of a canopy system according to one example embodiment of the present disclosure, with a canopy thereof in a deployed position in FIG. 1, transitioning from the deployed positioned to a retracted position in FIG. 2, and in the retracted position in FIG. 3.
Figure 2:
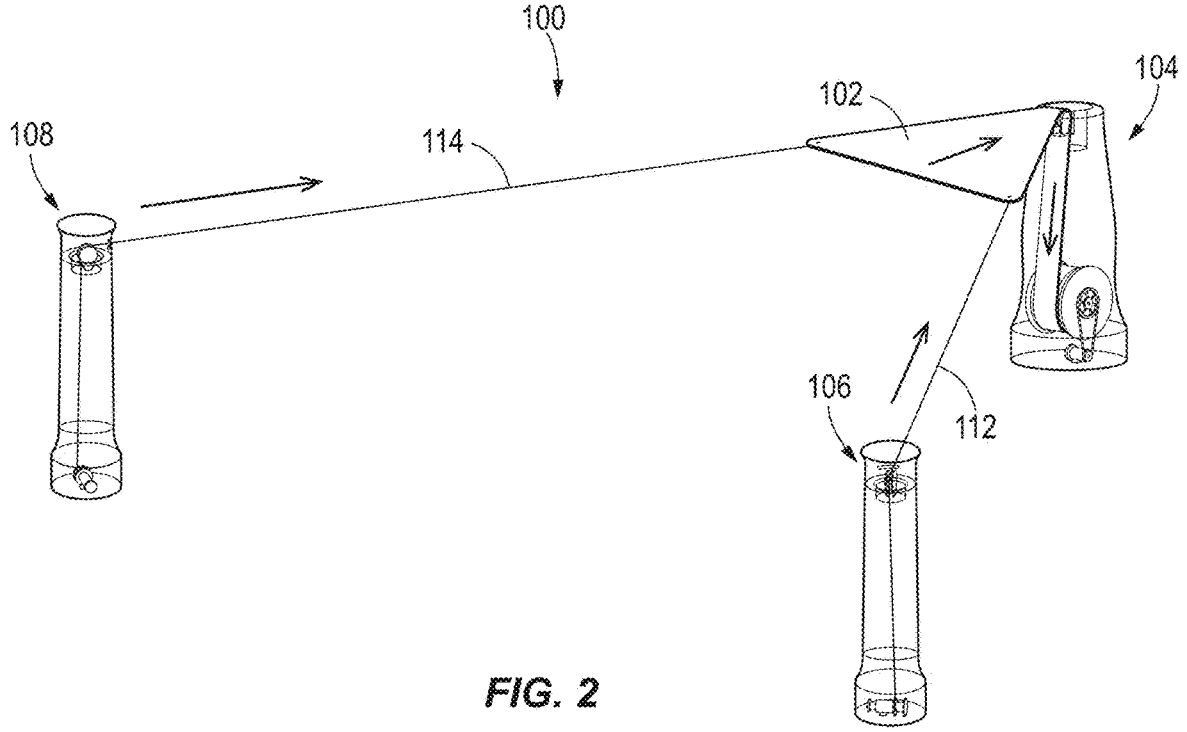
Figure 3:
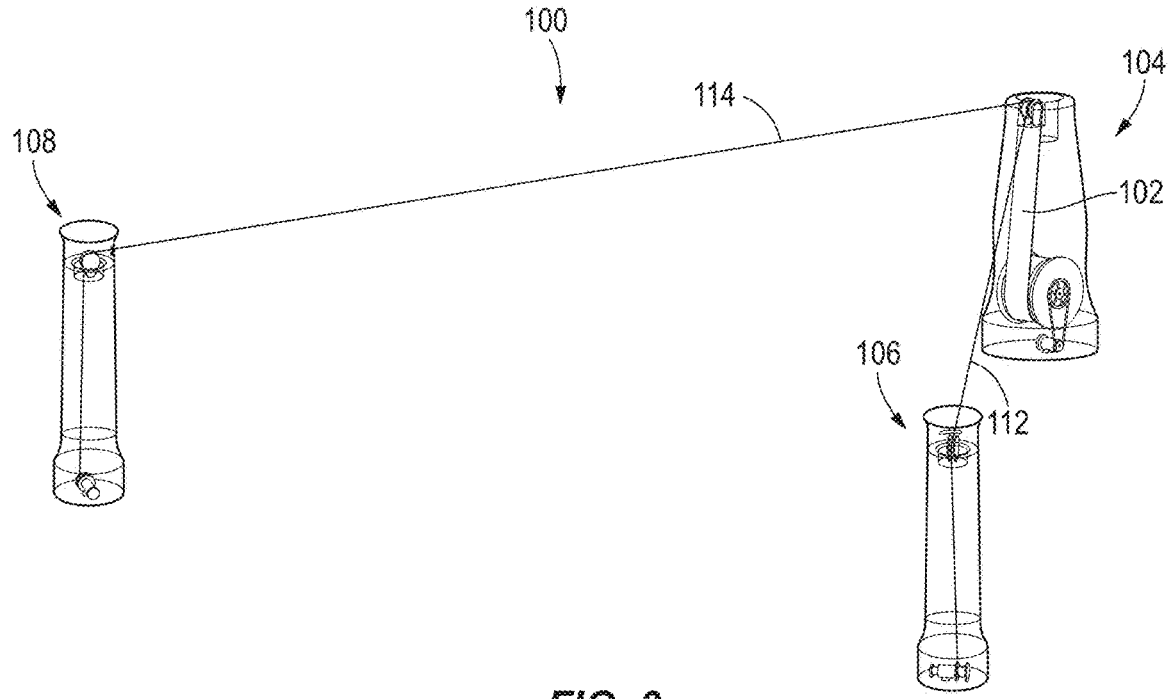

FIG. 1 is a perspective view of a canopy system 100 according to one example embodiment of the present disclosure. Generally, the canopy system 100 includes a canopy 102 that can be deployed to provide people (or other living things) with covered protection, e.g., from adverse environmental conditions (sun, rain, snow, hail, etc.), and that can be retracted from view, e.g., to keep sight lines open when covered protection is not needed or desired. In FIG. 1, the canopy 102 is shown in a deployed position. In FIG. 2, the canopy 102 is shown being moved from the deployed position to a retracted position in which the canopy 102 is hidden from view, at least in part. In FIG. 3, the canopy 102 is in the retracted position, and in this example, completely hidden from view. Accordingly, sight lines that would otherwise be obstructed by the canopy 102 are opened or unobstructed. In some embodiments, multiple canopy systems or canopy sets can be arranged relative to one another, e.g., so that a canopy of one system or set overlaps with a canopy of another system or set.

As shown in FIG. 1, the canopy system 100 includes a plurality of columns spaced from one another, including a canopy column 104 and at least two cable columns. In this example embodiment, the canopy system 100 includes a first cable column 106 and a second cable column 108. The columns 104, 106, 108 can each have a same height or different heights. When arranged at different heights, the canopy 102 can be canted or angled in its deployed position. The canopy system 100 also includes cables respectively connected to the canopy 102. Particularly, the cables are connected to, and support, respective corners of the canopy 102. The cables are also connected to respective ones of the columns 104, 106, 108. For the depicted embodiment of FIG. 1, the cables include a first cable 110, a second cable 112, and a third cable 114. A first end of the first cable 110 connects to the first corner of the canopy 102 and a second end of the first cable 110 connects to the canopy column 104. A first end of the second cable 112 connects to the second corner of the canopy 102 and a second end of the second cable 112 connects to the first cable column 106. A first end of the third cable 114 connects to the third corner of the canopy 102 and a second end of the third cable 114 connects to the second cable column 108. In at least some aspects, the number of columns incorporated into the canopy system 100 equals the number of corners on the canopy 102. For instance, in embodiments in which a canopy includes four corners, four columns can be incorporated into such a canopy system. Accordingly, while the canopy 102 has a triangular shape when deployed in the embodiment of FIGS. 1 through 3, it will be appreciated that the canopy 102 can have other shapes in other example embodiments.

In some example embodiments, the canopy 102 can be formed of a non-rigid material or flexible material that can be porous, such as a mesh material that passes some light and air therethrough (unlike a parachute, sail, kite, or the like). Stated differently, the canopy 102 can be flexible material with a predefined porosity whereby the canopy is permeable to air and at least some light. In yet other example embodiments, the canopy 102 can be formed of a non-rigid, water impervious material that prevents water, such as rain, from passing therethrough. Accordingly, the material utilized for the canopy 102 can be selected for protection against certain environmental conditions, such as sun or rain. In some further embodiments, the canopy 102 can be formed of a non-rigid material or flexible material that can be formed of a material similar to a parachute, sail, kite, or the like.

Figure 4:
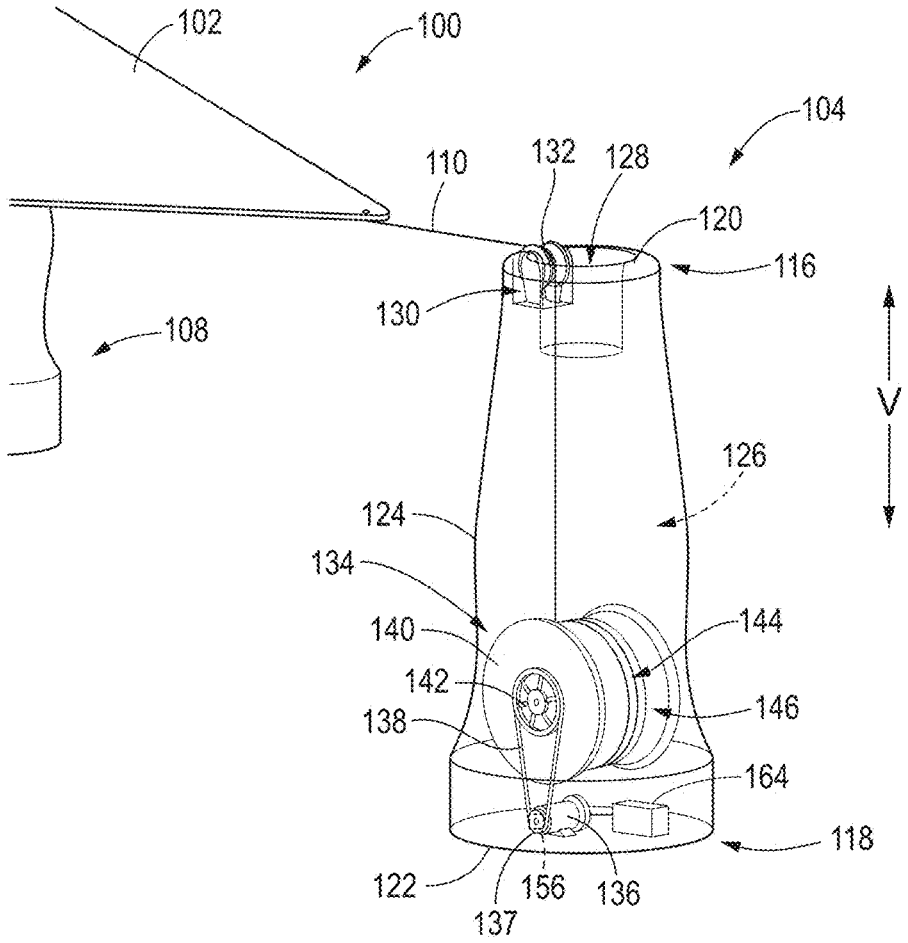
FIG. 4 is a perspective view of a canopy column of the canopy system of FIG. 1.

With reference now to FIG. 4 in addition to FIGS. 1 through 3, the canopy column 104 will be further described. The canopy column 104 extends along a vertical direction V between a top 116 and a bottom 118 and has a generally cylindrical shape. The canopy column 104 has a top wall 120, a bottom wall 122, and an exterior wall 124 extending between and connecting the top wall 120 and the bottom wall 122. In this example embodiment, the top wall 120 has a smaller diameter than the bottom wall 122. In other example embodiments, the canopy column 104 can have other geometric shapes. Moreover, the canopy column 104 defines an inner chamber 126 and a port 128. The port 128 provides an opening for the first cable 110 and the canopy 102 to be moved into and out of the inner chamber 126. In this regard, in addition to the first cable 110, the port 128 is sized to accommodate the canopy 102. The port 128 is defined at the top 116 of the canopy column 104, e.g., by the top wall 120 of the canopy column 104. However, the port 128 can be defined elsewhere in other example embodiments. Further, the canopy column 104 defines a recess 130 in which a pulley 132 can be disposed, e.g., to guide the cable into and out of the canopy column 104. The recess 130 can be defined so that only a portion of the pulley 132 is visible from a ground position, e.g., as shown in FIG. 4. In some embodiments, the recess 130 can be defined so that an entirety of the pulley 132 can be arranged below the top wall 120 of the canopy column 104, or rather, so that the pulley 132 can be completely hidden from view from a ground position. In such embodiments, a slit or the like can be defined by the exterior wall 124 to allow the first cable 110 to extend into and out of the canopy column 104.

The canopy column 104 has a drive assembly 134 arranged to wind-in or wind-out the first cable 110, which effectively retracts or deploys the canopy 102. The drive assembly 134 is equipped with an electric motor 136, a drum 137 mechanically coupled with the electric motor 136, and a belt 138 that is coupled with the cable drum 137 and a storage drum 140. The storage drum 140 can include a sprocket 142 to which the belt 138 is coupled. The sprocket 142 can include teeth that mesh with the belt 138 or can include opposing flanges that keep the belt 138 centered therebetween, for example. Moreover, the first cable 110 is connected to the storage drum 140. In this way, the first cable 110 is connected to the first corner of the canopy 102 at one end and to the storage drum 140 of the canopy column 104 at its other end.

As illustrated in FIG. 4, the storage drum 140 is disposed within the inner chamber 126 and can be rotatably-driven by the drive assembly 134 of the canopy column 104. That is, the electric motor can drive the belt 138, which in turn rotates the storage drum 140. To wind-in the first cable 110, which effectively retracts the canopy 102 (or moves the canopy 102 toward the canopy column 104), the electric motor 136 can drive the belt in a first direction (e.g., a clockwise direction), which rotates the storage drum 140 in the first direction (causing the first cable 110 to wind-in). In contrast, to wind-out the first cable 110, which effectively deploys the canopy 102 (or moves the canopy 102 away from the canopy column 104), the electric motor 136 can drive the belt in a second direction (e.g., a counterclockwise direction) opposite the first direction, which rotates the storage drum 140 in the second direction (causing the first cable 110 to wind-out).

In at least some example embodiments, such as the embodiment of FIG. 4, the storage drum 140 defines a channel 144, relative to a canopy winding surface 146 of the storage drum 140, within which the first cable 110 connected to the storage drum 140 can be received when wound thereon. The canopy winding surface 146 can be arranged to receive the canopy 102 when wound thereon. Accordingly, the storage drum 140 can be arranged to receive the first cable 110 within the channel 144 so that the canopy 102 does not contact the first cable 110 when wound on the canopy winding surface 146, except for at a coupling interface between the first cable 110 and the canopy 102. In this way, inadvertent damage to the canopy 102 can be prevented or otherwise reduced. In FIGS. 2 and 3, the canopy 102 is shown wound on the storage drum 140. In other embodiments, the storage drum 140 can include an annular winding surface without a channel.

The canopy column 104 can include features that help to guide the canopy 102 into the canopy column 104. For instance, the canopy column 104 can define the port 128 to be geometrically shaped to function as a canopy guide mechanism. The canopy guide mechanism can manage a shape of the canopy 102 as the canopy 102 is moved into the inner chamber 126. As one example, the port 128 can be shaped as a countersink opening as shown in FIGS. 1 through 4. A sink portion of the countersink can guide the canopy 102 into a hole of the countersink, which has a smaller diameter than the sink portion. As another example, the port 128 can be shaped like a funnel to gradually guide the width of the canopy 102 to the desired width for being rolled onto the storage drum 140.

Figure 5:
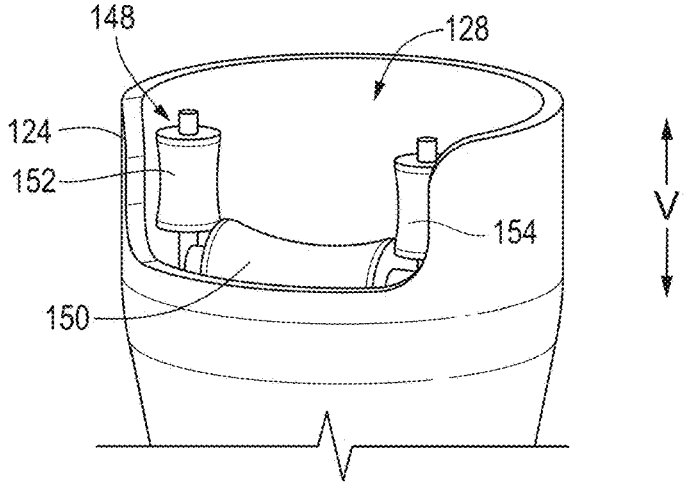
FIG. 5 is a close-up, perspective view of a canopy guide that can be incorporated into the canopy column of FIG. 4.

In yet other embodiments, the canopy column 104 can include a canopy guide 148 that guides the canopy 102 into and out of the inner chamber 126. For instance, as shown in FIG. 5, the canopy column 104 can include a canopy guide 148 that guides and manages the shape of the canopy 102 into and out of the inner chamber 126. In the depicted embodiment of FIG. 5, the canopy guide 148 includes a horizontally-oriented roller 150 and a pair of vertically-oriented rollers 152, 154 arranged on opposite sides of the horizontally-oriented roller 150. The horizontally-oriented roller 150 can be positioned at a height so that the horizontally-oriented roller 150 overlaps at least in part with the bottom ends of the vertically-oriented rollers 152, 154 along the vertical direction V. The vertically-oriented rollers 152, 154 can manage the lateral width of the canopy 102 as the canopy is moved into the canopy column 104, or stated differently, to facilitate furling of the canopy 102 into a position in which the canopy 102 can be efficiently rolled onto the storage drum 140. The horizontally-oriented roller 150 can facilitate the inward and downward movement of the canopy 102 into the inner chamber 126 and onto the storage drum 140.

In some example embodiments, the horizontally-oriented roller 150 and/or the vertically-oriented rollers 152, 154 can be passive rollers that are not actively driven. In such embodiments, the rollers 150, 152, 154 can be coupled with spindles that allow the rollers 150, 152, 154 to rotate when the canopy 102 engages them. In yet other example embodiments, the horizontally-oriented roller 150 and/or the vertically-oriented rollers 152, 154 can be active rollers that are actively driven, e.g., by an electric machine. In such embodiments, the rollers 150, 152, 154 can be coupled with rotatably-driven shafts that allow the rollers 150, 152, 154 to rotate when activated, e.g., to actively move the canopy 102 into the canopy column 104. In addition, in the embodiment of FIG. 5, the port 128 is defined by the exterior wall 124 and no top wall is present. However, in other embodiments, the top wall can be present or a cap (e.g., a themed cap) can be arranged on top of the canopy column 104. The circumferential width of the port 128 can be defined to accommodate the canopy 102. In at least some example embodiments, the circumferential width of the port 128 is at least ninety degrees (90°) but less than one hundred eighty degrees (180°). In some further embodiments, roller assemblies can be arranged throughout the canopy column 104 to guide the canopy 102 to or from the storage drum 140. For instance, the roller assemblies can be spaced from one another along the vertical direction V.

As represented schematically in FIG. 4, the canopy column 104 can include one or more brakes 156. In some embodiments, the canopy column 104 can include multiple brakes. For instance, the canopy column 104 can include a friction brake and a ratchet brake, e.g., positioned on opposite sides of the electric motor 136 or storage drum 140. The one or more brakes 156 can function to mechanically hold the first cable 110 and the canopy 102 in position when the canopy 102 is not being moved and can act as a failsafe. As one example, the brakes 156 can be activated (e.g., with electric power) to allow the first cable 110 to wind-in or wind-out. Then, with the canopy 102 in position, the brakes 156 can be deactivated (e.g., electric power can cease being provided to the brakes 156). The brakes 156 can hold the first cable 110, and consequently the canopy 102, in place mechanically and can maintain the tension on the cables. In some embodiments, the canopy column 104 can include a manual brake release 157 that be actuated to manually release the brakes 156.

In addition, in some example embodiments, the canopy column 104 can include one or more electric power sources. For instance, the canopy column 104 can include one or more batteries 164. In this way, the canopy column 104 can be a self-powered unit. The one or more batteries 164 can be electrically coupled with the electric power-consuming devices of the canopy column 104. The one or more batteries 164 can be removable and charged remotely, or alternatively, the canopy column 104 can include one or more power generating or energy harvesting devices, such as a solar or photovoltaic panel. Such devices can be used to charge the one or more batteries 164. In yet other embodiments, instead of being self-powered, the canopy column 104 can be electrically coupled with an electric power grid, for example.

Figure 6:
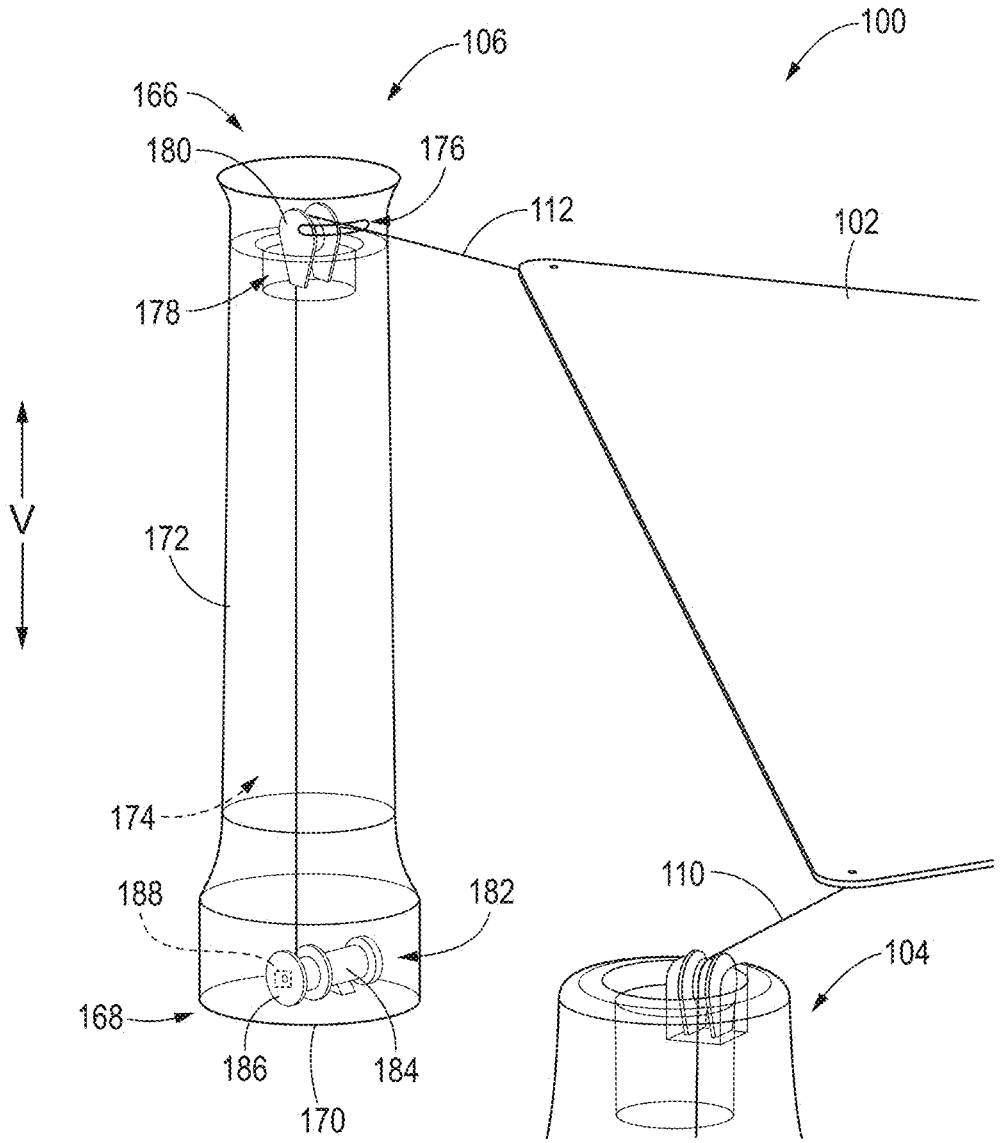
FIG. 6 is a perspective view of a cable column of the canopy system of FIG. 1.

With reference now to FIG. 6 in addition to FIGS. 1 through 3, the first cable column 106 will be further described. As illustrated, the first cable column 106 extends along the vertical direction V between a top 166 and a bottom 168. The first cable column 106 has a bottom wall 170 and an exterior wall 172 that extends upward from the bottom wall 170, e.g., to a top wall. The first cable column 106 defines an inner chamber 174 and a slit 176. The slit 176 provides an opening for the second cable 112 to be moved into and out of the inner chamber 174. The slit 176 is defined by the exterior wall 172 adjacent to the top 166 of the first cable column 106. However, the slit 176 can be defined elsewhere in other example embodiments. Further, the first cable column 106 defines a recess 178 in which a pulley 180 can be disposed, e.g., to guide the second cable 112 into and out of the first cable column 106. The pulley 180 can be an articulating or swivel pulley, for example.

The first cable column 106 has a drive assembly 182 arranged to wind-in or wind-out the second cable 112. The drive assembly 182 is equipped with a winch, or rather, an electric motor 184 and a cable drum 186 upon which the second cable 112 can be wound. The gearing between the electric motor 184 and the cable drum 186 can be designed with backdrive prevention features and can be designed so that minimal power is needed to generate a relatively large torque force. The second cable 112 is connected to the cable drum 186. In this way, the second cable 112 is connected to the second corner of the canopy 102 at one end and to the cable drum 186 of the first cable column 106 at its other end. The cable drum 186 and the electric motor 184 mechanically coupled thereto are disposed within the inner chamber 174. For instance, as shown in FIG. 6, the electric motor 184 can be mounted to the bottom wall 170 within the inner chamber 174.

The cable drum 186 can be rotatably-driven by the electric motor 184. To wind-in the second cable 112, which effectively deploys the canopy 102 (or moves the canopy 102 toward the first cable column 106 and away from the canopy column 104), the electric motor 184 can rotatably drive the cable drum 186 in a first direction (e.g., a clockwise direction), causing the second cable 112 to wind-in. In contrast, to wind-out the second cable 112, which effectively retracts the canopy 102 (or moves the canopy 102 away from the first cable column 106 and toward the canopy column 104), the electric motor 184 can rotatably drive the cable drum 186 in a second direction (e.g., a counterclockwise direction) opposite the first direction, causing the second cable 112 to wind-out.

The first cable column 106 can include one or more brakes 188, represented schematically in FIG. 6. In some embodiments, the first cable column 106 can include multiple brakes. For instance, the first cable column 106 can include a friction brake and a ratchet brake, e.g., positioned on opposite sides of the cable drum 186. The one or more brakes 188 can function to mechanically hold the second cable 112 and the canopy 102 in position when the canopy 102 is not being moved and can act as a failsafe. As one example, the brakes 188 can be activated (e.g., with electric power) to allow the second cable 112 to wind-in or wind-out. Then, with the canopy 102 in position, the brakes 188 can be deactivated (e.g., electric power can cease being provided to the brakes 188). The brakes 188 can hold the second cable 112, and consequently the canopy 102, in place mechanically and can maintain the tension on the cables. In some embodiments, the first cable column 106 can include a manual brake release 189 that be actuated to manually release the brakes 188.

The second cable column 108 can be constructed and can be operated in a same or similar manner as the first cable column 106. Specifically, as shown in FIG. 1, the second cable column 108 has a drive assembly 190 arranged to wind-in or wind-out the third cable 114. The drive assembly 190 is equipped with a winch, or rather, an electric motor 192 and a cable drum 194 upon which the third cable 114 can be wound. The third cable 114 is connected to the cable drum 194. In this way, the third cable 114 is connected to the third corner of the canopy 102 at one end and to the cable drum 194 of the second cable column 108 at its other end. The cable drum 194 and the electric motor 192 mechanically coupled thereto are disposed within an inner chamber 196 defined by the second cable column 108. For instance, as shown in FIG. 1, the electric motor 192 can be mounted to a bottom wall within the inner chamber 196.

The cable drum 194 can be rotatably-driven by the electric motor 192. To wind-in the third cable 114, which effectively deploys the canopy 102 (or moves the canopy 102 toward the second cable column 108 and away from the canopy column 104), the electric motor 192 can rotatably drive the cable drum 194 in a first direction (e.g., a clockwise direction), causing the third cable 114 to wind-in. In contrast, to wind-out the third cable 114, which effectively retracts the canopy 102 (or moves the canopy 102 away from the second cable column 108 and toward the canopy column 104), the electric motor 192 can rotatably drive the cable drum 194 in a second direction (e.g., a counterclockwise direction) opposite the first direction, causing the third cable 114 to wind-out.

The second cable column 108 can include one or more brakes 198, represented schematically in FIG. 1. In some embodiments, the second cable column 108 can include multiple brakes. For instance, the second cable column 108 can include a friction brake and a ratchet brake, e.g., positioned on opposite sides of the cable drum 194. The one or more brakes 198 can function to mechanically hold the third cable 114 and the canopy 102 in position when the canopy 102 is not being moved and can act as a failsafe. As one example, the brakes 198 can be activated (e.g., with electric power) to allow the third cable 114 to wind-in or wind-out. Then, with the canopy 102 in position, the brakes 198 can be deactivated (e.g., electric power can cease being provided to the brakes 198). The brakes 198 can hold the third cable 114, and consequently the canopy 102, in place mechanically and can maintain the tension on the cables. In some embodiments, the second cable column 108 can include a manual brake release 199 that be actuated to manually release the brakes 198.

The first and second cable columns 106, 108 can be multifunctional and/or can be self-powered, e.g., in a similar manner as the canopy column 104.

Retraction Operation

Figure 7:
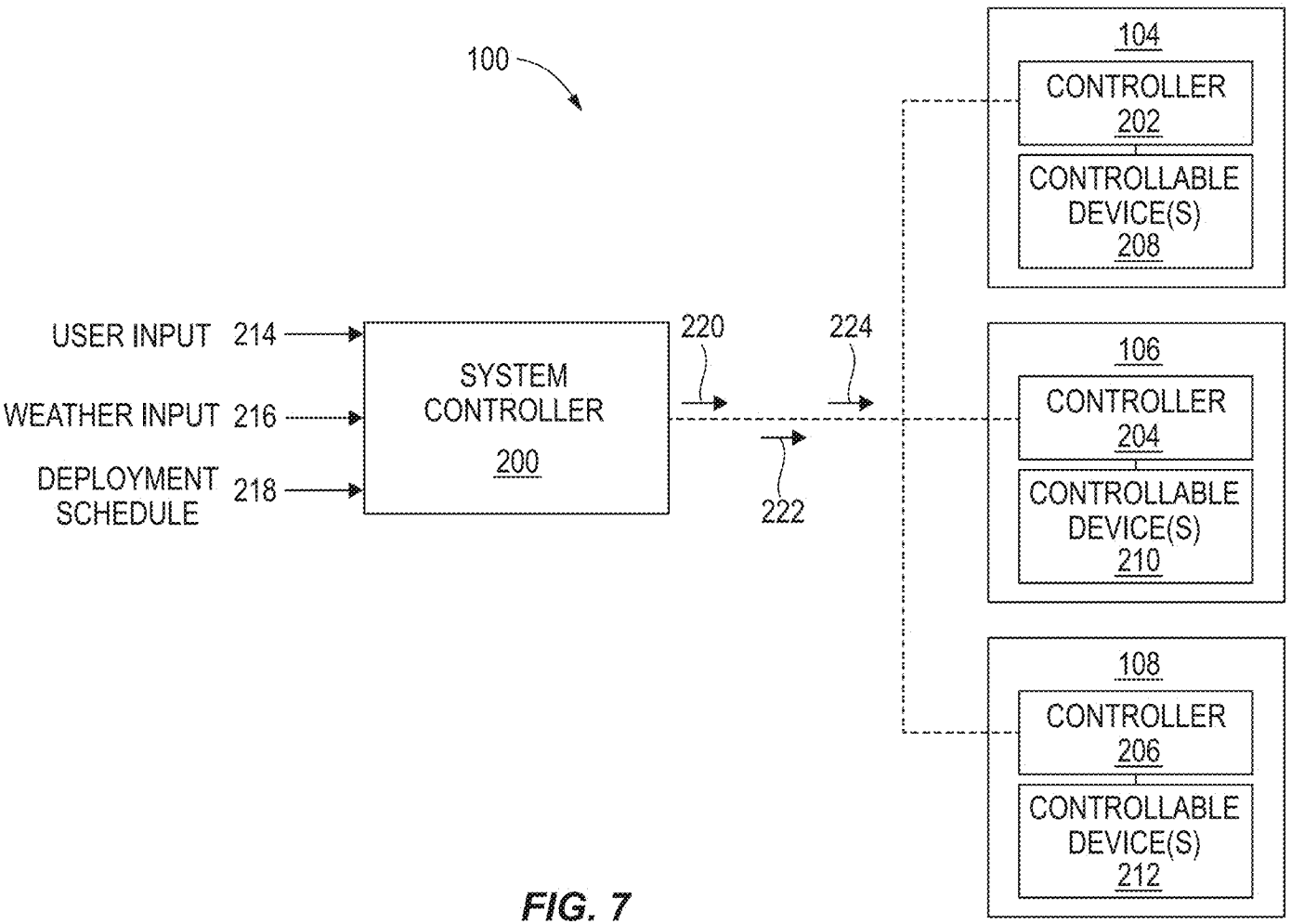
FIG. 7 is a system diagram of the canopy system of FIG. 1.

With reference now to FIG. 7 in addition generally to FIGS. 1 through 6, an example manner in which the canopy system 100 can move the canopy 102 from its deployed position to a stowed or retracted position will now be provided. Stowing or retracting the canopy 102 can, among other things, enhance guest sightlines when covered protection is not needed or desired.

FIG. 7 depicts a system diagram for the canopy system 100. In at least some example embodiments, such as in the embodiment of FIG. 7, the canopy system 100 includes a system controller 200 that is communicatively coupled with each one of the columns, or more specifically, with respective controllers thereof. The canopy column 104 can include a first controller 202, the first cable column 106 can include a second controller 204, and the second cable column 108 can include a third controller 206. The controllers 202, 204, 206 can be arranged within their respective columns 104, 106, 108 or outboard or external to their respective columns 104, 106, 108. The first, second, and third controllers 202, 204, 206 can each be communicatively coupled with the system controller 200, e.g., via one or more wired or wireless communication links. Each one of the columns 104, 106, 108 can also include one or more controllable devices 208, 210, 212 that are communicatively coupled with their respective controllers 202, 204, 206. The controllable devices 208, 210, 212 can include, among other possible devices, one or more devices of the drive assemblies 134, 182, 190 (e.g., the electric motors 136, 184, 192 or inverters thereof), cameras 158, speakers 160, lights 162, brakes 156, 188, 198, etc.

In some example embodiments, the system controller 200 can initiate a retraction operation to move the canopy 102 from its deployed position (FIG. 1) to the stowed or retracted position (FIG. 3), e.g., based at least in part on an input. As one example, one or more processors of the system controller 200 can receive a user input 214, which can provide an instruction to initiate the retraction operation. For instance, a user can manually initiate the retraction operation (e.g., by pushing a button on a user interface communicatively coupled with the system controller 200). The user input 214 can be received by the one or more processors of the system controller 200. As another example, the one or more processors of the system controller 200 can iteratively receive weather inputs 216 that indicate weather conditions at the canopy system 100. The weather inputs 216 can provide information relating to precipitation, wind, sun, cloud cover, etc. The weather conditions can be captured by weather sensors (onsite or offsite) and/or can be generated by one or more weather forecast models. The weather conditions received as part of the weather inputs 216 can be used as a trigger condition to retract the canopy 102, e.g., when the weather conditions are favorable. As yet another example, the one or more processors of the system controller 200 can receive an input in the form of a deployment schedule 218 that indicates times in which the canopy 102 is to be deployed, not deployed, scheduled for maintenance or cleaning, etc. That is, the deployment schedule 218 corresponds predetermined times with intended positions of the canopy. A park computing system or supervisor controller can generate the deployment schedule 218 for a given day, week, or predetermined time period, and the canopy 102 can be retracted, deployed, or otherwise moved based on the deployment schedule 218.

In some embodiments, the inputs received by the system controller 200 can each have an associated hierarchy or priority level. For instance, the deployment schedule 218 can be set at a first priority level, the weather inputs 216 can be set at a second priority level that is a higher priority than the first priority level, and the user input 214 can be set at a third priority level that is a higher priority than the second priority level. Accordingly, as one example, the system controller 200 can deploy or retract the canopy 102 according to the deployment schedule 218, but when rain or harsh sun conditions are expected based on the weather inputs 216, the system controller 200 can deviate from the deployment schedule 218 and can deploy or retract the canopy 102 according to the weather conditions indicated in the weather inputs 216. However, when an input corresponding to a user input is received, the system controller 200 can deploy or retract the canopy 102 according to the user input, no matter the schedule or weather conditions. As will be appreciated, the inputs can have different priority levels than noted in the example above.

The system controller 200 can coordinate control of the canopy 102 from its deployed position (FIG. 1) to the stowed or retracted position (FIG. 3). Specifically, the system controller 200 can, based on the one or more inputs received, initiate the retraction operation by sending one or more control signals 220 to the controllers 202, 204, 206 of the respective columns 104, 106, 108. Based on the received control signals 220, the controllers 202, 204, 206 can initiate the retraction operation. In particular, the controllers 202, 204, 206 can communicate with their respective controllable devices 208, 210, 212, or controllable devices of the drive assemblies 134, 182, 190, to retract the canopy 102. In this way, the drive assemblies 134, 182, 190 are arranged to wind-in or wind-out their respective first, second, and third cables 110, 112, 114 in coordination so as to coordinate retraction of the canopy 102 to a retracted position in which the canopy is, at least in part, retracted within the inner chamber 126 defined by the canopy column 104.

The canopy 102 is shown in the deployed position in FIG. 1. To move or retract the canopy 102 to the retracted position as illustrated in FIG. 3, the drive assembly 134 of the canopy column 104 is controlled to wind-in the first cable 110, which winds the first cable 110 onto the storage drum 140 within the channel 144. The winding-in of the first cable 110 moves the canopy 102 toward the canopy column 104. At the same time the drive assembly 134 of the canopy column 104 winds-in the first cable 110, the first and second drive assemblies 182, 190 of the first and second cable columns 106, 108 wind-out their respective second and third cables 112, 114. The winding-out of the second and third cables 112, 114 facilitates travel of the canopy 102 toward the canopy column 104.

At some point as the first cable 110 is wound-in and the second and third cables 112, 114 are wound-out, the first corner of the canopy 102 enters the inner chamber 126 through the port 128. The canopy 102 can be guided into the inner chamber 126 through the port 128. In some embodiments, the port 128 can be geometrically shaped to function as a canopy guide mechanism to manage the shape of the canopy 102 so that the canopy 102 can be folded, furled, or otherwise shaped to wind onto the storage drum 140. Alternatively, the canopy guide 148 of FIG. 5 can be used to guide and manage the shape of the canopy 102 into the inner chamber 126. For instance, the canopy guide 148 can be used to fold, furl, or otherwise shape the canopy 102 as the canopy 102 moves into the inner chamber 126. In embodiments in which the canopy guide 148 is an active guide, the horizontally-oriented roller 150 and/or the vertically-oriented rollers 152, 154 can be actively driven, e.g., by an electric motor controlled by the controller 202 of the canopy column 104. Once shaped or folded, the canopy 102 can traverse downward through the inner chamber 126 and can be wound onto the storage drum 140, or more specifically, on the canopy winding surface 146, e.g., as shown in FIG. 2.

In at least some embodiments, the canopy 102 can be fully retractable within the inner chamber 126 of the canopy column 104, e.g., as shown in FIG. 3. In this manner, when the canopy 102 is moved to the stowed or retracted position, an entirety of the canopy 102 can be hidden from view, e.g., from a ground perspective. In other embodiments, the canopy 102 can be moved to partially retracted position (or partially deployed position). In some embodiments, the second and third cables 112, 114 can be received, at least in part, into the canopy column 104. Moreover, when the canopy 102 is in the retracted position, only the second and third cables 112, 114 remain visible, besides the columns 104, 106, 108. In this regard, when the canopy 102 is in the retracted position, guest sightlines are largely unimpeded.

The controllers 202, 204, 206 can control their respective controllable devices 208, 210, 212, or controllable devices of the drive assemblies 134, 182, 190, to cease the retraction operation when the canopy 102 has been retracted into the canopy column 104 or at some designated position. The retraction operation can be ceased, e.g., after a predetermined time after initiation of the retraction operation, upon a sensor in the canopy column 104 detecting a specific marker or target on the canopy 102 or one of the cables, a sensed tension on one of the cables, a combination thereof, etc. The controllers 202, 204, 206 can report position information back to the system controller 200, e.g., so that the system controller 200 can use such information during a next deployment of the canopy 102.

Deployment Operation

With reference still to FIG. 7 in addition generally to FIGS. 1 through 6, an example manner in which the canopy system 100 can deploy the canopy 102 to provide covered protection will now be provided. Deploying the canopy 102 can, among other things, enhance guest experiences by providing covered protection, e.g., from adverse environmental conditions (sun, rain, snow, hail, etc.).

In some example embodiments, the system controller 200 can initiate a deployment operation to move the canopy 102 from its stowed or retracted position (FIG. 3) to the deployed position (FIG. 1), e.g., based at least in part on one or more inputs. As noted previously, the one or more processors of the system controller 200 can receive user inputs 214, weather inputs 216, and/or deployment schedules 218. The inputs received by the system controller 200 can each have an associated hierarchy or priority level.

The system controller 200 can coordinate control of the canopy 102 from its stowed or retracted position (FIG. 3) to the deployed position (FIG. 1). Specifically, the system controller 200 can, based on the one or more inputs received, initiate the deployment operation by sending one or more control signals 222 to the controllers 202, 204, 206 of the respective columns 104, 106, 108. Based on the received control signals 222, the controllers 202, 204, 206 can initiate the deployment operation. In particular, the controllers 202, 204, 206 can communicate with their respective controllable devices 208, 210, 212, or controllable devices of the drive assemblies 134, 182, 190, to deploy the canopy 102. In this way, the drive assemblies 134, 182, 190 are arranged to wind-in or wind-out their respective first, second, and third cables 110, 112, 114 in coordination so as to coordinate deployment of the canopy 102 to a deployed position in which the canopy provides covered protection, or rather, so that the canopy 102 is suspended, at least in part, between the columns 104, 106, 108.

The canopy 102 is shown in the retracted position in FIG. 3. To deploy the canopy 102 to the deployed position as illustrated in FIG. 1, the first and second drive assemblies 182, 190 of the first and second cable columns 106, 108 wind-in their respective second and third cables 112, 114. The winding-in of the second and third cables 112, 114 facilitates travel of the canopy 102 away from the canopy column 104 and toward the first and second cable columns 106, 108. At the same time the first and second drive assemblies 182, 190 of the first and second cable columns 106, 108 wind-in their respective second and third cables 112, 114, the drive assembly 134 of the canopy column 104 is controlled to wind-out the first cable 110. Stated differently, the drive assembly 134 of the canopy column 104 is controlled to rotate the storage drum 140 so that the canopy 102 and the first cable 110 unwind from the storage drum 140 and exit the inner chamber 126 through the port 128.

As the canopy 102 exits the inner chamber 126, the canopy 102 can begin to unfold, unfurl, or otherwise assume its deployed shape. The port 128 can be geometrically shaped to function as a canopy guide mechanism to manage the unfolding or unfurling of the canopy 102. Alternatively, the canopy guide 148 of FIG. 5 can be used to manage the unfolding or unfurling of the canopy 102. For instance, the canopy guide 148 can be used to unfold, unfurl, or otherwise return the shape of the canopy 102 to its deployed shape. In embodiments in which the canopy guide 148 is an active guide, the horizontally-oriented roller 150 and/or the vertically-oriented rollers 152, 154 can be actively driven, e.g., by an electric motor controlled by the controller 202 of the canopy column 104. Once unfolded or unfurled, the canopy 102 can be suspended, at least in part, between the columns 104, 106, 108, e.g., as shown in FIG. 1. In at least some embodiments, an entirety of the canopy 102 can be deployed from the canopy column 104. Deployment of the canopy 102 can provide guests with covered protection from sun, rain, snow, hail, wind, etc.

The controllers 202, 204, 206 can control their respective controllable devices 208, 210, 212, or controllable devices of the drive assemblies 134, 182, 190, to cease the deployment operation, e.g., when the canopy 102 has reached the deployed position or some at some designated position. The deployment operation can be ceased, e.g., after a predetermined time after initiation of the deployment operation, upon a sensor in one of the columns 104, 106, 108 detecting a specific marker or target on one more of the cables 110, 112, 114, a sensed tension on one of the cables 110, 112, 114, a combination thereof, etc. The controllers 202, 204, 206 can report position information back to the system controller 200, e.g., so that the system controller 200 can use such information during a next retraction of the canopy 102.

Although FIG. 7 depicts the use of the system controller 200 to manage the retraction and deployment operations, in other embodiments, the controllers 202, 204, 206 of the columns 104, 106, 108 can control their respective controllable devices 208, 210, 212 without supervision from a system controller.

Maintenance Operation

Figure 8:
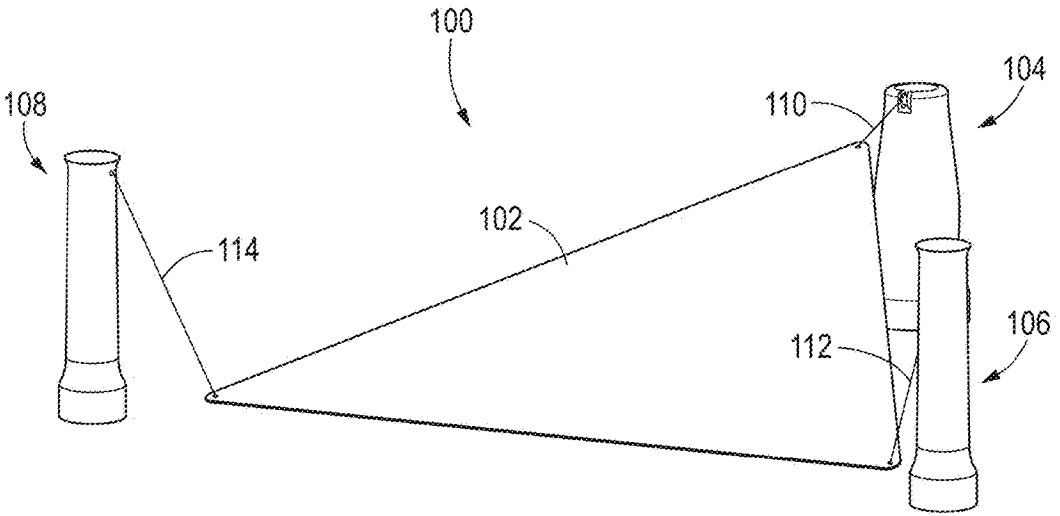
FIGS. 8 and 9 are perspective and side elevation views of the canopy system of FIG. 1, with the canopy moved to a maintenance position.
Figure 9:
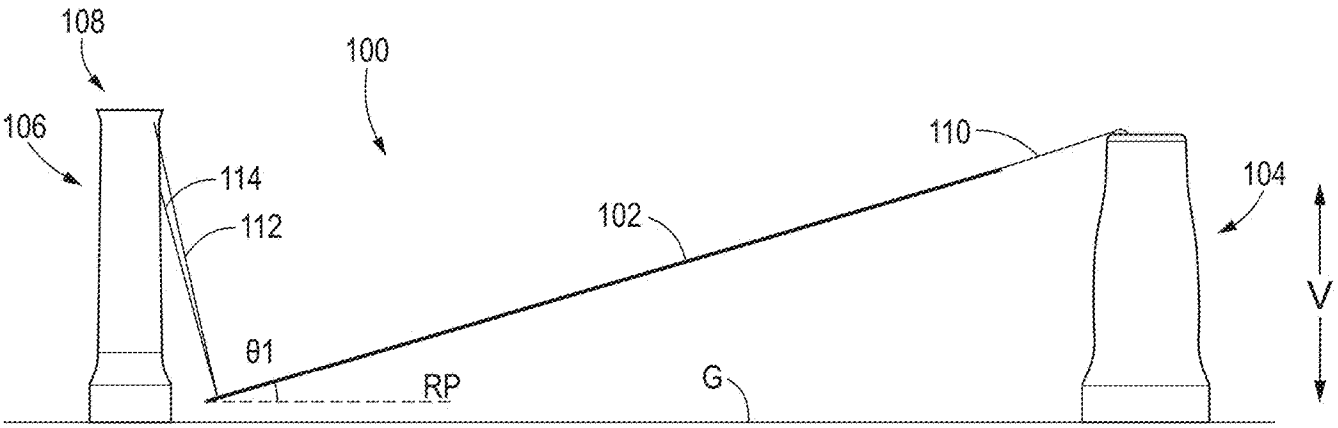

With reference now to FIGS. 7, 8, and 9 in addition generally to FIGS. 1 through 6, an example manner in which the canopy system 100 can move the canopy 102 to a maintenance position will now be provided. Deploying the canopy 102 to the maintenance position can facilitate cleaning of the canopy 102, for example.

In some example embodiments, the system controller 200 can initiate a maintenance operation to move the canopy 102 from the deployed position (FIG. 1) or the retracted position (FIG. 3) to the maintenance position (FIGS. 8 and 9), e.g., based at least in part on one or more inputs. As noted previously, the one or more processors of the system controller 200 can receive various inputs, including user inputs 214, weather inputs 216, and/or deployment schedules 218. The inputs received by the system controller 200 can each have an associated hierarchy or priority level.

The system controller 200 can coordinate control of the canopy 102 to the maintenance position (FIGS. 8 and 9). Specifically, the system controller 200 can, based on the one or more inputs received, initiate the maintenance operation by sending one or more control signals 224 to the controllers 202, 204, 206 of the respective columns 104, 106, 108. Based on the received control signals 224, the controllers 202, 204, 206 can initiate the maintenance operation. In particular, the controllers 202, 204, 206 can communicate with their respective controllable devices 208, 210, 212, or controllable devices of the drive assemblies 134, 182, 190, to move the canopy 102 to the maintenance position. In this way, the drive assemblies 134, 182, 190 are arranged to wind-in, wind-out, or hold in place their respective first, second, and third cables 110, 112, 114 in coordination so as to coordinate deployment of the canopy 102 to a maintenance position in which the canopy 102 is arranged for cleaning.

To move the canopy 102 from the deployed position (FIG. 1) to the maintenance position (FIGS. 8 and 9), at least two of the corners of the canopy 102 can be dropped down near the ground while the other corner(s) can remain relatively in place. For instance, in the example of FIGS. 8 and 9, the first and second drive assemblies 182, 190 of the first and second cable columns 106, 108 can wind-out their respective second and third cables 112, 114. At the same time, the drive assembly 134 of the canopy column 104 can be controlled to hold the first cable 110 in place, or rather, not wind-in or wind-out the first cable 110. As a result, the second and third corners of the canopy 102 are dropped down below the first corner of the canopy 102, e.g., to a position just above the ground G along the vertical direction V, and the first corner to which the first cable 110 is coupled is dropped slightly along the vertical direction V due to the reduced tension provided by the second and third cables 112, 114. Accordingly, the canopy 102 is arranged at an angle θ1 with respect to a horizontal reference plane RP, which is orthogonal to the vertical direction V. For the example embodiment of FIGS. 8 and 9, the angle θ1 is approximately fifteen degrees (15°). However, in other embodiments, the angle θ1 can be more or less than fifteen degrees (15°), such as between zero and sixty degrees (0-60°).

Accordingly, the drive assemblies 134, 182, 190 of the canopy system 100 are controllable to move the canopy 102 to a maintenance position, and to move the canopy 102 to the maintenance position, at least two of the drive assemblies wind-out their respective cables and at least one of the drive assemblies holds its respective one of the cables in place so that the canopy 102 is angled with respect to the horizontal reference plane RP, with at least two corners of the canopy 102 being arranged in respective lowered positions and at least one corner of the canopy 102 being arranged in an elevated position, e.g., as shown in FIGS. 8 and 9.

Advantageously, the angled arrangement of the canopy 102 in the maintenance position can allow for readily available access to the canopy 102. For instance, the canopy 102 can be moved to the maintenance position for cleaning of the canopy 102. The angled arrangement can allow for readily available access to the canopy 102 for brushing, blotting, etc. but also allows water or other cleaning solutions to "runoff" in a specific direction or toward a designated drainage area. In addition, the canopy 102 can be moved to the maintenance position for purposes other than cleaning, such as for maintenance of the canopy 102, replacing the canopy 102 with another canopy, maintenance of a cable or column, etc.

In some instances, performing the maintenance operation can include successively moving the canopy 102 to multiple different maintenance positions. For instance, after the second and third corners are dropped down as shown in FIGS. 8 and 9, the drive assembly 134 of the canopy column 104 can be controlled to wind-out the first cable 110 to move the first corner of the canopy 102 downward, the first drive assembly 182 can be controlled to wind-in the second cable 112 to move the second corner of the canopy 102 upward, and the second drive assembly 190 can be controlled to hold the third cable 114 in place, e.g., at a downward position. In this way, the first and third corners of the canopy 102 can be dropped down below the second corner of the canopy 102, e.g., to a position just above the ground G along the vertical direction V, and the second corner to which the second cable 112 can be arranged, e.g., proximate the top 166 (FIG. 6) but with the second cable 112 angled downward due to the reduced tension provided by the first and third cables 110, 114. This process can be further iterated for other maintenance positions.

In some embodiments, as an alternative maintenance position, all corners can be lowered down such that the canopy 102 is positioned above the ground G but so that the canopy 102 is substantially parallel with the horizontal reference plane RP (e.g., within two degrees (2°) of parallel).

To move the canopy 102 from the retracted position to the maintenance position, a deployment operation as described above can be implemented and then the maintenance operation can be executed, for example.

Canopy System with Multiple Canopies and at Least One Shared Cable Column

In some further embodiments of the present disclosure, a canopy system can include multiple canopies, and the canopies can be respectively supported by at least one shared cable columns. An example embodiment is provided below.

Figure 10:
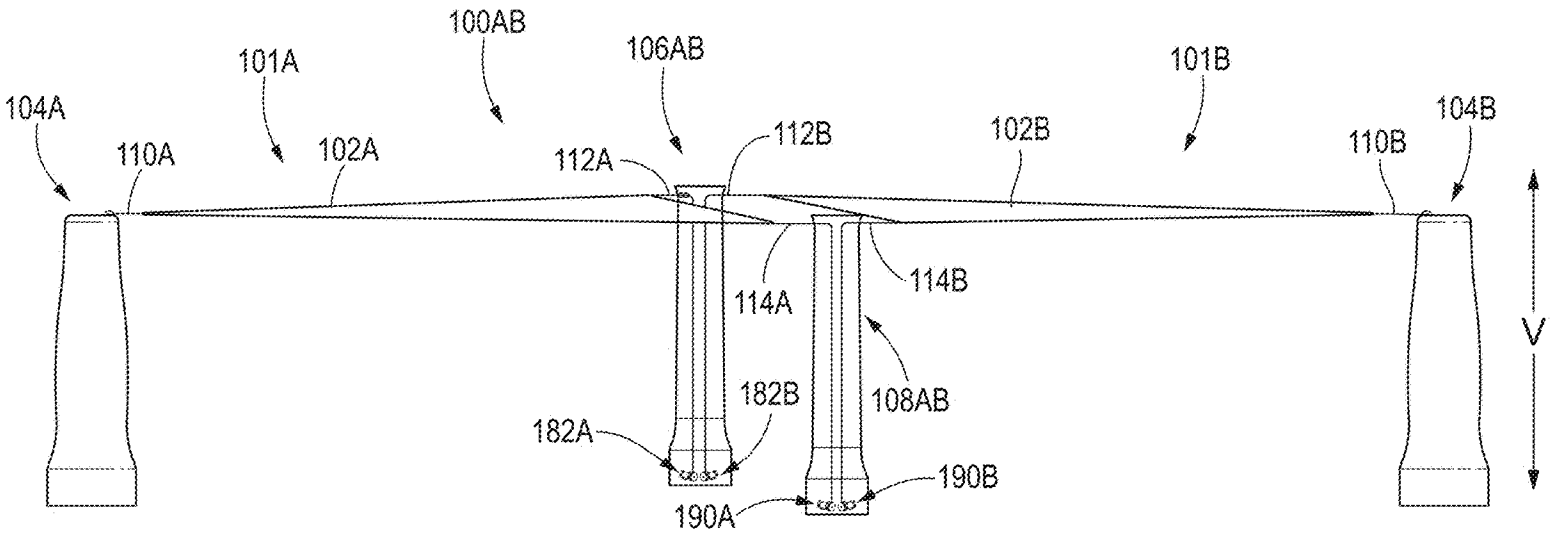
FIG. 10 is a perspective view of a canopy system according to another example embodiment of the present disclosure, with the canopy system having two canopy sets that share cable columns.

FIG. 10 depicts a perspective view of a canopy system 100AB having a first canopy set 101A and a second canopy set 101B. The first canopy set 101A includes a first canopy 102A, a first canopy column 104A, a first cable column 106AB, and a second cable column 108AB. The first canopy 102A is connected to, and supported by, a first cable 110A, a second cable 112A, and a third cable 114A. The first canopy set 101A is generally arranged in a similar manner as the canopy system 100 of FIG. 1. The second canopy set 101B includes a second canopy 102B, a second canopy column 104B, the first cable column 106AB, and the second cable column 108AB. Accordingly, the first and second cable columns 106AB, 108AB are shared between the two canopy sets 101A, 101B. The second canopy 102B is connected to, and supported by, a first cable 110B, a second cable 112B, and a third cable 114B. The second canopy set 101B is generally arranged in a similar manner as the canopy system 100 of FIG. 1.

In the depicted embodiment of FIG. 10, the shared cable columns 106AB, 108AB each include a drive assembly associated with the first canopy set 101A and a drive assembly associated with the second canopy set 101B. Specifically, the first cable column 106AB includes a first drive assembly 182A and a second drive assembly 182B (both drive assemblies 182A, 182B are arranged in a same or similar manner as the drive assembly 182 of the first cable column 106 of FIG. 6). The first and second drive assemblies 182A, 182B are both arranged within an inner chamber of the first cable column 106AB. The first drive assembly 182A is connected to the second cable 112A and is arranged to wind-in or wind-out the second cable 112A so as to deploy or retract the first canopy 102A to one of a plurality of positions. The second drive assembly 182B is connected to the second cable 112B and is arranged to wind-in or wind-out the second cable 112B so as to deploy or retract the second canopy 102B to one of a plurality of positions. The second cables 112A, 112B can extend through respective slits defined by the first cable column 106AB.

Similarly, the second cable column 108AB includes a first drive assembly 190A and a second drive assembly 190B (both drive assemblies 190A, 190B are arranged in a same or similar manner as the drive assembly 190 of the second cable column 108 of FIG. 1). The first and second drive assemblies 190A, 190B are both arranged within an inner chamber of the second cable column 108AB. The first drive assembly 190A is connected to the third cable 114A and is arranged to wind-in or wind-out the third cable 114A so as to deploy or retract the first canopy 102A to one of a plurality of positions. The second drive assembly 190B is connected to the third cable 114B and is arranged to wind-in or wind-out the third cable 114B so as to deploy or retract the second canopy 102B to one of a plurality of positions. The third cables 114A, 114B can extend through respective slits defined by the second cable column 108AB.

The canopy system 100AB advantageously provides additional covered protection, e.g., for guests from adverse environmental conditions (sun, rain, snow, hail, etc.) and can also utilize at least one common or shared cable column, which can reduce the structures needed to support multiple canopies and can also reduce the impact to guest sightlines, among other benefits.

Shared Canopy Column

In yet other example embodiments, a canopy system can include multiple canopy sets having respective canopies, wherein at least two canopies can be respectively supported by a shared column that functions as a canopy column with respect to one canopy set and as a cable column with respect to another canopy set. An example embodiment is provided below.

Figure 11:
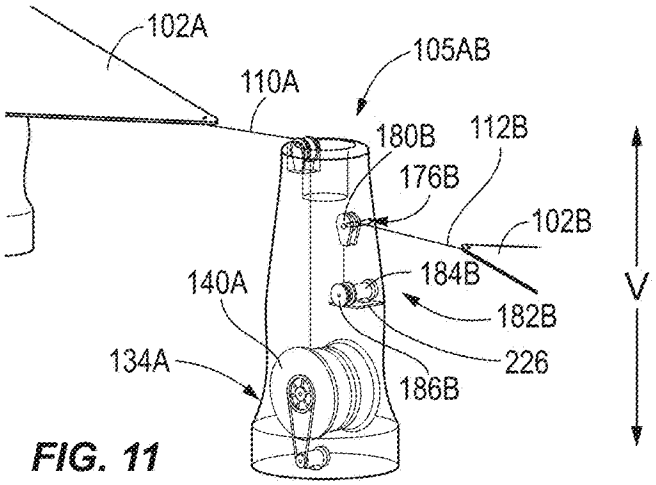
FIG. 11 is a perspective view of an example canopy column that functions as a canopy with respect to one canopy set and a cable column with respect to another canopy set.

FIG. 11 depicts a perspective view of a shared column 105AB that is shared between sets of canopies, including a first canopy set having a first canopy 102A and a second canopy set having a second canopy 102B. The shared column 105AB is shared between the two canopy sets, acting as a canopy column for the first canopy set and as a cable column for the second canopy set. As shown in FIG. 11, the shared column 105AB includes two drive assemblies, including a first drive assembly 134A and a second drive assembly 182B. The first drive assembly 134A is arranged to wind-in or wind-out the first cable 110A and the first canopy 102A. When retracted, the first canopy 102A and the first cable 110A can be wound on a storage drum 140A of the first drive assembly 134A. The first drive assembly 134A can be arranged in a same or similar manner as the drive assembly 134 of the canopy column 104 of FIG. 4, for example. The first drive assembly 134A can be arranged with an inner chamber defined by the shared column 105AB.

Further, the second drive assembly 182B is arranged to wind-in or wind-out the second cable 112B, e.g., to deploy or retract the second canopy 102B. The second drive assembly 182B can be arranged in a same or similar manner as the drive assembly 182 of the first cable column 106 of FIG. 6, for example. In this regard, the second drive assembly 182B is equipped with a winch, or rather, an electric motor 184B and a cable drum 186B upon which the second cable 112B can be wound. The second cable 112B is connected to the cable drum 186B. The cable drum 186B and the electric motor 184B mechanically coupled thereto are disposed within the inner chamber defined by the shared column 105AB. For instance, as shown in FIG. 11, the electric motor 184B can be mounted to a shelf 226 arranged above the storage drum 140A of the first drive assembly 134A along the vertical direction V. The shelf 226 can be cantilevered from an interior surface of the exterior wall of the shared column 105AB and positioned out of the cable and canopy travel path so as not to interfere with the first cable 110A or the first canopy 102A when retracted within the shared column 105AB. Further, the shared column 105AB can include a pulley 180B, which can guide the second cable 112B into and out of a slit 176B defined by the shared column 105AB. The pulley 180B can be an articulating or swivel pulley, for example.

A canopy system employing the shared column 105AB can advantageously combine the functionality of a canopy column and a cable column for respective canopies of different canopy sets. Such an arrangement can reduce the structures needed to support multiple canopies and can also reduce the impact to guest sightlines, among other benefits.

Extendable Columns

In some further example embodiments, a canopy system can include at least one extendable column, or rather, at least one column that is extendable along a vertical direction relative to a neutral position of that column. An example embodiment is provided below.

Figure 12:
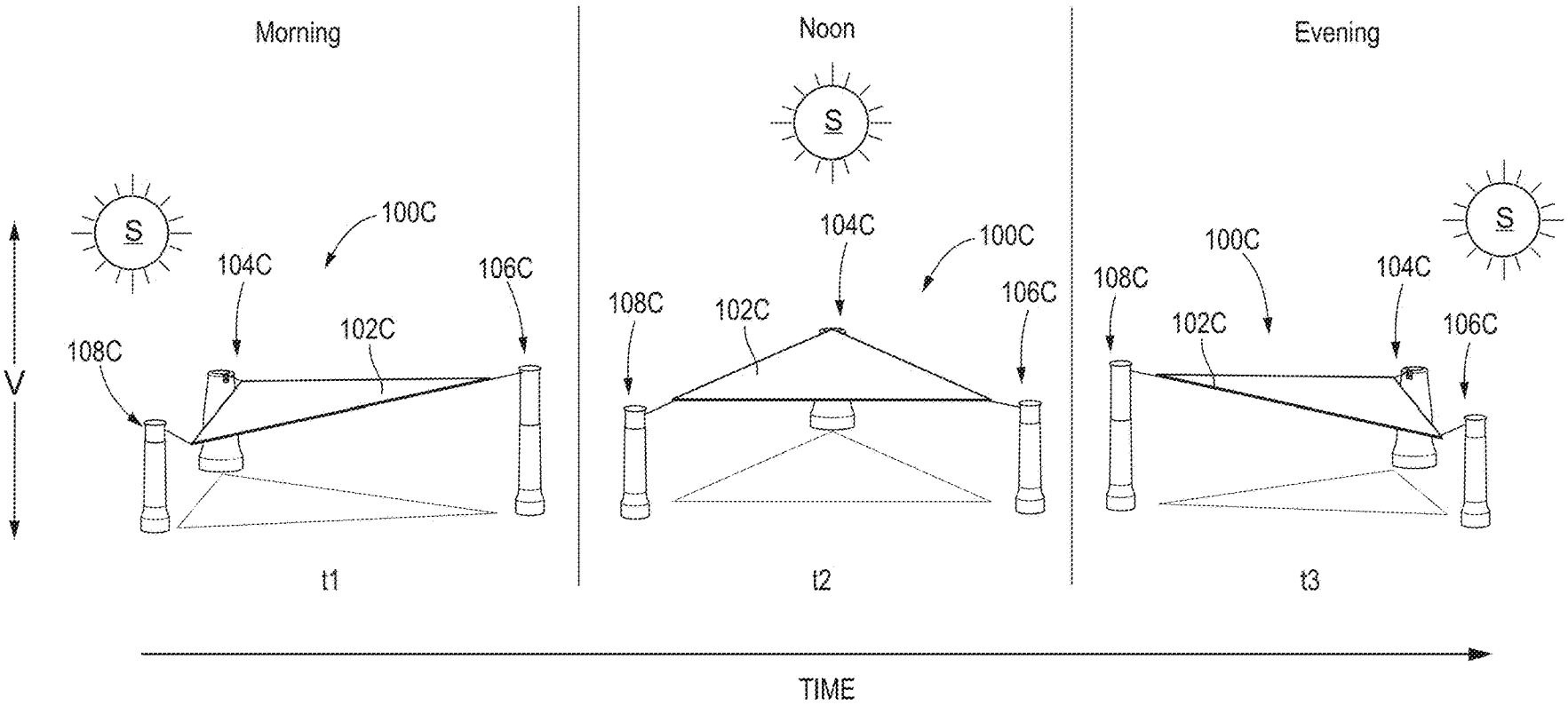
FIG. 12 is a schematic perspective view of a canopy system according to another example embodiment of the present disclosure, with at least one column of the canopy system being extendable.

FIG. 12 shows a schematic view of a canopy system 100C at certain times of a day, with the canopy system 100C having at least one column that is extendable. Specifically, FIG. 12 depicts the canopy system 100C at a first time t1 (e.g., a time of day in the morning), a second time (e.g., noon), and a third time t3 (e.g., a time of day in the afternoon). A sun S is shown in the sky above the canopy system 100C. As will be appreciated, the sun S is located at different positions in the sky relative to the canopy system 100C as the day progresses. To optimize or provide enhanced shaded covered protection for guests from the sun S throughout the day, one or more of the columns can be extended to adjust an angle of the canopy 102C relative to a horizontal reference plane, e.g., based at least in part on the time of day, the actual or estimated position of the sun, an angle of the sun relative to a reference point, etc.

In the example embodiment of FIG. 12, the canopy system 100C includes a canopy column 104C and a pair of extendable cable columns, including a first extendable cable column 106C and a second extendable cable column 108C. The first and second extendable cable columns 1060, 108C are each extendable along the vertical direction V relative to their respective neutral positions, or rather, their respective non-extended positions. The first extendable cable column 106C is shown fully extended at time t1, slightly extended at time t2, and in its neutral position at time t3. The second extendable cable column 108C is shown in its neutral position at times t1 and t2 and fully extended at time t3. The first and second extendable cable columns 106C, 108C can each include caps that telescope relative to their respective bases.

The first and second extendable cable columns 106C, 108C are each extendable along the vertical direction V relative to their respective neutral positions based at least in part on an environmental condition, e.g., a position of the sun or a time of day. Accordingly, at time t1 with the sun S in a first position relative to the canopy system 100C, the first extendable cable column 106C can be fully extended or telescoped upward along the vertical direction V while the second extendable cable column 108C can remain un-extended. At time t2 with the sun S in a second position relative to the canopy system 100C, the first extendable cable column 106C can be extended or telescoped upward along the vertical direction V slightly while the second extendable cable column 108C can remain un-extended. At time t3 with the sub S in a third position relative to the canopy system 100C, the first extendable cable column 106C can be retracted or un-extended along the vertical direction V while the second extendable cable column 108C can be fully extended or telescoped upward along the vertical direction V. Coordinated extension and retraction of the cable columns can optimize or provide enhanced shade for guests, among other benefits. In some other embodiments, the environmental condition can be the presence of rain, and one or more of the columns can be extended to angle the canopy 102C to direct rain water to a particular location, such toward a drain or nearby body of water.

Themed Columns

In some further example embodiments, a canopy system can include at least one themed column. The column can be themed such that a utilitarian aspect of the column can be disguised. An example embodiment is provided below.

Figure 13:
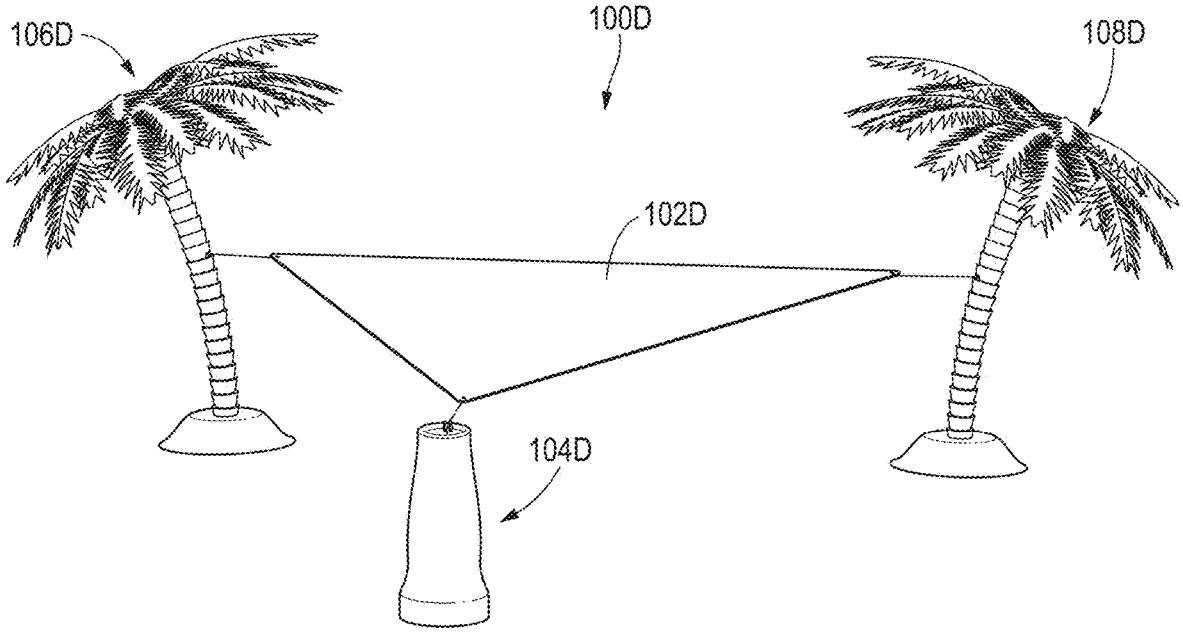
FIG. 13 is a perspective view of a canopy system according to another example embodiment of the present disclosure, with at least one column of the plurality of columns being themed such that a utilitarian aspect of the at least one column is disguised.

FIG. 13 is a perspective view of a canopy system 100D having at least one column that is themed. Specifically, in FIG. 13, the canopy system 100D includes a canopy 102D, a canopy column 104D, a first cable column 106D, and a second cable column 108D. The first and second cable columns 106D, 108D are both themed as palm trees. In this regard, the first and second cable columns 106D, 108D are themed such that their utilitarian aspects are disguised. Other themes for the columns are possible. For instance, instead of palm trees, the first and second cable columns 106D, 108D and/or canopy column 104D can be themed as, without limitation, an airplane, a spaceship, a riverboat, a volcano, a castle, a lighthouse, a skyscraper, the Eiffel tower, a pyramid, other aesthetically interesting structures, etc. The columns 104D, 106D, 108D can have a same theme or different themes. In other aspects, the first and second cable columns 106D, 108D and/or canopy column 104D can be themed as existing structures or buildings.

Figure 14:
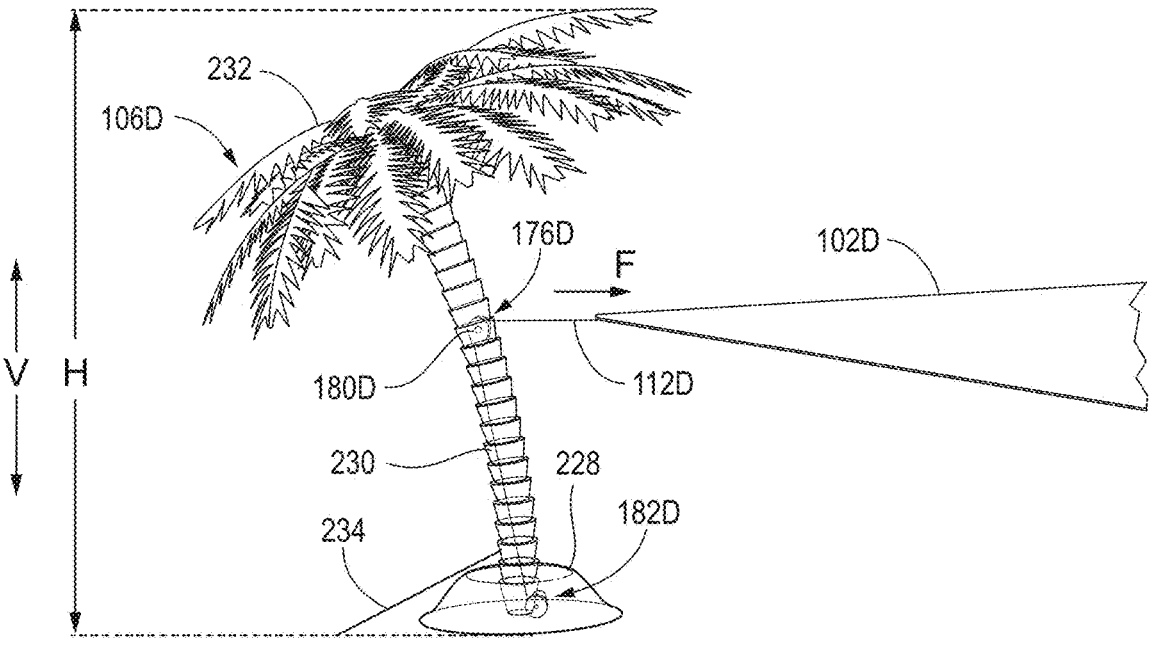
FIG. 14 is a perspective view of one of the themed columns of the canopy system of FIG. 13.

In some aspects, one or more of the themed columns can be arranged to lean in a direction opposite a force the canopy applies on the cable that is arranged to be wound-in or wound-out by the drive assembly of that column. For instance, FIG. 14 is a perspective view of the themed first cable column 106D of the canopy system 100D. The first cable column 106D has a base 228, a trunk 230 extending from the base 228, and a plurality of fronds 232 extending outward from a top or crown of the trunk 230. As depicted, the first cable column 106D is arranged to lean in a direction opposite a force F the canopy 102D applies on the second cable 112D arranged to be wound-in or wound-out by the drive assembly 182D of the first cable column 106D. Leaning the trunk 230 away from the force F can provide a counterforce to the force F and can lower the center of mass of the first cable column 106D, which can enhance the loading capability of the first cable column 106D and provide enhanced stability. Less material may be needed for a leaning column. Notably, the themed palm tree can disguise or mask the utilitarian aspect of the leaning column, namely because at least some palm trees (e.g., coconut palm trees) typically lean with respect to the vertical direction V. In this way, the "leaning" utilitarian aspect of the first cable column 106D can be rolled into the theme. Moreover, in some additional aspects, the first cable column 106D can be supported by one or more guide wires 234, which can be disguised as roots or other themed structures, such as a mermaid tail.

In some further aspects, to further disguise the utilitarian aspect of the first cable column 106D, the trunk 230 can define the slit 176D through which the second cable 112D extends at approximately a mid-span position of the trunk 230. Accordingly, in this example, approximately half a height H of the first cable column 106D is arranged above the slit 176D along the vertical direction V. In some embodiments, at least one half of the total height H of the first cable column 106D is arranged above the slit 176D along the vertical direction V. In other embodiments, at least one third of the total height H of the first cable column 106D is arranged above the slit 176D along the vertical direction V. Arranging a substantial portion of the total height of a column above a slit or above where a cable enters and exits the column can further disguise the utilitarian aspect of the column.

Self-Pleating Canopy

In some further example embodiments, a canopy system can include a self-pleating canopy with cable columns and cables that facilitate the self-pleating aspects of the canopy. The self-pleating canopy can include pleats (e.g., predefined folds or ribs). The pleats can be formed of a material that is more rigid than the main body of the canopy but also flexible to allow for the canopy to be wound on a drum. The pleats can act as fold lines along which the main body of the canopy can be folded. In such embodiments, the canopy can be considered a "self-pleating" canopy. The canopy can be self-pleating such that, upon entry of the canopy into the inner chamber of the canopy column, the canopy can automatically furl into shape to be wound upon a storage drum. That is, the canopy can self-fold along the pleats to assume a desired shape to be wound on the storage drum. Further, upon exit of the canopy from the inner chamber, the canopy can automatically unfurl. In some embodiments, a canopy guide or storage system can facilitate the furling and unfurling of the canopy. Example embodiments are provided below.

Figure 15:
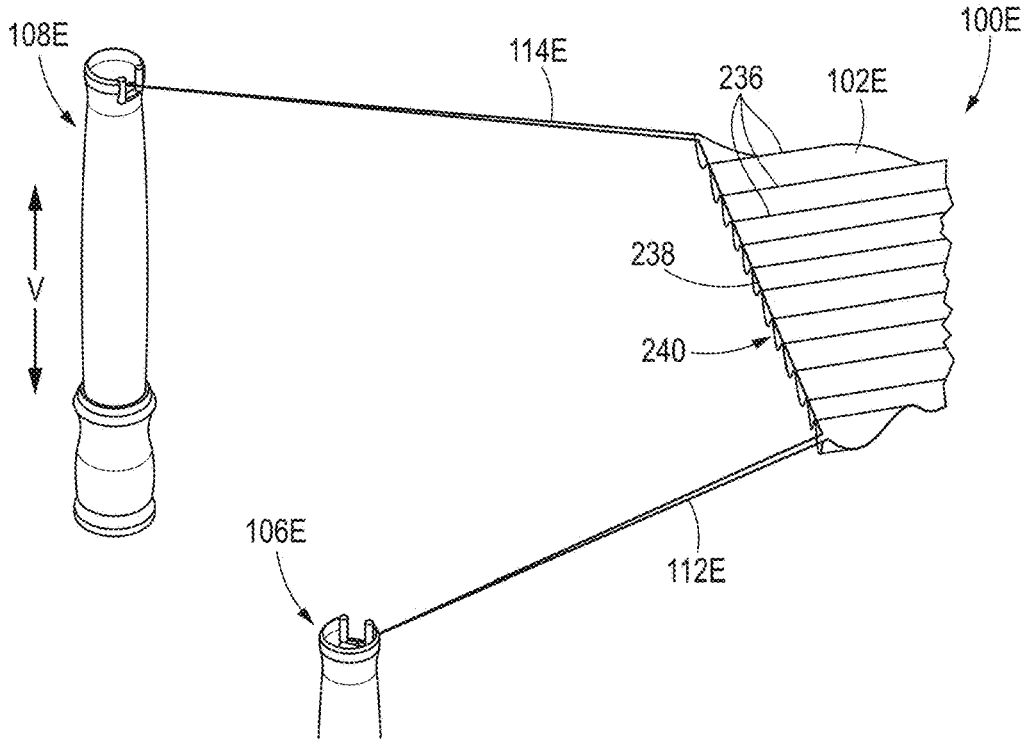
FIGS. 15 and 16 illustrate a canopy system having a self-pleating canopy according to one example embodiment of the present disclosure.
Figure 16:
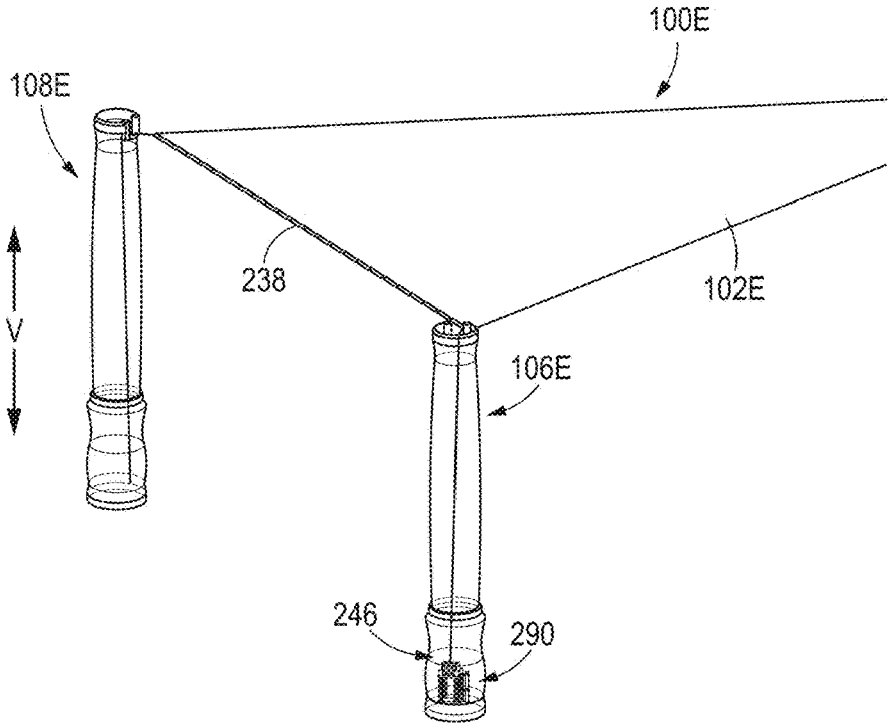

FIGS. 15 and 16 illustrate a canopy system 100E having a canopy 102E that is self-pleating, or rather, a self-pleating canopy. The canopy 102E has pleats 236 (or predefined folds or ribs) arranged in a parallel configuration. The canopy 102E can be folded along the pleats 236 when stowed. For the depicted embodiment of FIG. 15, the canopy system 100E includes a first cable connected to a first corner of the canopy 102E (the first corner and first cable are not depicted in FIG. 15), a second cable 112E connected to a second corner of the canopy 102E, and a third cable 114E connected to a third corner of the canopy 102E. The first cable can be wound on a drum in a canopy column (not pictured in FIG. 15) and the second and third cables 112E, 114E can be wound on cable drums within their respective first and second cable columns 106E, 108E. In addition, the canopy system 100E includes a pleating cable 238 that is coupled with the canopy 102E as well as with the first and second cable columns 106E, 108E. As shown in FIG. 16, one end of the pleating cable 238 can be fixed, e.g., within one of the cable columns, and the other end of the pleating cable 238 can be coupled with a drive assembly winch of the other cable column. The winch can be used to wind-in or wind-out the pleating cable 238 during deployment or retraction of the canopy 102E.

Figure 17:
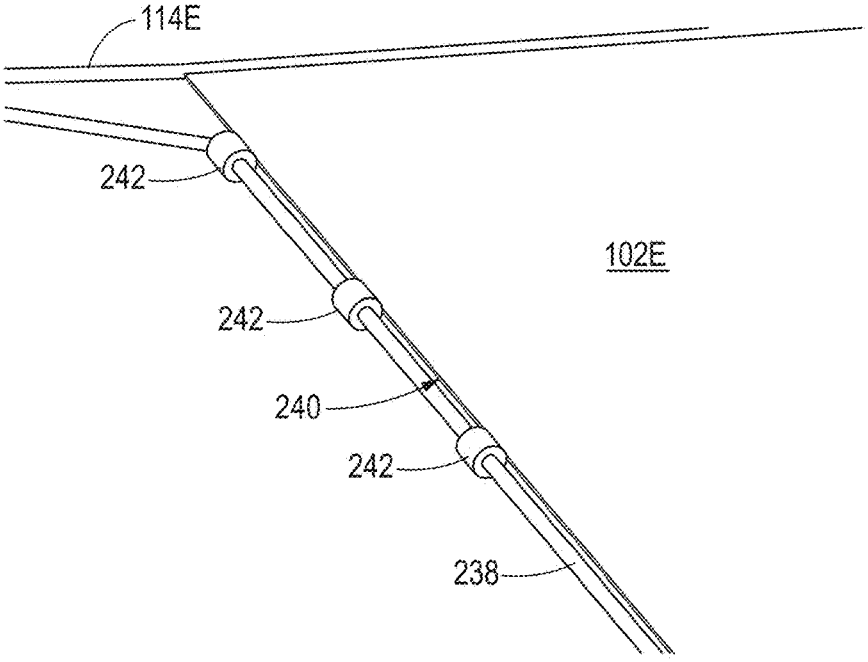
FIGS. 17 and 18 illustrate embodiments of a pleating cable coupled with a self-pleating canopy.
Figure 18:
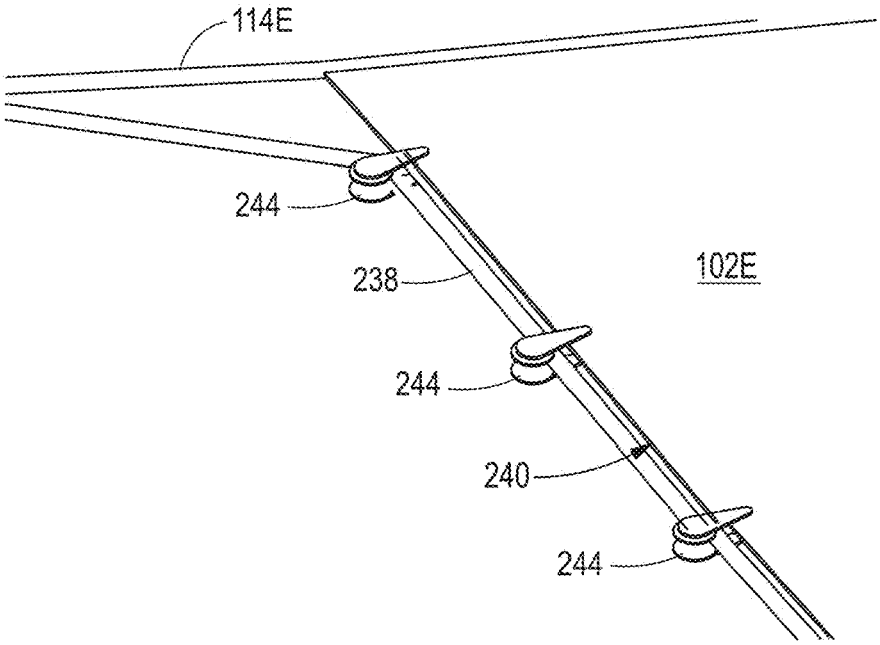

The pleating cable 238 can be coupled with an edge 240 of the canopy 102E located between the second and third corners of the canopy 102E, or stated differently, the edge 240 facing the first and second cable columns 106E, 108E. As shown in FIG. 17, in some example embodiments, the pleating cable 238 can be coupled with the canopy 102E by way of eyelets 242, or low-friction bearings, that couple with the edge 240 of the canopy 102E. As shown in FIG. 18, in some example embodiments, the pleating cable 238 can be coupled with the canopy 102E by way of pulleys 244 that couple with the edge 240 of the canopy 102E. The pulleys 244 can be arranged along the edge 240 and spaced from one another. The pulleys 244 can allow the pleating cable 238 to move relative to the canopy 102E, e.g., when a drive assembly wind-ins or wind-outs the pleating cable 238.

With reference to FIGS. 15 and 16, when the canopy 102E is moved from a deployed position (FIG. 16) to a stowed position, the canopy 102E can self-pleat or fold unto itself so that it may be moved into and stored in the canopy column in a strategic manner. In at least some example embodiments, the second and third cables 112E, 114E can be wound-out while the first cable can be wound-in to retract the canopy 102E toward the canopy column. At the same time, a pleated cable drive assembly 246 can wind-out the pleating cable 238 to provide slack for the pleating cable 238 to travel with the canopy 102E as it is moved toward the canopy column. Advantageously, as the canopy 102E self-pleats as it moves toward the canopy column, the tension on the pleating cable 238 can be controlled or can passively provide tension to prevent the canopy 102E from drooping on the ground or otherwise being arranged below a predetermined height above the ground.

When the canopy 102E is moved to the deployed position, the canopy 102E can unfold along the pleats 236. In at least some example embodiments, the second and third cables 112E, 114E can be wound-in while the first cable is wound-out to deploy the canopy 102E. At the same time, the pleated cable drive assembly 246 can wind-in the pleating cable 238 to provide tension on the pleating cable 238 as it travels with the canopy 102E away from the canopy column. Beneficially, as the canopy 102E unfolds along the pleats 236 as it moves away from the canopy column, the tension on the pleating cable 238 can be controlled or can passively provide tension to prevent the canopy 102E from drooping on the ground or otherwise being arranged below a predetermined height above the ground.

Pleated Tension System

In some further example embodiments, a canopy system can include a pleated tension system arranged to passively tension the pleating cable. An example embodiment is provided below.

Figure 19:
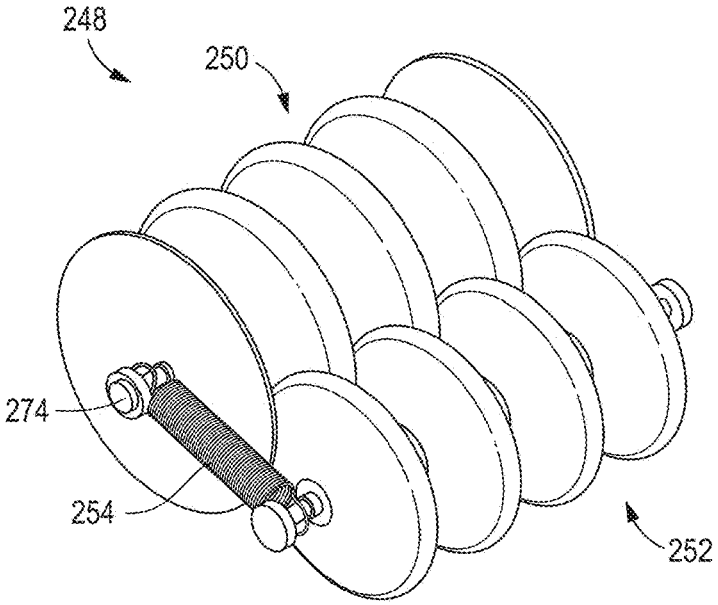
FIGS. 19 and 20 illustrate a pleated tension system for passively tensioning a pleating cable according to one example embodiment of the present disclosure.
Figure 20:
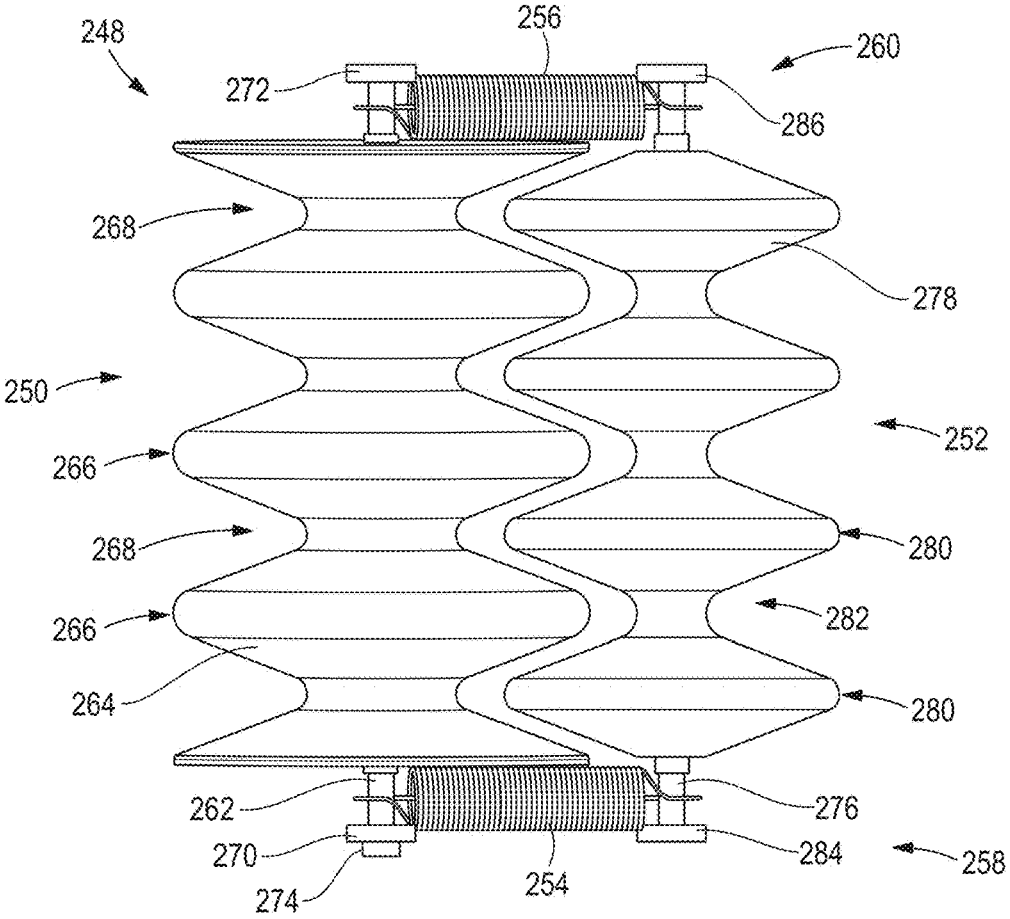

FIGS. 19 and 20 illustrate a pleated tension system 248 for passively tensioning a pleating cable, such as the pleating cable 238 described above. The pleated tension system 248 can be arranged within a cable column, for example. As depicted, the pleated tension system 248 can include a storage spool 250 and a compression spool 252. The storage spool 250 and the compression spool 252 are coupled with one another by a first spring 254 and a second spring 256 arranged at opposing first and second ends 258, 260 of the pleated tension system 248.

The storage spool 250 includes a shaft 262 and a drum 264 mounted on the shaft 262. The drum 264 has annular ridges 266 defining a plurality of relief channels or grooves 268 that retain a pleating cable in an organized fashion on the drum 264. The annular ridges 266 have tapered sidewalls that direct the pleating cable into the grooves 268. The first spring 254 is coupled with the shaft 262 at the first end 258 while the second spring 256 is coupled with the shaft 262 at the second end 260. The shaft 262 is capped at both ends by retainers 270, 272 that keep the first and second springs 254, 256 retained on the shaft 262. The storage spool 250 can also include an encoder 274 arranged to sense a position of the storage spool 250. Readouts from the encoder 274 can be provided to a controller, and based at least in part on the readouts, one or more motors can be controlled to wind-in or wind-out at a changed rate, e.g., faster or slower, so that the tension on the pleating cable can be adjusted.

The compression spool 252 includes a shaft 276 and a drum 278 mounted on the shaft 276. The drum 278 has annular ridges 280 defining a plurality of relief channels or grooves 282 that retain the pleating cable in an organized fashion on the drum 278. The annular ridges 280 have tapered sidewalls that direct the pleating cable into the grooves 282. The annular ridges 280 of the drum 278 have smaller diameters than the annular ridges 266 of the drum 264. Moreover, the annular ridges 280 of the drum 278 are received within respective ones of the grooves 268 defined by the annular ridges 266 of the drum 264 while the annular ridges 266 of the drum 264 are received within respective ones of the grooves 282 defined by the annular ridges 280 of the drum 278. In this regard, the annular ridges 266, 280 are interleaved. The first spring 254 is coupled with the shaft 276 at the first end 258 while the second spring 256 is coupled with the shaft 276 at the second end 260. The shaft 276 is capped at both ends by retainers 284, 286 that keep the first and second springs 254, 256 retained on the shaft 276.

A pleating cable received by the pleated tension system 248 in an alternating manner on the storage spool 250 and the compression spool 252. For instance, a pleating cable can travel from a first groove of the grooves 268 of the storage spool 250 to a first groove of the grooves 282 of the compression spool 252, back to the storage spool 250 in a second groove of the grooves 268 (e.g., with second groove being adjacent to the first groove of the grooves 268), and then back to compression spool 252 in a second groove of the grooves 282 (e.g., with second groove being adjacent to the first groove of the grooves 282), and so on.

During operation, the spring-loaded interaction between the storage spool 250 and the compression spool 252 can passively provide a predetermined tension (or range of predetermined tension) on the pleating cable 238. In at least some example embodiments, the first and second springs 254, 256 can be specifically stressed and coupled with the storage spool 250 and the compression spool 252 so as to be constant torque springs. In this way, as noted, a predetermined range of tension can be applied to the pleating cable. If the encoder 274 senses a position of the storage spool 250 outside of a predetermined position range, readouts from the encoder 274 can be provided to a controller, and based at least in part on the readouts, an electric motor (e.g., in another cable column) can be controlled to wind-in or wind-out at a changed rate, e.g., faster or slower, so that the storage spool can be returned within the predetermined position range and the tension on the pleating cable can be adjusted.

Figure 21:
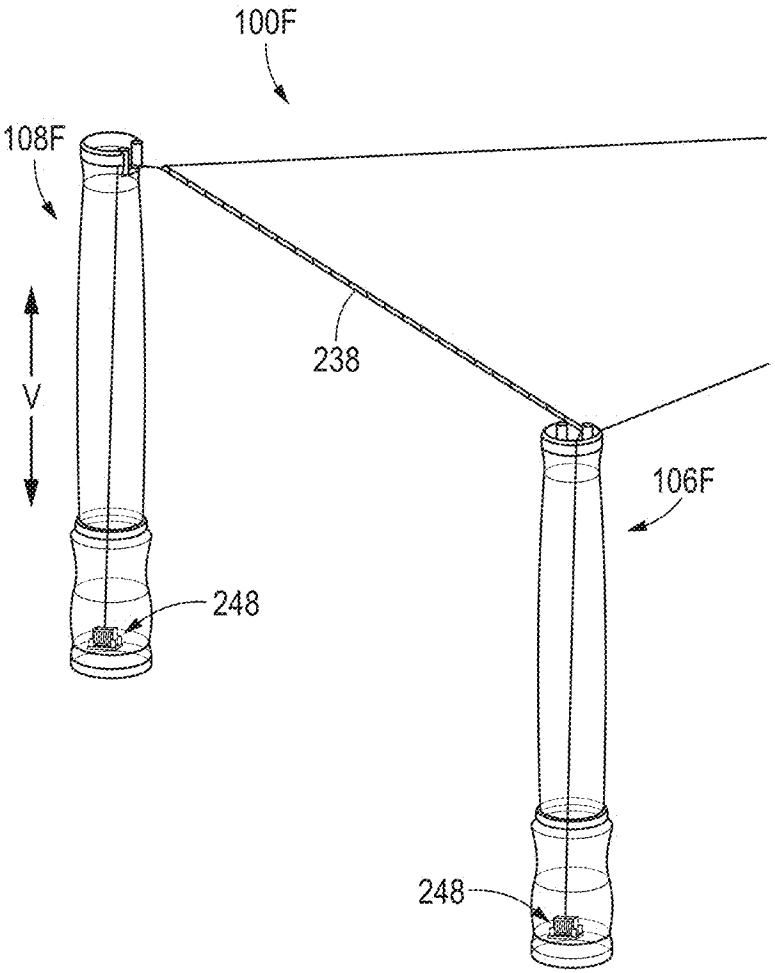
FIG. 21 illustrates a canopy system having a pleated tension system according to one example embodiment of the present disclosure.

FIG. 21 illustrates an example canopy system 100F implementing at least one pleated tension system 248. For the depicted embodiment of FIG. 21, first and second cable columns 106F, 108F each include pleated tension systems 248. The pleated tension systems 248 can passively control the tension on the pleating cable 238, e.g., as described above.

Passive Tension System

In some example embodiments, a canopy system can include a passive tension system that can be used to automatically adjust a spooling/unspooling speed of a cable, or rather, a winding-in/winding-out speed of a cable. An example embodiment is provided below.

Figure 22:
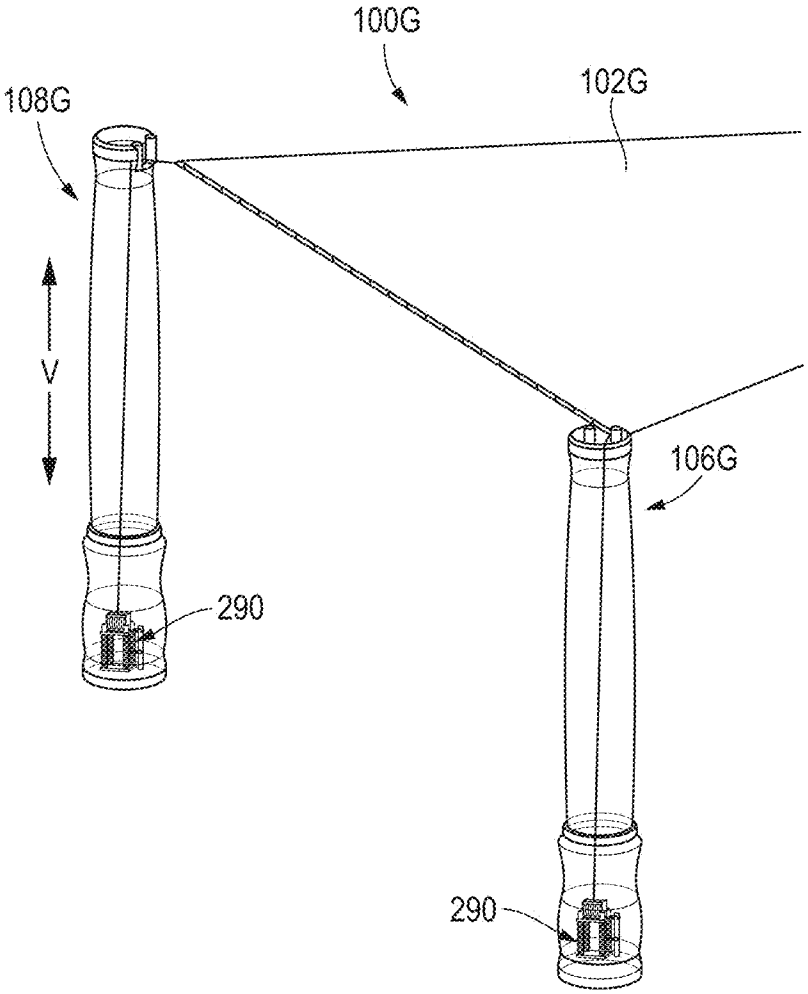
FIGS. 22, 23, and 24 illustrate a tension system according to one example embodiment of the present disclosure.
Figure 23:
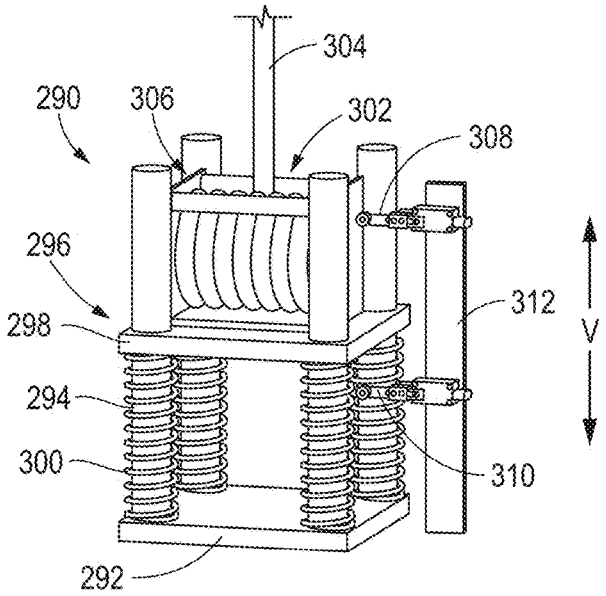
Figure 24:
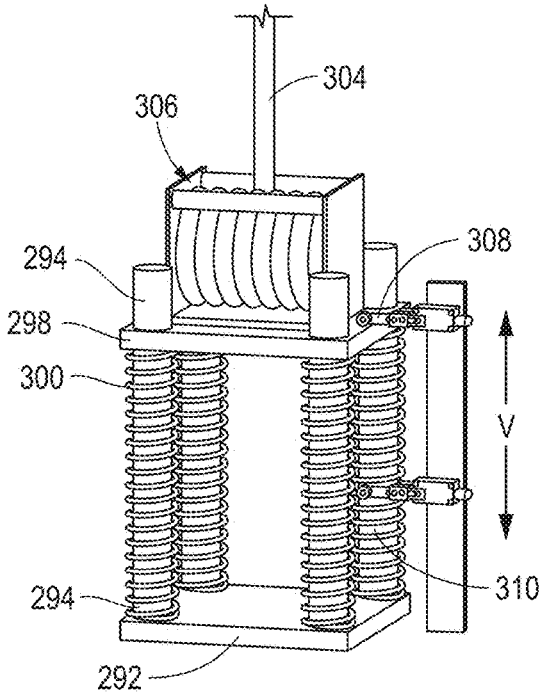

FIGS. 22, 23, 24 illustrate a tension system 290 according to an example embodiment of the present disclosure. The tension system 290 includes a base plate 292, columns 294 extending from the base plate 292, and a movable assembly 296. The movable assembly 296 can include a movable plate 298 defining apertures sized to receive respective ones of the columns 294. Springs 300 are wrapped around respective ones of the columns 294 and engage the movable plate 298 at their respective top ends and the base plate 292 at their respective lower ends. The movable plate 298 is movable, e.g., along the vertical direction V. In FIG. 22, the movable plate 298 and the springs 300 are shown in a neutral position. A drive assembly 302 is arranged on the movable plate 298. The drive assembly 302 is equipped with a winch, or rather, an electric motor and a cable drum upon which a cable 304 can be wound.

The tension system 290 includes a sensor system, including an encoder 306, a slack sensor 308, and a tension sensor 310. The slack sensor 308 and the tension sensor 310 are arranged relative to the movable plate 298, with one sensor being arranged above and one sensor being arranged below the movable plate 298. For this embodiment, the slack sensor 308 is arranged above the movable plate 298 while the tension sensor is arranged below the movable plate 298, e.g., along the vertical direction V. The slack sensor 308 and the tension sensor 310 can both be coupled with a support structure 312. The slack sensor 308 and the tension sensor 310 can both be coupled with the encoder 306.

In some instances, the cable 304 can be under too much tension, causing the movable plate 298 to move upward and the springs 300 to extend from their respective neutral positions. The high tension on the cable 304 can cause the movable plate 298 to move upward. In some cases, the movable plate 298 can move upward to engage or be sensed by the slack sensor 308, e.g., as shown in FIG. 23. When this occurs, the slack sensor 308 is activated, and consequently, an electrical signal is routed to the encoder 306. The encoder 306 can convert the electrical signal into a digital readout indicating a position of the movable assembly 296 at the slack sensor 308. The digital readout can be used by a controller of the column to control the electric motor to reduce the tension on the cable 304, such as by winding-out the cable 304 faster to create more slack or less tension in the cable 304 or by winding-in the cable 304 more slowly.

In some instances, the cable 304 can be under too little tension, causing the movable plate 298 to move downward and the springs 300 to compress relative to their respective neutral positions. The slack or lack of enough tension on the cable 304 can cause the movable plate 298 to move downward. In some cases, the movable plate 298 can move downward to engage or be sensed by the tension sensor 310, e.g., as shown in FIG. 24. When this occurs, the tension sensor 310 is activated, and consequently, an electrical signal is routed to the encoder 306. The encoder 306 can convert the electrical signal into a digital readout indicating a position of the movable assembly 296 at the tension sensor 310. The digital readout can be used by a controller of the column to control the electric motor to increase the tension on the cable 304, such as by winding-in the cable 304 faster or by winding-in the cable 304 faster.

In some embodiments, when one cable is controlled to wind-in or wind-out faster or slower to increase or reduce the tension thereon, at least one other cable can be controlled to wind-in or wind-out faster or slower to increase or reduce the tension thereon when a readout of an encoder of a tension system of another column indicates that a position of the movable assembly thereof is at the tension or slack sensor. In this way, the tension systems of respective ones of the columns can be controlled in coordination to control the tension on the cables and canopy.

In some further embodiments, load cells, strain gauges, other force sensing devices, and/or some combination of the foregoing can be used on, in, or near the drive assemblies of a canopy system to sense the tension on their respective cables, e.g., at all times, at predetermined time intervals, upon a condition being satisfied, during deployment or retraction of the canopy, etc. In some embodiments, electric current sensing of the electric motors of the drive assemblies can be implemented to sense and/or derive the tension on the cables. In yet further embodiments, a spring lock or spring locks can be activated to lock out the springs 300 and have a hard connection, e.g., when a target tension is reached in the cables, which can be sensed per one of the techniques noted above.

Figure 25:
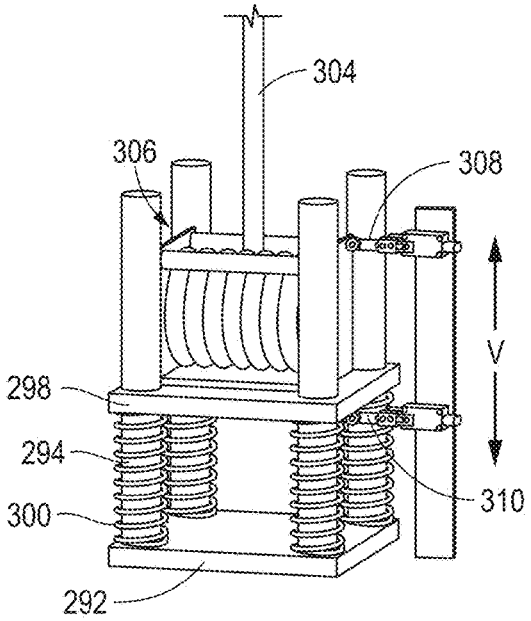
FIG. 25 illustrates a canopy system having a tension system according to one example embodiment of the present disclosure.

FIG. 25 illustrates an example canopy system 100G implementing at least one tension system 290. For the depicted embodiment of FIG. 25, first and second cable columns 106G, 108G each include tension systems 290, which can be used to sense the tension on their respective tension cables. FIG. 16 shows the canopy system 100E having at least one tension system 290 arranged to sense the tension on the pleating cable 238. In this regard, the tension system 290 can be used to sense the tension on a tension cable or a pleating cable.

Passive Canopy Rotator

In some further example embodiments, a canopy system can include a canopy storage guide for guiding a pleated canopy into a stowed position within a canopy column. Example embodiments are provided below.

Figure 26:
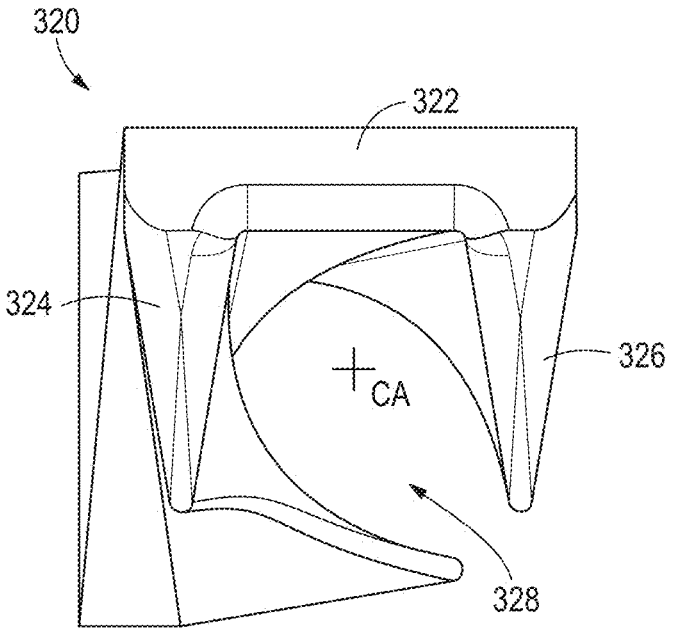
FIGS. 26 and 27 illustrate a canopy rotator according to one example embodiment of the present disclosure.
Figure 27:
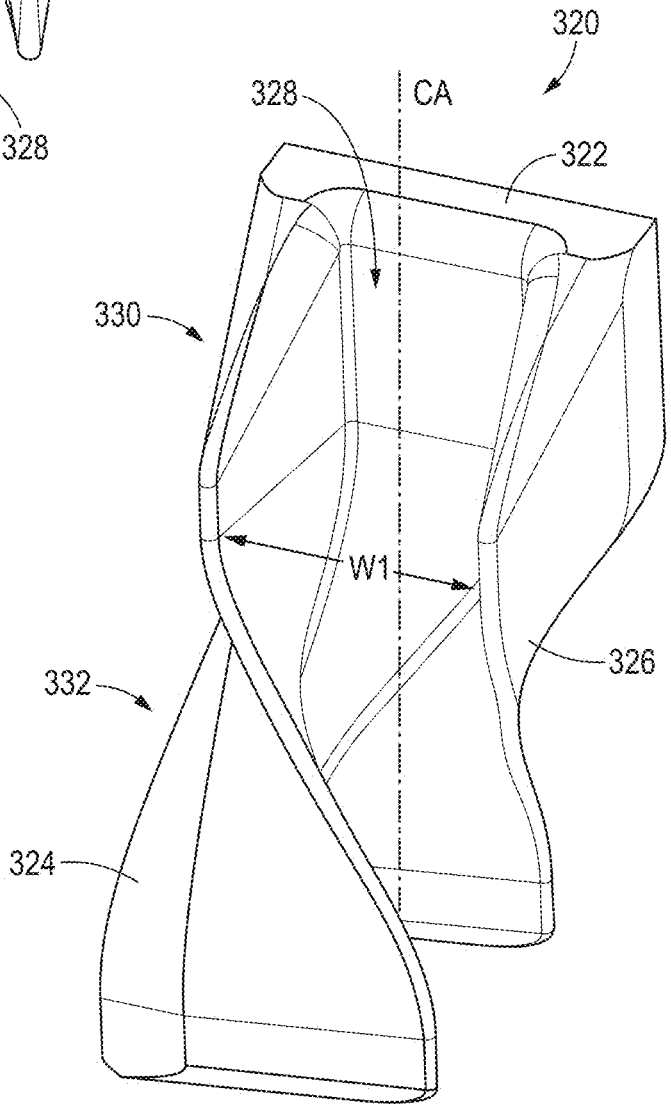

FIGS. 26 and 27 illustrate a canopy rotator 320 that can be arranged within a canopy column, according to one example embodiment of the present disclosure. The canopy rotator 320 is generally arranged to passively rotate a canopy being moved therethrough, e.g., so that the canopy is rotated by a predefined rotation angle, such as ninety degrees (90°). The canopy rotator 320 can be arranged within a canopy column, such as just below or at a same height of a port of the canopy column, wherein the port provides an ingress/egress for the canopy to enter or exit the canopy column. In some example embodiments, the canopy rotator 320 can be arranged in an interior of the canopy column at a top of thereof.

As shown in FIGS. 26 and 27, the canopy rotator 320 defines a central axis CA and includes a backbone 322 and opposing walls 324, 326. The backbone 322 extends between and connects the opposing walls 324, 326. The backbone 322 and the opposing walls 324, 326 define a canopy chute 328 through which a canopy can be passed through. The canopy chute 328 can be an open-ended chute, e.g., as shown in FIGS. 26 and 27.

The canopy rotator 320 can include a receiving port 330 and a rotator 332, which can be formed as separate components or integrally as a monolithic structure. The receiving port 330 can receive an incoming canopy being retracted into a canopy column. For the receiving port 330, the opposing walls 324, 326 are arranged generally parallel to one another and do not twist or spiral along the central axis CA, and the backbone 322 is arranged perpendicular to the opposing walls 324, 326. For the rotator 332, the backbone 322 and the opposing walls 324, 326 are arranged in helical relation to the central axis CA. That is, the backbone 322 and the opposing walls 324, 326 spiral or twist with respect to the central axis CA. In this regard, a canopy passing through the rotator 332 is rotated, e.g., so that the canopy is rotated by a predefined rotation angle, such as ninety degrees (90°). Rotating the canopy can allow the canopy to fold down pleated sections one on top of another, e.g., on a storage drum or on a storage platform. For the depicted embodiment of FIGS. 26, 27, the rotator 332 is arranged so as to rotate a canopy passing through the canopy chute 328 by ninety degrees (90°). However, in other embodiments, the rotator 332 can be arranged so as to rotate a canopy passing through the canopy chute 328 by other predefined rotation angles. A width W1 of the canopy chute 328 defined between distal ends of the opposing walls 324, 326 can remain substantially constant W along the length of the canopy chute 328. Further, when a canopy is moved from a stowed position to a deployed position, the canopy rotator 320 can facilitate the unfolding of pleated sections of the canopy as it passes therethrough.

Figure 28:
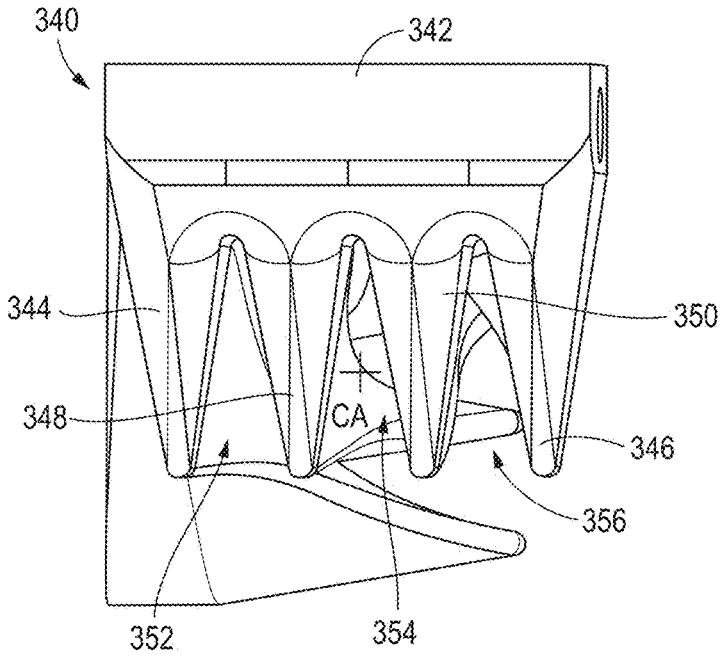
FIGS. 28 and 29 illustrate a canopy rotator according to another example embodiment of the present disclosure.
Figure 29:
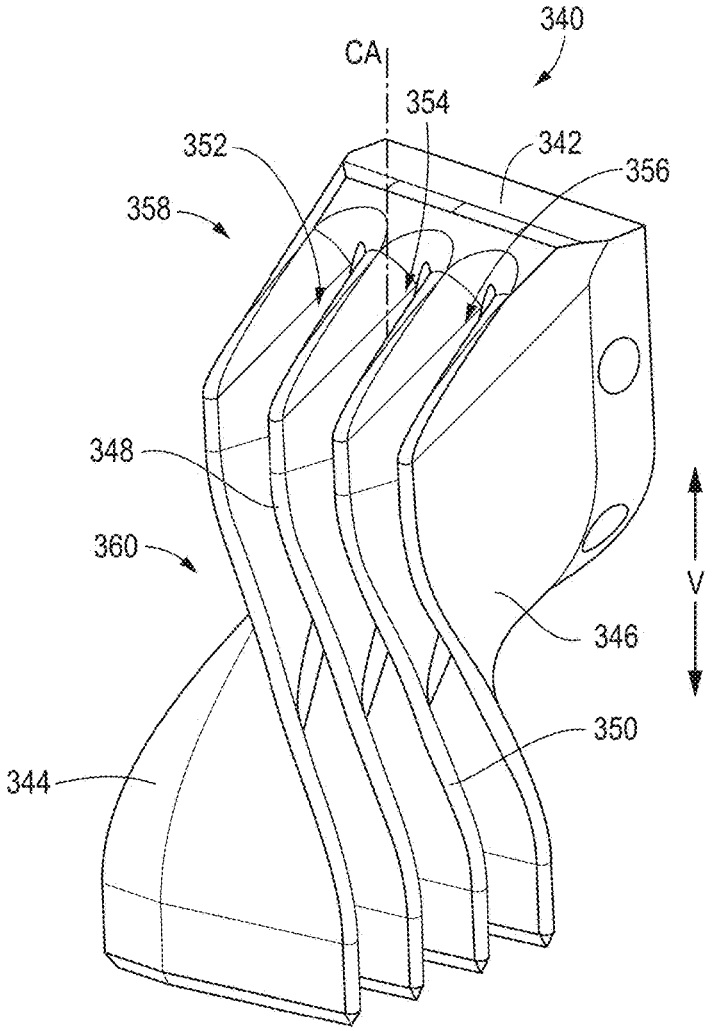

FIGS. 28 and 29 illustrate a canopy rotator 340 that can be arranged within a canopy column, according to another example embodiment of the present disclosure. Like the canopy rotator 320 of FIGS. 26 and 27, the canopy rotator 340 of FIGS. 28 and 29 is generally arranged to passively rotate a canopy being moved therethrough, e.g., so that the canopy is rotated by a predefined rotation angle, such as ninety degrees (90°). The canopy rotator 340 defines a central axis CA and includes a backbone 342, first and second outer walls 344, 346, and at least one internal wall. For the depicted embodiment of FIGS. 28 and 29, the canopy rotator 340 includes a first internal wall 348 and a second internal wall 350. The first and second outer walls 344, 346 and the first and second internal walls 348, 350 each extend from the backbone 342 and are spaced from one another. Chutes can be defined between the walls. For instance, a first chute 352 can be defined between the first outer wall 344 and the first internal wall 348, a second chute 354 can be defined between the first internal wall 348 and the second internal wall 350, and a third chute 356 can be defined between the second internal wall 350 and the second outer wall 346. The backbone 342 can also define each of the chutes 352, 354, 356.

The canopy rotator 340 can include a receiving port 358 and a rotator 360, which can be formed as separate components or integrally as a monolithic structure. The receiving port 358 can receive an incoming canopy being retracted into a canopy column. For the receiving port 358, the first and second outer walls 344, 346 and the first and second internal walls 348, 350 are arranged generally parallel to one another and do not twist or spiral along the central axis CA, and the backbone 342 is arranged perpendicular to the walls 344, 346, 348, 350. For the rotator 360, the backbone 342 and the first and second outer walls 344, 346 and the first and second internal walls 348, 350 are arranged in helical relation to the central axis CA. That is, the backbone 342, the first and second outer walls 344, 346, and the first and second internal walls 348, 350 spiral or twist with respect to the central axis CA. Accordingly, a canopy passing through the rotator 360 can be received in the first, second, and third chutes 352, 354, 356 and rotated by a predefined rotation angle, such as ninety degrees (90°). Rotating the canopy can allow the canopy to fold down pleated sections one on top of another, as noted above.

For the depicted embodiment of FIGS. 28 and 29, the rotator 360 is arranged so as to rotate a canopy passing through the chutes 352, 354, 356 by ninety degrees (90°). However, in other embodiments, the rotator 360 can be arranged so as to rotate a canopy passing through the chutes 352, 354, 356 by other predefined rotation angles. The width of each of the first, second, and third chutes 352, 354, 356 can remain substantially constant along the length of the rotator 360. Further, when a canopy is moved from a stowed position to a deployed position, the canopy rotator 360 can facilitate the unfolding of pleated sections of the canopy as it passes therethrough.

Passive Variable Canopy Storage System

In some further example embodiments, a column of a canopy system can include a variable canopy storage system. An example embodiment is provided below.

Figure 31:
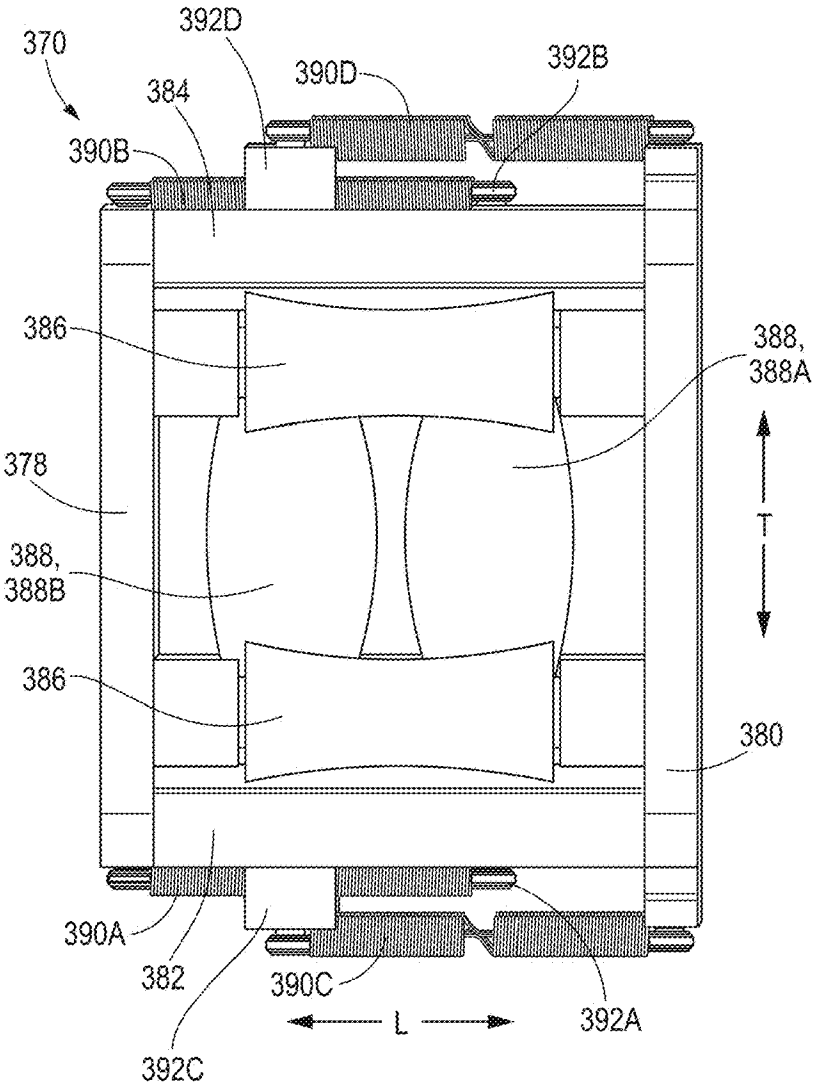
FIGS. 30 and 31 illustrate a variable canopy storage system according to one example embodiment of the present disclosure.
Figure 30:
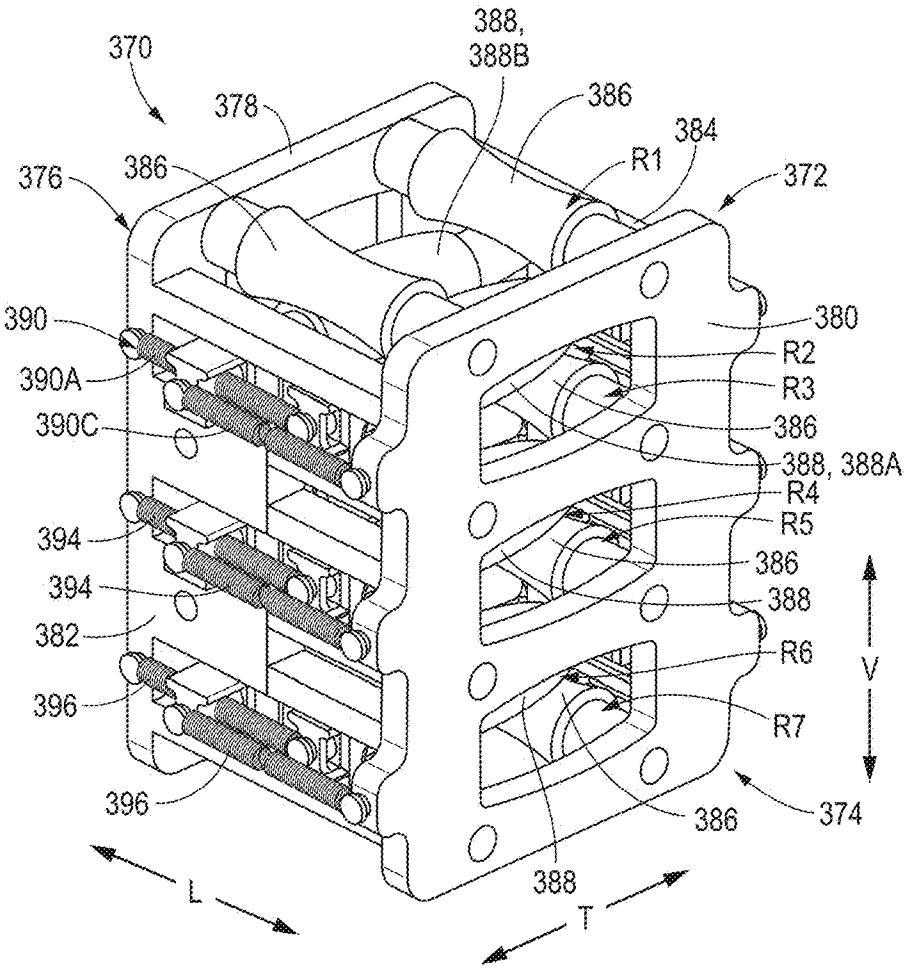

FIGS. 30 and 31 illustrate a variable canopy storage system 370 that can be incorporated into a canopy column of a canopy system. For reference, the variable canopy storage system 370 defines a lateral direction L, a transverse direction T, and the vertical direction V, which are mutually perpendicular to one another. The variable canopy storage system 370 extends between a top end 372 and a bottom end 374, e.g., along the vertical direction V.

As shown in FIGS. 30 and 31, the variable canopy storage system 370 can include a frame 376 having opposing first and second end walls 378, 380 connected by opposing first and second sidewalls 382, 384. The first and second end walls 378, 380 are spaced from one another, e.g., along the lateral direction L, and the first and second sidewalls 382, 384 are spaced from one another, e.g., along the transverse direction T. The variable canopy storage system 370 can include a plurality of guide rollers 386 and a plurality of compression rollers 388. The guide rollers 386 extend between and are connected to the first and second end walls 378, 380 while the compression rollers 388 extend between and connect the first and second sidewalls 382, 384. The guide rollers 386 extend lengthwise along the lateral direction L while the compression rollers 388 extend lengthwise along the transverse direction T. In this manner, the guide rollers 386 and the compression rollers 388 are oriented perpendicular to one another.

The guide rollers 386 and the compression rollers 388 are arranged in rows, with the rows of compression rollers 388 being interleaved with the rows of guide rollers 386. For instance, a first row R1 of the variable canopy storage system 370 can include guide rollers 386, a second row R2 can include compression rollers 388, a third row R3 can include guide rollers 386, a fourth row R4 can include compression rollers 388, a fifth row R5 can include guide rollers 386, a sixth row R6 can include compression rollers 388, and a seventh row R7 can include guide rollers 386. The rows of compression rollers 388 are interleaved with the rows of guide rollers 386. Accordingly, the compression rollers 388 of the second row R2 are arranged between the guide rollers 386 of the first and third rows R1, R3, e.g., along the vertical direction V, the compression rollers 388 of the fourth row R4 are arranged between the guide rollers 386 of the third and fifth rows R3, R5, e.g., along the vertical direction V, and the compression rollers 388 of the sixth row R6 are arranged between the guide rollers 386 of the fifth and seventh rows R5, R7, e.g., along the vertical direction V. In other words, the rows of the variable canopy storage system 370 alternate between guide rollers 386 and compression rollers 388 along the vertical direction V. The guide rollers 386 of a given row can be arranged at a same height while the compression rollers 388 of a given row can be offset from one another, e.g., along the vertical direction V.

Each one of the compression rollers 388 is coupled with a pair of springs, one at each end of the compression roller. Each spring coupled with a compression roller can be coupled with a fixed structure at one end and with that compression roller at the other end. For instance, for the compression rollers 388 of the second row R2 (the top row of compression rollers 388), a first compression roller 388A is coupled with a first spring 390A and a second spring 390B. The first spring 390A extends lengthwise along a direction parallel with the guide rollers 386 (e.g., along the lateral direction L), or stated differently, perpendicular to the compression rollers 388. The first spring 390A is coupled with the first end wall 378 (or fixed structure) at one of its ends and with a first slider 394A at its other end. The first slider 394A is coupled with the first compression roller 388A. The first slider 392A can be slid along a track, e.g., along the lateral direction L. Like the first spring 390A, the second spring 390B extends lengthwise along a direction parallel with the guide rollers 386, or stated another way, perpendicular to the compression rollers 388. The second spring 390B is coupled with the first end wall 378 (or fixed structure) at one of its ends and with a second slider 392B at its other end. The second slider 392B is coupled with the first compression roller 388A. The second slider 392B can be slid along a track, e.g., along the lateral direction L.

Further, for the compression rollers 388 of the second row R2, a second compression roller 388B is coupled with a first spring 390C and a second spring 390D. The first spring 390C extends lengthwise along a direction parallel with the guide rollers 386, or stated differently, perpendicular to the compression rollers 388. The first spring 390C is coupled with the second end wall 380 (or fixed structure) at one of its ends and with a first slider 392C at its other end. The first slider 392C is coupled with the second compression roller 388B. The first slider 392C can be slid along a track, e.g., along the lateral direction L. Like the first spring 390C, the second spring 390D extends lengthwise along a direction parallel with the guide rollers 386, or stated differently, perpendicular to the compression rollers 388. The second spring 390D is coupled with the second end wall 380 (or fixed structure) at one of its ends and with a second slider 392D at its other end. The second slider 392D is coupled with the second compression roller 388B. The second slider 392D can be slid along a track, e.g., along the lateral direction L.

The compression rollers 388 of the fourth and sixth rows R4, R6 can each be coupled with first and second springs as described above for the compression rollers 388 of the second row R2. In at least some example embodiments, the springs 390 associated with the compression rollers 388 of the second row R2 can each have a first predetermined tension (e.g., a relatively low spring tension), the springs 394 associated with the compression rollers 388 of the fourth row R4 can each have a second predetermined tension (e.g., a mid-spring tension), and the springs 396 associated with the compression rollers 388 of the sixth row R6 can each have a third predetermined tension (e.g., a relatively high spring tension).

During operation, the guide rollers 386 of the first row R1 can guide a canopy into the variable canopy storage system 370. The guide rollers 386 of the first row R1 can guide the canopy between the compression rollers 388 of the second row R2. Once past the compression rollers 388 of the second row R2, the guide rollers 386 of the third row R3 can guide the canopy between the compression rollers 388 of the fourth row R4. The canopy can pass through the compression rollers 388 of the fourth row R4 and be guided by the guide rollers 386 of the fifth row R5 between the compression rollers 388 of the sixth row R6. Once past the compression rollers 388 of the sixth row R6, the guide rollers 386 of the seventh row R7 can guide the canopy onto a drum or the like.

As the canopy is moved through compression rollers 388 of a given row, the compression rollers 388 can compress the canopy. As the thickness of the canopy increases between the compression rollers 388 of the given row, the compression rollers 388 can be moved laterally away from one another, which is enabled by the sliders moving along their respective tracks. The springs associated with one compression roller of a given row can be extended in one direction along the lateral direction L (e.g., in a positive lateral direction) while the springs associated with the other compression roller of the given row can be extended in an opposite direction along the lateral direction L (e.g., in a negative lateral direction). This allows the compression rollers 388 of the given row to move away from one another. As the canopy is moved through the variable canopy storage system 370, the canopy is progressively increasingly compressed by the increasing tension of the springs from one row of compression rollers 388 to the next.

When a canopy is moved through the variable canopy storage system 370 to be deployed, the canopy is steadily compressed or increasingly compressed by the constant tension of the springs or increasing tension of the springs from one row of compression rollers 388 to the next. In some embodiments, as the thickness of the canopy decreases between the compression rollers of a given row, the compression rollers 388 can be moved laterally toward one another. Accordingly, the compression rollers 388 are movable along the lateral direction L away from one another or toward one another depending on the direction of travel of the canopy through the variable canopy storage system 370.

In some further embodiments, the variable canopy storage system 370 can be arranged so that each successive roller set is rotated forty-five degrees (45°) with respect to the prior roller set, with each set of rollers including a row of guide rollers and a row of compression rollers. In this way, a first set of rollers of the variable canopy storage system 370 can push a canopy passing therethrough into a rectangular shape, then a second set of rollers, which is arranged adjacent to the first set of rollers and rotated by forty-five degrees (45°) with respect to the first set of rollers, can push on the corners of that rectangle to form a subsequent rectangle, then a third set of rollers, which is arranged adjacent to the second set of rollers and rotated by forty-five degrees (45°) with respect to the second set of rollers (and having the same orientation as the first set of rollers), can pinch the corners of the subsequent rectangle to form a next subsequent rectangle, and so on. Thus, the rotated sets of rollers can help to collimate the canopy.

Figure 32:
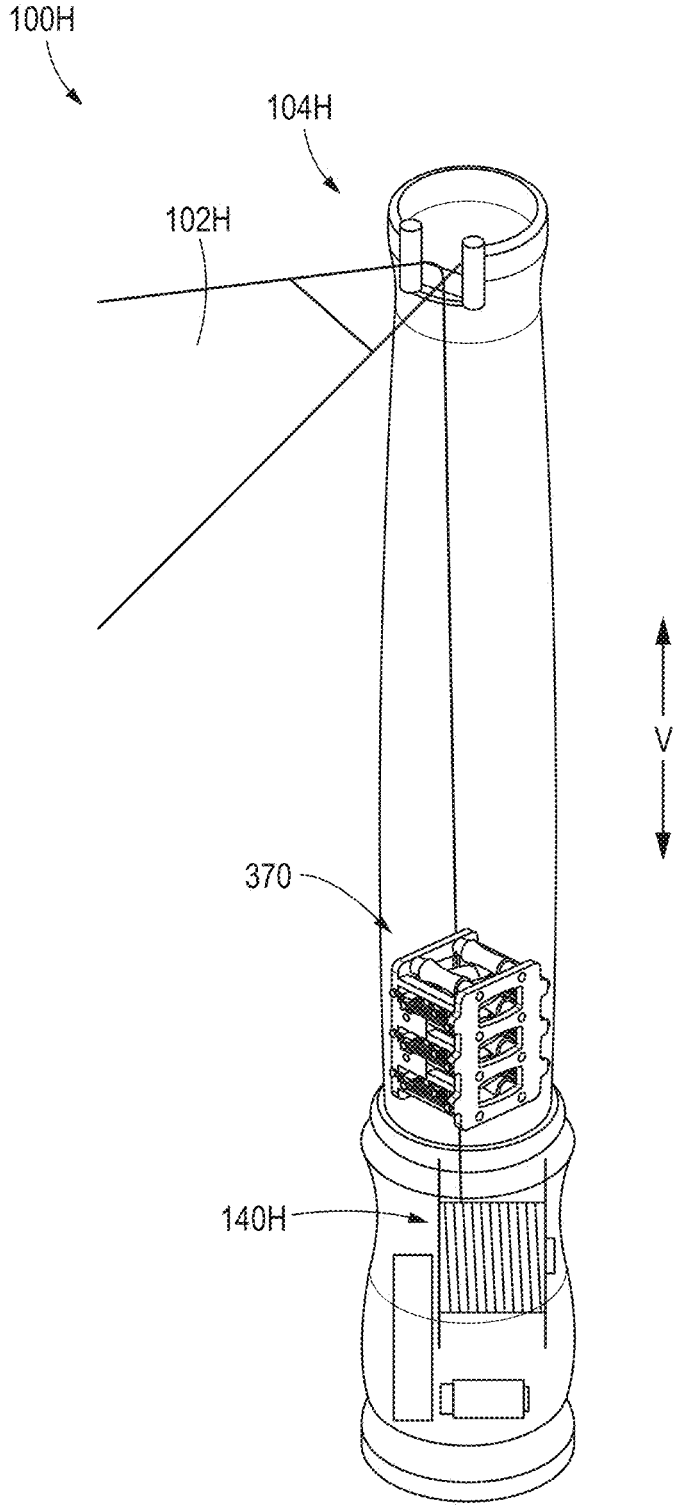
FIG. 32 illustrates a canopy system having a column that includes a variable canopy storage system according to one example embodiment of the present disclosure.

FIG. 32 illustrates a canopy column 104H having the variable canopy storage system 370 incorporated therein. As shown, the variable canopy storage system 370 can be arranged within an inner chamber of the canopy column 104H. The variable canopy storage system 370 can be arranged above a storage drum 140H, e.g., along the vertical direction V. In this way, when the canopy 102H is retracted within the canopy column 104H, the canopy 102H can be compressed and arranged for efficient storage on the storage drum 140H. Further, when the canopy 102H is moved from the stowed position to the deployed position, the canopy 102H can be wound off the storage drum 140H and passed through variable canopy storage system 370 to facilitate its efficient travel through the inner chamber of the canopy column 104H.

Canopy Relief Openings

In some further example embodiments, a canopy system can include a canopy that includes relief openings, e.g., that relieve the impact of wind loading on the canopy. Example embodiments are provided below.

Figure 33:
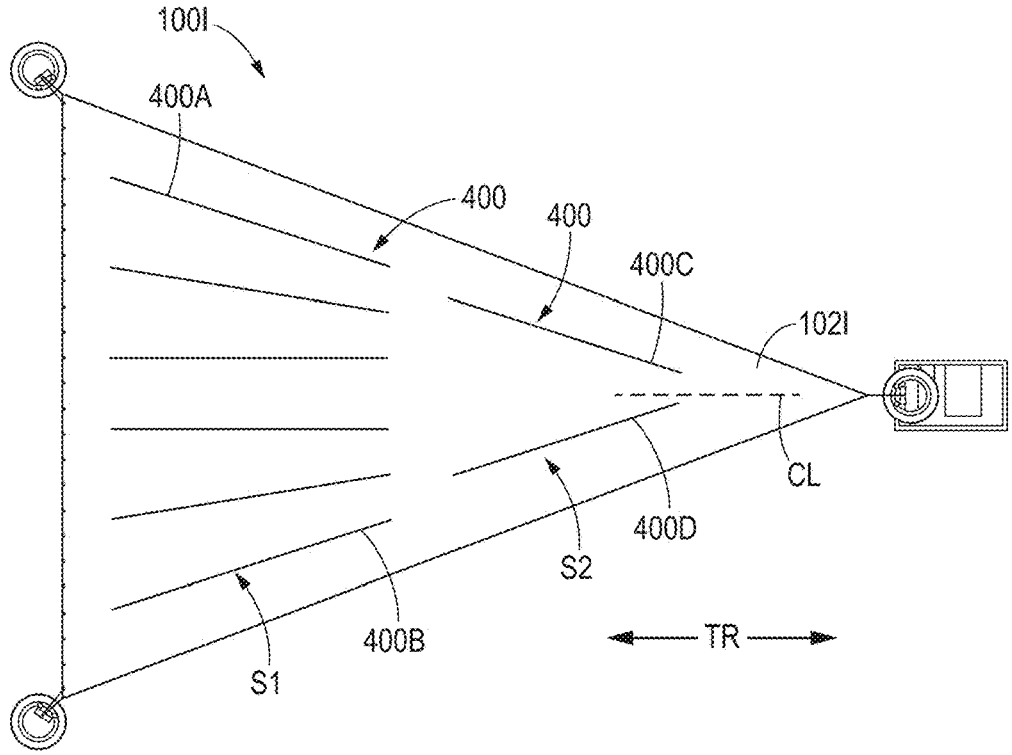
FIGS. 33 and 34 illustrate canopies having breakaway threads according to example embodiments of the present disclosure.

FIG. 33 illustrates a canopy system 1001 that includes a canopy 102I defining relief openings 400 according to one embodiment of the present disclosure. In FIG. 33, the relief openings 400 are arranged linearly and substantially aligned with a direction of travel TR of the canopy 102I (e.g., within forty-five degrees (45°)). In some embodiments, the relief openings 400 can be arranged in sets and each set can include relief openings 400 that converge toward one another with respect to a centerline CL of the canopy 102I. For instance, in a first set S1, first and second outer relief openings 402A, 402B converge toward the centerline CL. In a second set S2, first and second outer relief openings 400C, 400D converge toward the centerline CL. In other embodiments, the relief openings 400 can have other arrangements. Such an arrangement of the relief openings 400 can reduce the drag on the canopy 102I as the canopy 102I is retracted into the canopy column of the canopy system 100I.

Figure 34:
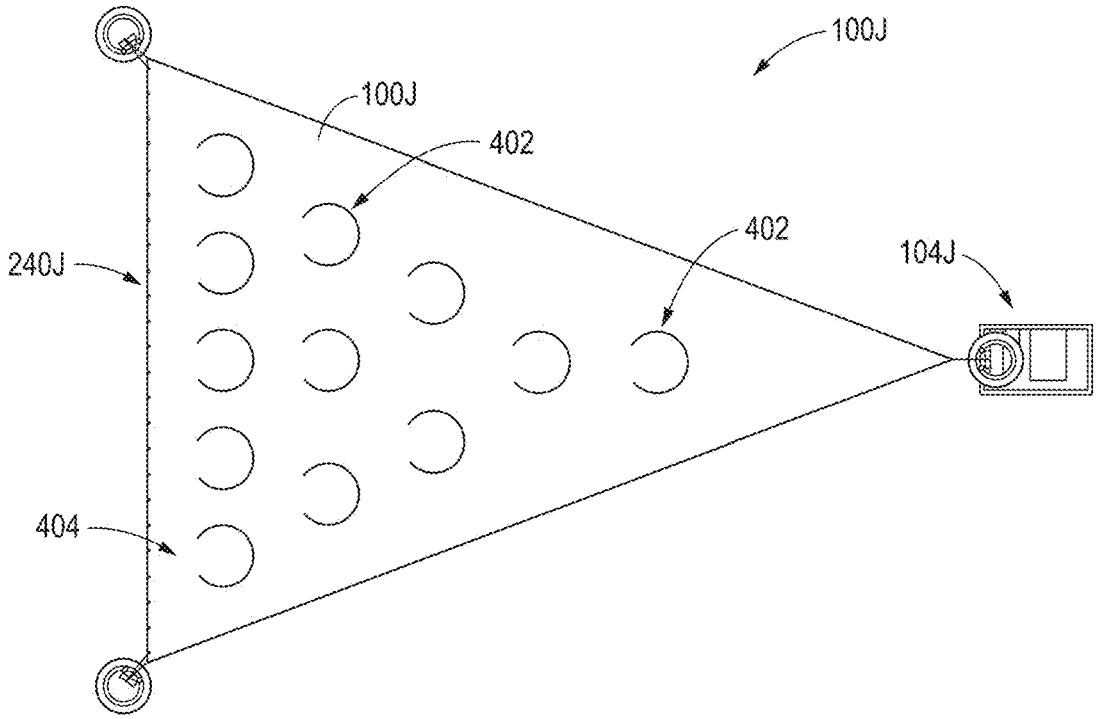

FIG. 34 illustrates a canopy system 100J that includes a canopy 102J defining relief openings 402 according to another embodiment of the present disclosure. In FIG. 34, the relief openings 402 are arranged as arcs (e.g., arcs of greater than two hundred seventy degrees (270°) and less than three hundred sixty degrees (360°). The arcs can be arranged in an array that is generally complementary to the shape of the canopy 102J when deployed, which in this example is a triangle. Each arc can be arranged to have an attachment portion 404 that faces toward an edge 240J of the canopy 102J opposite the canopy column 104J. Such an arrangement of the relief openings 402 can reduce the drag on the canopy 102J as the canopy 102J is retracted into the canopy column 104J.

Multifunctional Column

In some further example embodiments, a column of a canopy system can be multifunctional. For instance, a column can include one or more cameras, speakers, projectors, lights, etc. Canopy columns and/or cable columns of a canopy system can be multifunctional. Example embodiments are provided below.

Figure 35:
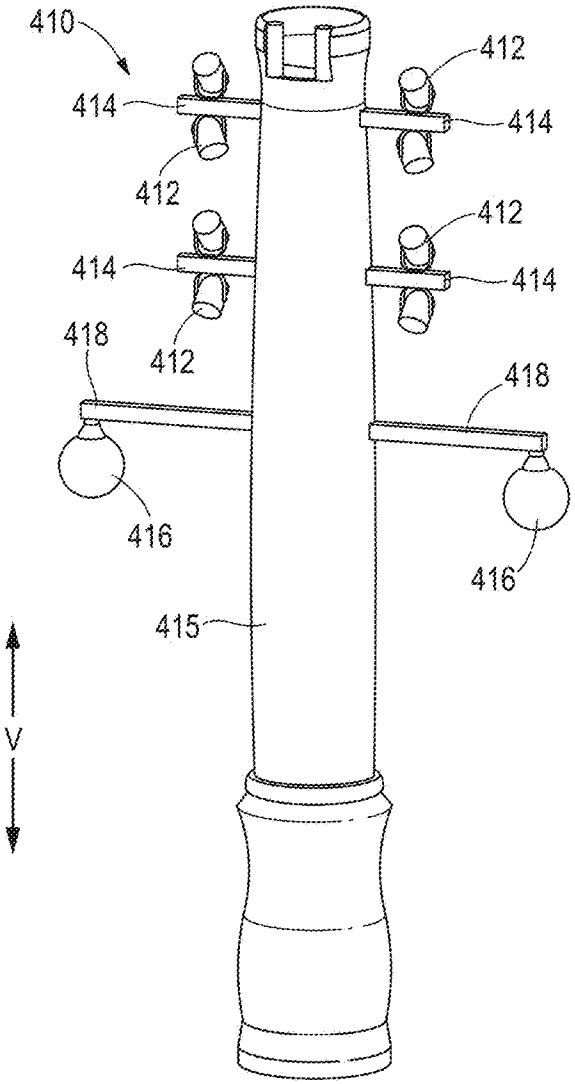

FIG. 35 illustrates a column 410 that is multifunctional, according to one embodiment of the present disclosure. As shown, the column 410 can include a plurality of lights 412 or projectors, e.g., for enhancing the lighting or special effects of a live show. The lights 412 can be coupled with support arms 414 projecting from an outer wall 415 of the column 410. In some embodiments, the lights 412 can be mounted to the support arms 414 with controllable movable head fixtures. The column 410 can also include one or more cameras 416 supported by support arms 418. The cameras 416 can be used for monitoring an area proximate the column 410.

Figure 36:
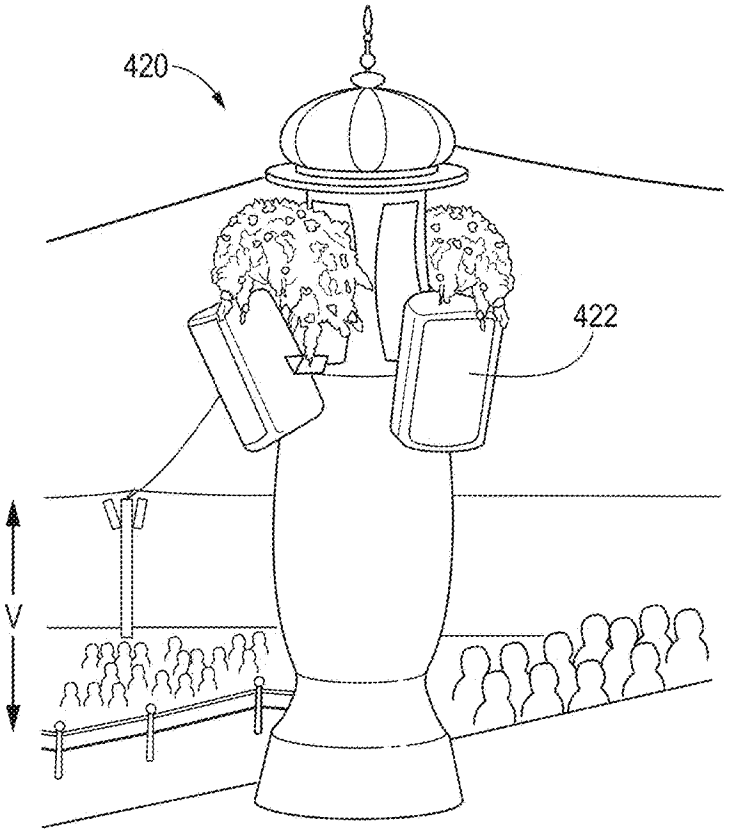
FIGS. 35 and 36 illustrate multifunctional columns according to example embodiments of the present disclosure.

FIG. 36 illustrates a column 420 that is multifunctional, according to another embodiment of the present disclosure. As shown in FIG. 27, the column 420 can include a plurality of speakers 422, e.g., for playing music or specific sounds for guests. The speakers 422 can be arranged to point downward toward the guests, for example. In some example embodiments, the speakers 422 can be arranged circumferentially around the column 420. In some embodiments, a column can include the features of the embodiment of FIG.

35 (e.g., the lights 412 and cameras 416) and the features of the embodiment of FIG. 36 (e.g., the speakers 422).

Drainage System

In some further example embodiments, a canopy system can include at least one column with drainage features. Example embodiments are provided below.

Figure 37:
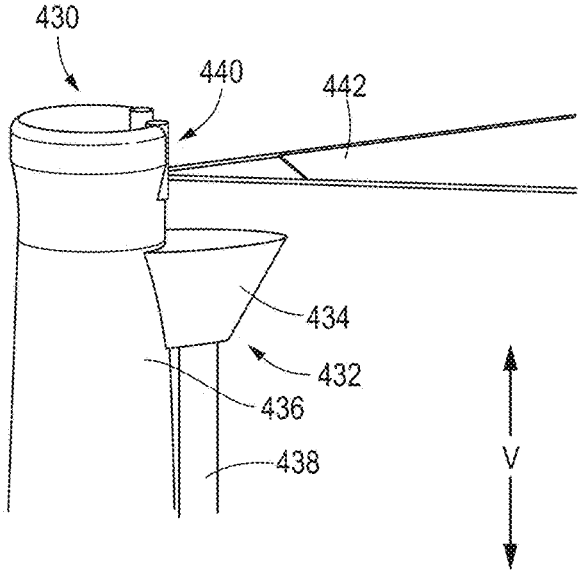
FIGS. 37, 38, and 39 illustrate columns having a drainage system according to example embodiments of the present disclosure.
Figure 38:
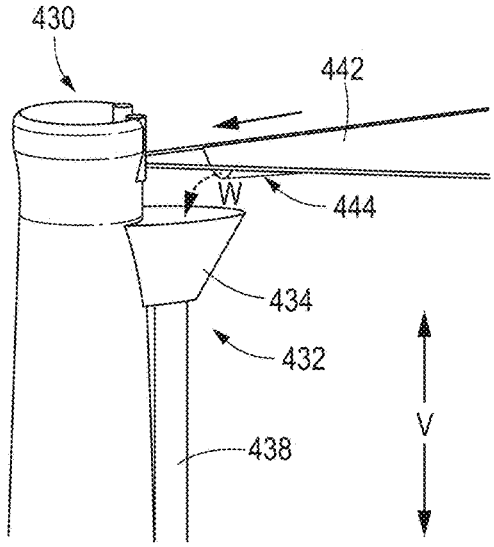

FIGS. 37 and 38 illustrate a column 430 of a canopy system having drainage features. The column 430 can be a canopy column, for example, but the cable columns of the canopy system can have drainage features as well. As shown, the column 430 includes a drainage system 432. The drainage system 432 has a collector 434 coupled with a wall 436 of the column 430 and a drain pipe 438 fluidly coupled with the collector 434. The collector 434 can be arranged as a funnel having a relatively large top opening and a relatively small bottom opening that is in fluid communication with the drain pipe 438. The collector 434 is arranged at a height below a port 440 of the column 430. The collector 434 can collect water situated on a canopy 442 and the drain pipe 438 can direct the collected water, e.g., to a reclaimed water tank for irrigation or to a body of water.

In some embodiments, with the canopy 442 in the deployed position and water disposed on the canopy 442 (e.g., from rainfall), the canopy 442 can be retracted slightly to create a drainage channel 444 in the canopy 442, e.g., as shown in FIG. 38. That is, the cables supporting the canopy 442 can be controlled in a coordinated manner so that the canopy 442 is moved toward the column 430 or retracted slightly, which creates slack in the canopy 442 relative to its deployed, fully extended position, e.g., as shown in FIG. 37. The slack in the canopy 442 can create the drainage channel 444. The drainage channel 444 can facilitate water flowing downstream off of the canopy 442 and into the collector 434, e.g., as shown in FIG. 38. Water W is shown flowing off the slightly retracted canopy 442 and into the collector 434. The water W can continue downstream through the drain pipe 438.

Figure 39:
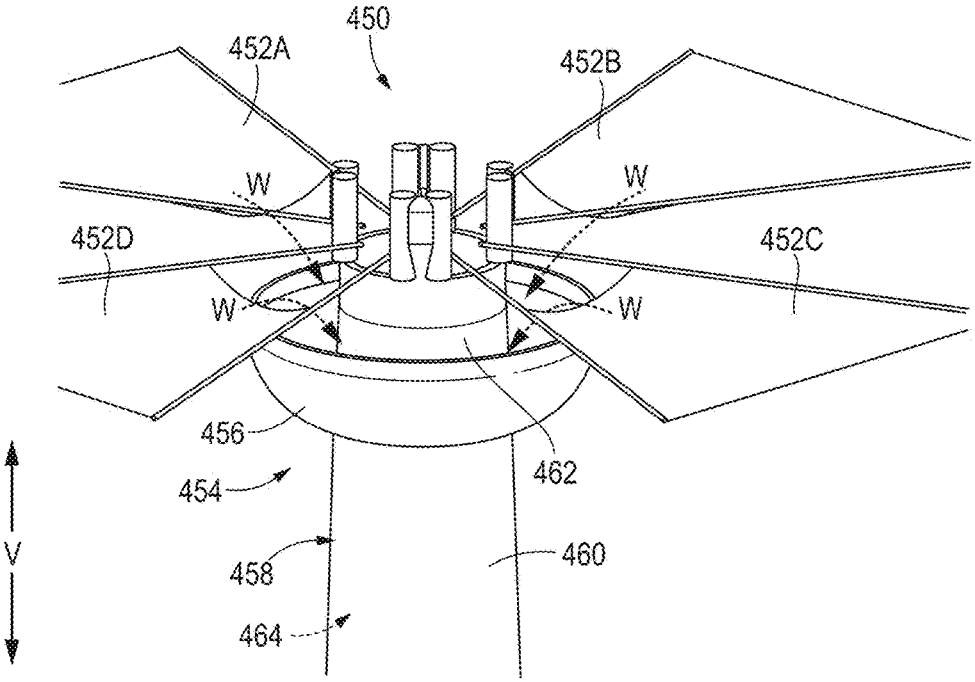

FIG. 39 illustrates a column 450 of a canopy system having drainage features according to another embodiment of the present disclosure. The column 450 can be a canopy column, for example. As depicted in FIG. 39, the column 450 functions as the canopy column for multiple canopies, including a first canopy 452A, a second canopy 452B, a third canopy 452C, and a fourth canopy 452D. The column 450 also includes a drainage system 454. The drainage system 454 has a collector 456 and a drain pipe 458 fluidly coupled with the collector 456. In this example embodiment, the collector 456 is annularly arranged and operable to collect water W from each of the canopies 452A, 452B, 452C, 452D. The collector 456 can be arranged to have a relatively large top annular opening and a relatively small bottom annular opening that is in fluid communication with the drain pipe 458. The drain pipe 458 can be formed by an annular body 460 that wraps around an outer wall 462 of the column 450. The drain pipe 458 can thus define a drain passage 464 between the annular body 460 and the outer wall 462 of the column 450. In some embodiments, the drain passage 464 can be annular. In other embodiments, baffles can be provided in the drain passage 464 to direct fluid into specific channels within the drain passage.

In some embodiments, with the canopies 452A, 452B, 452C, 452D in their respective deployed positions and water disposed on thereon (e.g., from rainfall), the canopies 452A, 452B, 452C, 452D can each be retracted slightly to create respective drainage channels, e.g., as shown in FIG. 39. That is, the cables supporting the respective canopies 452A, 452B, 452C, 452D can be controlled in a coordinated manner so that the canopies 452A, 452B, 452C, 452D are moved toward the column 450 or retracted slightly, which creates slack in the canopies 452A, 452B, 452C, 452D relative to their deployed, fully extended positions. The slack in the canopies 452A, 452B, 452C, 452D can create the drainage channels. The drainage channels can facilitate water flowing downstream off of the canopies 452A, 452B, 452C, 452D and into the collector 456, e.g., as shown in FIG. 39. Water W is shown flowing off the slightly retracted canopies 452A, 452B, 452C, 452D and into the collector 456. The water W can continue downstream through the drain passage 464 of the drain pipe 458.

Solar-Powered Columns

In some further example embodiments, a canopy system can include at least one column that is solar powered. An example embodiment is provided below.

Figure 40:
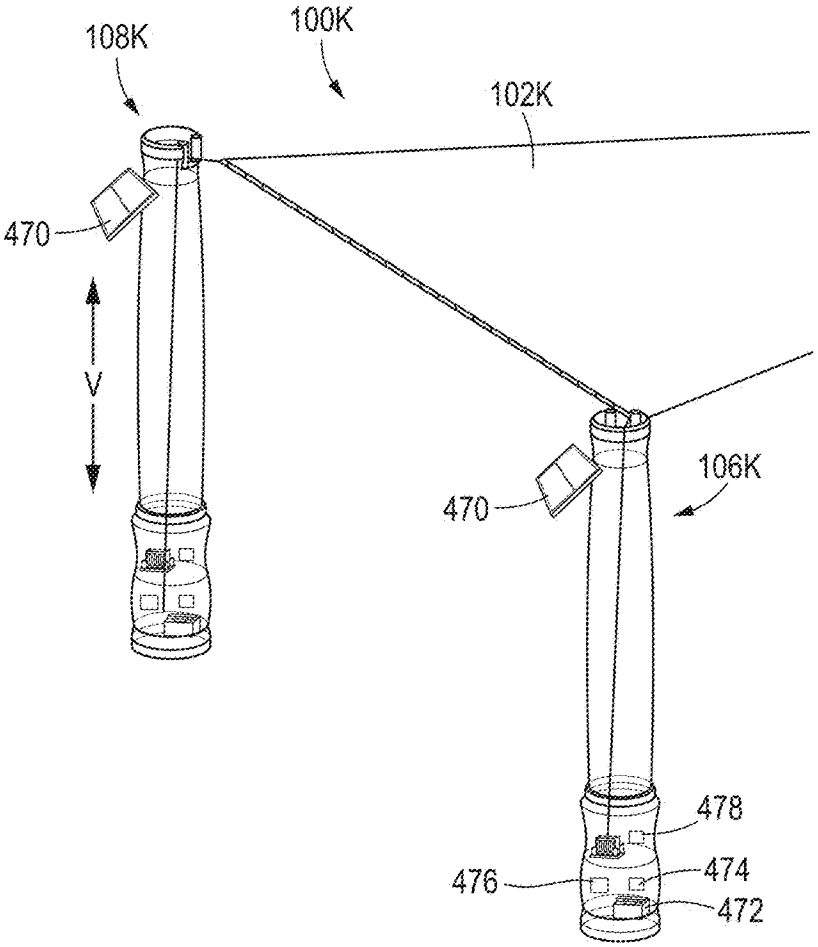
FIG. 40 illustrates a canopy system having solar-powered columns according to an example embodiment of the present disclosure.

FIG. 40 illustrates a canopy system 100K having at least one column that is solar powered. As depicted in FIG. 40, the canopy system 100K includes first and second cable columns 106K, 108K. Although not pictured, the canopy system can also include a canopy column. Each cable column 106K, 108K can include at least one solar panel 470, or photovoltaic cell. The solar panel 470 can be electrically coupled with a battery bank 472, e.g., by way of a power bus. A charge controller 474 can be arranged along the power bus to control the charging of the batteries of the battery bank 472. An inverter 476 can be disposed along the power bus to convert DC power into AC power. AC power can be delivered to the AC loads of the column, such as the electric motor of the drive assembly and a wireless control module 478. The wireless control module 478 can be communicatively coupled with other wireless control modules of other columns and/or a main controller of the canopy system, e.g., to coordinate control of their respective drive assemblies.

In some embodiments, at least one column of the canopy system 100K can be a self-contained, solar-powered column. In other embodiments, each column of the canopy system 100K can be a self-contained, solar-powered column. In yet other embodiments, at least one column of the canopy system 100K can be powered by solar power in a normal operating mode, but can be powered by a power grid or other power source, e.g., when the batteries of the battery bank 472 have little or no charge due to lack of sunlight or extended use.

Vault

In some further example embodiments, a canopy system can include at least one column with features arranged in a vault, e.g., an underground vault. An example embodiment is provided below.

Figure 41:
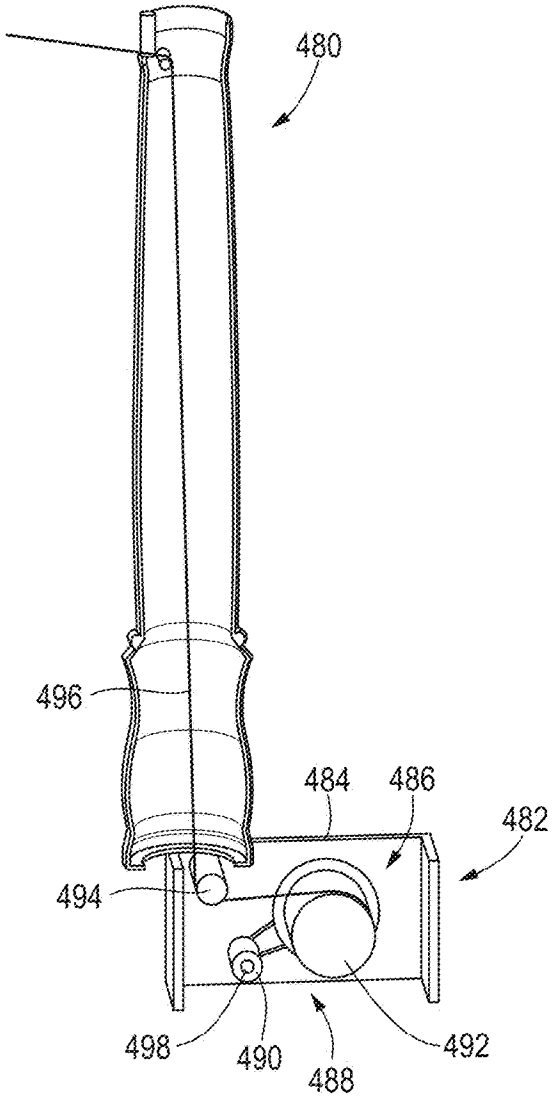
FIG. 41 illustrates a column having a vault according to an example embodiment of the present disclosure.

FIG. 41 illustrates a column 480 for a canopy system being arranged relative to a vault 482. The column 480 can be a canopy column, for example. The vault 482 can be arranged underground beneath the column 480 as shown in FIG. 41. The vault 482 has vault body 484 defining a vault chamber 486 in which various components can be disposed. Particularly, in this example embodiment, a drive assembly 488 associated with the column 480 is arranged within the vault chamber 486. The drive assembly 488 includes a winch, which includes an electric motor 490 and a drum 492 rotatably-driven by the electric motor 490. A vault pulley 494 is also arranged within the vault chamber 486 to facilitate the transition of a cable 496 between an interior volume of the column 480 and the vault chamber 486. An encoder 498 can be coupled with the electric motor 490 and/or the vault pulley 494, e.g., to readout a position of such components for controlling the winding-in and/or winding-out of the cable 496. Arranging at least some components within the vault 482 can advantageously reduce the diameter of the column 480, which can provide improved sightlines.

Canopy Having Catenary Cables

In some further example embodiments, a canopy system can include a canopy having catenary cables that can reduce the droop or slack in a canopy when deployed. An example embodiment is provided below.

Figure 42:
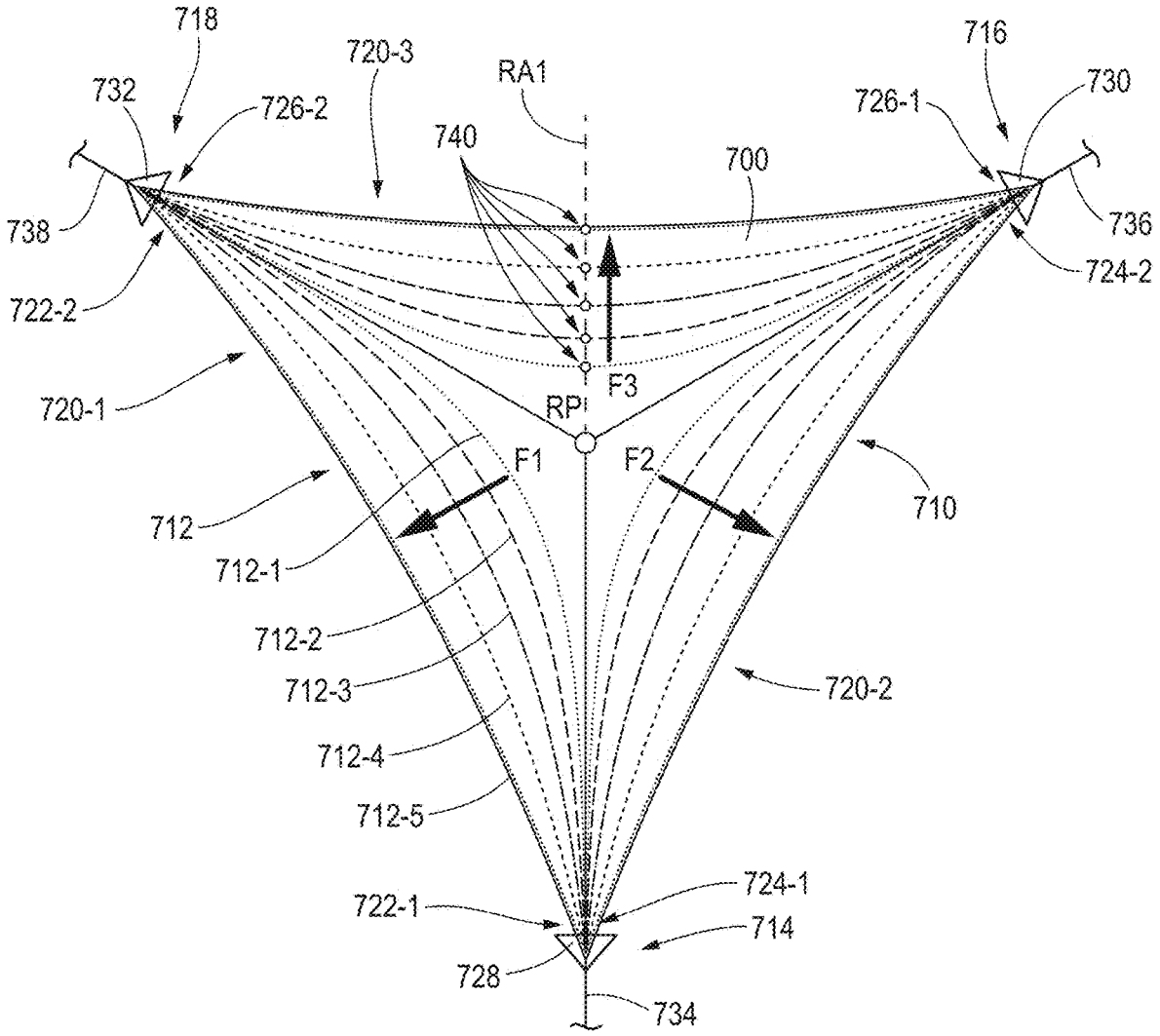
FIG. 42 is a canopy having catenary cables according to one example embodiment of the present disclosure.

FIG. 42 shows a top view of a canopy 700 that can be implemented in a canopy system, such as any of the canopy systems disclosed herein. Thus, the canopy 700 can be movable to one of a plurality of positions, including a deployed position in which the canopy 700 can provide covered protection (e.g., for guests) and a retracted position in which the canopy is, at least in part, retracted within a structure, such as a canopy column. The canopy 700 has catenary cables 710 arranged in rows 712 with respect to a reference point RP of the canopy 700. The catenary cables 710 are generally arranged in a plane of the canopy 700, e.g., in a plane horizontal to a vertical direction when the canopy 700 is arranged in a plane horizontal to the vertical direction. Further, in at least some embodiments, the reference point RP is a null point at which, when the canopy 700 is fully deployed, stress vectors applied on the canopy 700 by the catenary cables 710 balance to zero. For the canopy 700 of FIG. 42, which has an equilateral triangular shape (with rounded corners), the reference point RP can be centrally located. In other embodiments, however, the reference point RP can be offset from the center of the canopy 700.

For the depicted embodiment of FIG. 42, the catenary cables 710 are arranged in five (5) rows, including a first row 712-1, a second row 712-2, a third row 712-3, a fourth row 712-4, and a fifth row 712-5 (each designated with particular dashed, dashed-dot, or dotted lines in FIG. 42). The first row 712-1 is the innermost row with respect to the reference point RP while the fifth row 712-5 is the outermost row with respect to the reference point RP. The fifth row 712-5 of the catenary cables 710 can be attached to, and/or form, the edges of the canopy 700. Each one of the rows 712 can include one or more of the catenary cables 710. In the example embodiment of FIG. 42, each one of the rows 712 includes three (3) catenary cables. In other embodiments, the canopy 700 can include more or less than five (5) rows of catenary cables, e.g., depending on the shape and size of the canopy 700. In some embodiments, such as in the depicted embodiment of FIG. 42, the catenary cables 710 can be concentrically arranged with respect to the reference point RP. That is, the catenary cables 710 are in respective rows relative to a common center or common point.

Each one of the catenary cables 710 is secured to the canopy 700 so as to have a catenary curve when the canopy 700 is fully deployed, e.g., as shown in FIG. 42. The catenary cables 710 can be secured to or coupled with the canopy 700 in a number of ways. As one example, the catenary cables 710 can be disposed within pockets of the canopy 700. The pockets can have catenary shapes in which the catenary cables 710 can be disposed. The catenary cables 710, which can be formed of a flexible material, can thus take their catenary shapes when the canopy 700 is deployed. As another example, the catenary cables can be affixed to the canopy 700. For instance, the catenary cables 710 can be sewn to the canopy 700 at their respective locations shown in FIG. 42. The catenary cables can be formed of a flexible material, as noted above, and can be formed of a material capable of withstanding weather elements, such as sun, wind, rain, etc. For instance, in at least one embodiment, the catenary cables can be formed of a synthetic fiber resistant to ultraviolet rays and moisture.

The catenary cables 710 can also be arranged in sets. In some embodiments, the catenary cables 710 can be arranged in a number of sets equaling a number of corners of the canopy 700. In FIG. 42, for example, the canopy 700 has three (3) corners, including a first corner 714, a second corner 716, and a third corner 718. Accordingly, the catenary cables 710 are arranged in three (3) sets, including a first set 720-1, a second set 720-2, and a third set 720-3. Catenary cables from different sets can collectively form the rows. For instance, the innermost catenary cable from the first set 720-1, the innermost catenary cable from the second set 720-2, and the innermost catenary cable from the third set 720-3 can collectively form the first row 712-1. The second innermost catenary cable from the first set 720-1, the second innermost catenary cable from the second set 720-2, and the second innermost catenary cable from the third set 720-3 can collectively form the second row 712-2. The other rows 712-3, 712-4, and 712-5 can be similarly collectively formed by catenary cables from the different sets.

Each one of the catenary cables 710 has opposing ends respectively coupled with corners of the canopy 700. For example, the catenary cables of a given set can include respective first ends each coupled with one of the corners of the canopy 700 and respective second ends each coupled with another one of the corners of the canopy 700. The catenary cables 710 of the first set 720-1 can include respective first ends 722-1 and respective second ends 722-2, the catenary cables 710 of the second set 720-2 can include respective first ends 724-1 and respective second ends 724-2, and the catenary cables 710 of the third set 720-3 can include respective first ends 726-1 and respective second ends 726-2. The first ends 722-1 of the catenary cables 710 of the first set 720-1 can each couple to a first corner plate 728 arranged at the first corner 714 and the first ends 724-1 of the catenary cables 710 of the second set 720-2 can each couple to the first corner plate 728 as well. The second ends 724-2 of the catenary cables 710 of the second set 720-2 can each couple to a second corner plate 730 arranged at the second corner 716 and the first ends 726-1 of the catenary cables 710 of the third set 720-3 can each couple to the second corner plate 730 as well. Finally, the second ends 722-2 of the catenary cables 710 of the first set 720-1 can each couple to a third corner plate 732 arranged at the third corner 718 and the second ends 726-2 of the catenary cables 710 of the third set 720-3 can each couple to the third corner plate 732 as well.

The first, second, and third corner plates 728, 730, 732 each have a cable 734, 736, 738 coupled thereto that couples the first, second, and third corner plates 728, 730, 732 with respective drive assemblies controllable in a coordinated manner to wind-in, wind-out, or hold in place their respective ones of the cables 734, 736, 738 to deploy or retract the canopy 700 to one of a plurality of positions, including a deployed position in which the canopy provides covered protection and a retracted position in which the canopy is, at least in part, retracted within an inner chamber defined by a canopy column.

The catenary cables 710 can each have predefined design tensions, with the predefined design tensions of the catenary cables 710 progressively increasing from one row to the next as the rows approach the reference point RP. Accordingly, for the illustrated embodiment of FIG. 42, the catenary cables of the fifth row 712-5 have a predefined design tension, and the catenary cables of the fourth row 712-4 have a predefined design tension that is greater than the predefined tension of the catenary cables of the fifth row 712-5. The catenary cables of the third row 712-3 have a predefined design tension that is greater than the predefined tension of the catenary cables of the fourth row 712-4. The catenary cables of the second row 712-2 have a predefined design tension that is greater than the predefined tension of the catenary cables of the third row 712-3. Finally, the catenary cables of the first row 712-1 have a predefined design tension that is greater than the predefined tension of the catenary cables of the second row 712-2. Thus, the catenary cables 710 of the first row 712-1, or the innermost row with respect to the reference point RP, have the greatest predefined design tension while the catenary cables 710 of the fifth row 712-5, or the outermost row with respect to the reference point RP, have the least predefined design tension, with the predefined design tension of the rows therebetween being progressively stepped up as the rows approach the reference point RP.

When the canopy 700 is fully deployed, e.g., as shown in FIG. 42, the catenary cables 710 are under their respective predefined designed tensions so as to apply stress vectors on the canopy 700 in directions away from the reference point RP. For instance, the catenary cables 710 of the first set 720-1 can each apply a force on the canopy 700 in a direction away from the reference point RP, as represented by F1. Similarly, the catenary cables 710 of the second set 720-2 can each apply a force on the canopy 700 in a direction away from the reference point RP, as represented by F2. In addition, the catenary cables 710 of the third set 720-3 can each apply a force on the canopy 700 in a direction away from the reference point RP, as represented by F3. Thus, when the canopy 700 is fully deployed, the catenary cables 710 are under their respective predefined designed tensions so as to limit deflection in a region near the reference point RP (or a center region) of the canopy 700 while allowing for increased deflection on the edges of the canopy 700. Such an arrangement can advantageously eliminate or reduce the droop or slack in the canopy 700 when deployed, especially at the reference point RP or center region of the canopy 700. Thus, sightlines can be kept open and water can be prevented from pooling on top of the canopy 700, among other benefits.

In some example embodiments, the catenary cables 710 become progressively more curved from one row to the next as the rows approach the reference point RP. That is, the catenary cables 710 become progressively less straight from one row to the next as the rows approach the reference point RP. For instance, the catenary cables 710 of the fourth row 712-4 are more curved than the catenary cables 710 of the fifth row 712-5, the catenary cables 710 of the third row 712-3 are more curved than the catenary cables 710 of the fourth row 712-4, the catenary cables 710 of the second row 712-2 are more curved than the catenary cables 710 of the third row 712-3, and the catenary cables 710 of the first row 712-1 are more curved than the catenary cables 710 of the second row 712-2. Accordingly, the catenary cables 710 can become progressively less curved (i.e., progressively straighter) from one row to the next as the rows step outward from the reference point RP.

In addition, in some embodiments, inflection points of each one of the catenary cables 710 of at least one of the sets 720-1, 720-2, 720-3 can be aligned along a radial axis extending from the reference point RP. For instance, as shown in FIG. 42, inflection points 740 of the catenary cables 710 of the third set 720-3 are aligned with a radial axis RA1 extending radially (e.g., in a plane orthogonal to a vertical direction) from the reference point RP. In some embodiments, the inflection points of the catenary cables 710 of each one of the sets are aligned with respective radial axes extending radially from the reference point RP.

In some further embodiments, the canopy 700 can include backbone cables 742 extending respectively linearly from each corner of the canopy 700 to the reference point RP. In the embodiment of FIG. 42, for example, the canopy 700 includes three (3) backbone cables 742 as the canopy 700 includes three (3) corners. The backbone cables 742 can divide the catenary cables 710 into respective sets and can each be coupled with respective ones of the corner plates 728, 730, 732. The backbone cables 742 can provide direct tension lines from the reference point RP to the respective corners of the canopy 700, providing further support for the canopy 700, which may reduce droop or sag of the canopy 700.

It will be appreciated that the canopy 700 having the catenary cables 710 is provided way of example. It is contemplated that canopies having different shapes or number of sides can include catenary cables, including canopies having non-symmetric shapes. Further, while a single reference point is depicted in the embodiment of FIG. 42, in other embodiments, a canopy can have multiple reference points about which catenary cables disposed in rows and one or more sets can be arranged. Further, in yet other embodiments, a canopy can be asymmetric and the inflection points of the catenary cables may or may not line up in a straight line (or along a radial axis extending from the reference point), and/or may not terminate orthogonally to the canopy's edge.

Method

Figure 43:
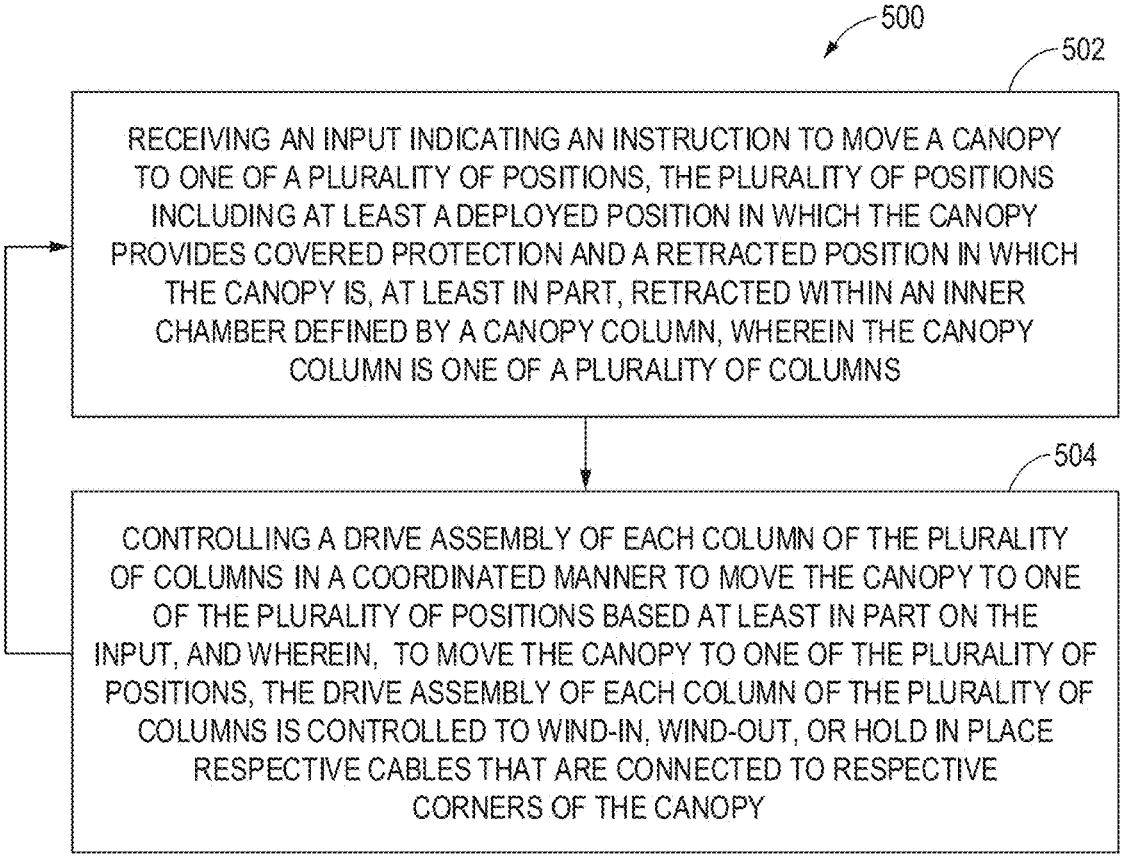
FIG. 43 is a flow diagram for a method of operating a canopy system according to one example embodiment of the present disclosure.

FIG. 43 is a flow diagram for a method 500 of controlling a canopy system. The method 500 can be used to control the canopy system disclosed herein, for example.

At 502, the method 500 includes receiving an input indicating an instruction to move a canopy to one of a plurality of positions, the plurality of positions including at least a deployed position in which the canopy provides covered protection and a retracted position in which the canopy is, at least in part, retracted within an inner chamber defined by a canopy column, wherein the canopy column is one of a plurality of columns. For instance, a system controller communicatively coupled with respective controllers of the columns can receive the input. The input can be a user input, weather inputs indicating certain weather conditions at the canopy system, or a deployment schedule that corresponds predetermined times with intended positions of the canopy. In some implementations, multiple inputs can be received. The inputs can have associated priority levels, and when the inputs conflict, the input with the highest priority level relative to the others controls whether and how the canopy is moved.

At 504, the method 500 includes controlling a drive assembly of each column of the plurality of columns in a coordinated manner to move the canopy to one of the plurality of positions based at least in part on the input, and wherein, to move the canopy to one of the plurality of positions, the drive assembly of each column of the plurality of columns is controlled to wind-in, wind-out, or hold in place respective cables that are connected to respective corners of the canopy. For instance, the system controller can send one or more control signals to the controllers of the columns to control the drive assemblies thereof to wind-in, wind-out, or hold in place their respective cables so that the canopy is moved to a desired position, such as in a deployed position to provide covered protection, retracted position to open up sightlines for guests, or in a maintenance position for cleaning the canopy. In some implementations, the method 500 can further include receiving a current position of the canopy. The current position of the canopy can be used to determined how much cable to wind-in or wind-out (or the time to wind-in or wind-out the cables) to position the canopy in the desired position. After moving the canopy to a desired position, the method 500 can iterate to 502 to await further inputs.

Computing System

Figure 44:
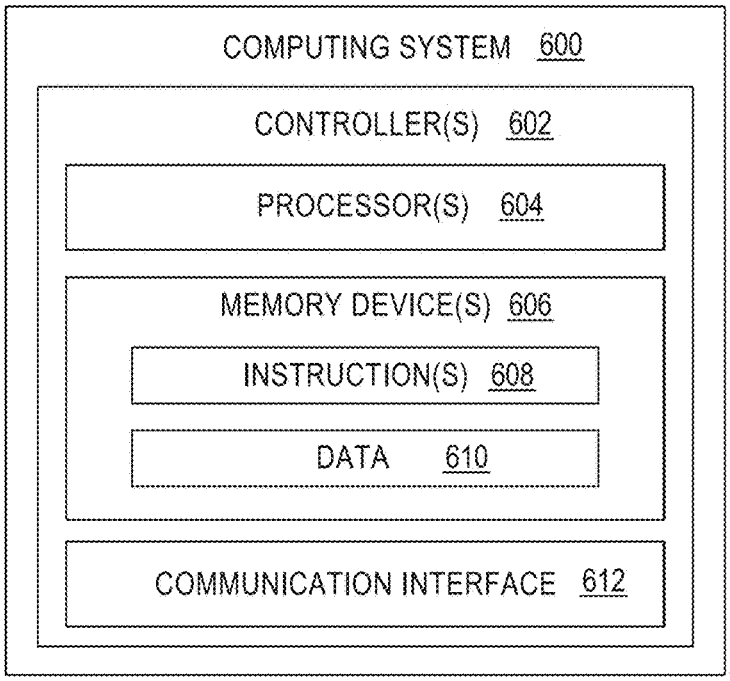
FIG. 44 is a block diagram for an example computing system according to various embodiments of the present disclosure.

FIG. 44 is a block diagram of an example computing system 600 for a canopy system in accordance with various aspects of the present disclosure. As shown in FIG. 44, the computing system 600 can include one or more processor(s) 604 and one or more memory device(s) 606. The one or more processor(s) 604 and the one or more memory device(s) 606 can be embodied in one or more computing devices or controller(s) 602. The system controller 200 and controllers 202, 204, 206 depicted in FIG. 7 can each be configured in a same or similar manner as the controller 602 of FIG. 44. The one or more processor(s) 604 can include any suitable processing device, such as a microprocessor, microcontroller, integrated circuit, logic device, or other suitable processing device. The one or more memory device(s) 606 can include one or more computer-readable medium, including, but not limited to, non-transitory computer-readable medium, RAM, ROM, hard drives, flash drives, and other memory devices.

The one or more memory device(s) 606 can store information accessible by the one or more processor(s) 604, including computer-readable instructions 608 or computer-readable program code that can be executed by the one or more processor(s) 604. The instructions 608 can be any set of instructions that, when executed by the one or more processor(s) 604, cause the one or more processor(s) 604 to perform operations. The instructions 608 can be software written in any suitable programming language or can be implemented in hardware. The memory device(s) 606 can further store data 610 that can be accessed by the processors 604. For example, the data 610 can include any of the data noted herein. The data 610 can include one or more table(s), function(s), algorithm(s), model(s), equation(s), libraries, etc. according to example aspects of the present disclosure.

The computing system 600, or the controllers 602 thereof, can include a communication interface 612 used to communicate with other components. The communication interface 612 can include any suitable components for interfacing with one or more network(s), including for example, transmitters, receivers, ports, controllers, antennas, or other suitable components.

CLAUSES

A canopy system is provided. The canopy system includes a canopy; tension cables respectively connected to the canopy; a canopy column defining an inner chamber in which a storage drum is disposed; a pleating cable coupled with an edge of the canopy opposite the canopy column; and drive assemblies each arranged to wind-in, wind-out, or hold in place respective ones of the tension cables and the pleating cable in coordination to deploy or retract the canopy to one of a plurality of positions, including a deployed position in which the canopy provides covered protection and a retracted position in which the canopy is, at least in part, retracted within the inner chamber of the canopy column and wound on the storage drum, and wherein one of the drive assemblies rotatably drives the storage drum.

In one aspect, the pleating cable has a first end and a second end, and wherein the first end is fixed within a cable column of the canopy system and the second end is coupled with one of the drive assemblies.

In one aspect, the pleating cable is coupled with the edge of the canopy by way of eyelets arranged along the edge of the canopy.

In one aspect, the pleating cable is coupled with the edge of the canopy by way of pulleys arranged along the edge of the canopy.

In one aspect, the pleating cable is coupled with a pleated tension system having a storage spool and a compression spool. The storage spool and the compression spool are coupled with one another by a first spring and a second spring arranged at opposing first and second ends of the pleated tension system.

A tension system is provided. The tension system includes a base plate, columns extending from the base plate, and a movable assembly. The movable assembly includes a movable plate defining apertures sized to receive respective ones of the columns. Springs are wrapped around respective ones of the columns and engage the movable plate at their respective top ends and the base plate at their respective lower ends. A drive assembly is mounted on the movable plate. The tension system includes a sensor system, including an encoder, a slack sensor, and a tension sensor. The slack sensor and the tension sensor are arranged relative to the movable plate, with one sensor being arranged above and one sensor being arranged below the movable plate. The slack sensor and the tension sensor are electrically coupled with the encoder. Depending on the tension of a cable coupled with the drive assembly, the movable plate is movable.

When the movable plate is sensed by the slack sensor, the slack sensor is activated, causing an electrical signal indicating the position of the movable plate at or proximate the slack sensor to be routed to the encoder. The encoder converts the electrical signal into a digital readout indicating a position of the movable assembly at or proximate the slack sensor. In some aspects, the digital readout can be used by a controller to control an electric motor of a drive assembly to reduce the tension on a cable of a canopy system, such as by winding-out or by winding-in the cable faster or more slowly.

When the movable plate is sensed by the tension sensor, the tension sensor is activated, causing an electrical signal indicating the position of the movable plate at or proximate the tension sensor to be routed to the encoder. The encoder converts the electrical signal into a digital readout indicating a position of the movable assembly at or proximate the tension sensor. In some aspects, the digital readout can be used by a controller to control an electric motor of a drive assembly to increase the tension on a cable of a canopy system, such as by winding-out or by winding-in the cable faster or more slowly.

A canopy system is provided. The canopy system includes a canopy; a canopy column defining an inner chamber in which a storage drum is disposed; and a canopy rotator arranged to rotate the canopy traveling therethrough to rotate by a predefined rotation angle.

In one aspect, the canopy rotator has a backbone and opposing walls arranged in helical relation to a central axis along at least a portion of a length of the canopy rotator.

In one aspect, the predefined rotation angle is ninety degrees.

In one aspect, the canopy rotator has a backbone, outer walls, and inner walls arranged in helical relation to a central axis along at least a portion of a length of the canopy rotator.

A variable canopy storage system for a canopy column of a canopy system is provided. The variable canopy storage system includes rows of spring-loaded compression rollers interleaved with rows of guide rollers, wherein the compression rollers of a given one of the rows of spring-loaded compression rollers are movable away or toward one another depending on a thickness of the canopy traveling therethrough.

In one aspect, the springs coupled with the compression rollers progressively increase in tension from one row to the next.

In one aspect, the compression rollers and the guide rollers are arranged perpendicular to one another.

A canopy system is provided. The canopy system includes a column having a drainage system. The drainage system has a collector and a drain pipe fluidly coupled with the collector. A canopy supported by the column is controllable to be retracted toward the column so as to create a drainage channel in the canopy, which allows water to drain into the collector and flow downstream to the drain pipe.

In one aspect, the collector is annular.

In one aspect, the drain pipe is formed by an annular body wrapped around an outer wall of the column, and wherein a drain passage is defined between the annular body and the outer wall.

A canopy system is provided. The canopy system includes a canopy; cables respectively connected to the canopy; a canopy column defining an inner chamber; at least one cable column; and drive assemblies each arranged to wind-in, wind-out, or hold in place respective ones of the cables in coordination to deploy or retract the canopy to one of a plurality of positions, including a deployed position in which the canopy provides covered protection and a retracted position in which the canopy is, at least in part, retracted within the inner chamber of the canopy column, and wherein at least one of the columns is a solar-powered column.

A canopy system is provided. The canopy system includes a canopy; cables respectively connected to the canopy; a canopy column; drive assemblies each arranged to wind-in, wind-out, or hold in place respective ones of the cables in coordination to deploy or retract the canopy to one of a plurality of positions, including a deployed position in which the canopy provides covered protection and a retracted position in which the canopy is, at least in part, retracted within an inner chamber of the canopy column, and wherein one of the drive assemblies and a storage drum upon which the canopy can be wound is disposed within a vault in communication with the inner chamber of the canopy column.

A canopy system is provided. The canopy system includes a canopy having catenary cables arranged in rows with respect to a reference point of the canopy, with each one of the catenary cables being secured to the canopy so as to have a catenary curve when the canopy is fully deployed and each one of the catenary cables having opposing ends respectively coupled with corners of the canopy, and wherein the catenary cables each have predefined design tensions, with the predefined design tensions of the catenary cables progressively increasing from one row to the next as the rows approach the reference point.

In one aspect, the catenary cables are arranged in sets, with a number of sets equaling a number of corners of the canopy.

In one aspect, the ends of the catenary cables of a given one of the sets include first ends each coupled with one of the corners and second ends each coupled with another one of the corners.

In one aspect, wherein the sets include a first set and a second set with the catenary cables of the first set having respective first ends and respective second ends and the catenary cables of the second set having respective first ends and respective second ends, and wherein the first ends of the catenary cables of the first set each couple to a first corner plate arranged at a first corner of the corners of the canopy and the first ends of the catenary cables of the second set each couple to the first corner plate.

In one aspect, wherein the sets include a third set with the catenary cables of the third set having respective first ends and respective second ends, and wherein the second ends of the catenary cables of the second set each couple to a second corner plate arranged at a second corner of the corners of the canopy and the first ends of the catenary cables of the third set each couple to the second corner plate.

In one aspect, the second ends of the catenary cables of the first set each couple to a third corner plate arranged at a third corner of the corners of the canopy and the second ends of the catenary cables of the third set each couple to the third corner plate.

In one aspect, the first, second, and third corner plates each have a cable coupled thereto that couples the first, second, and third corner plates with respective drive assemblies controllable in a coordinated manner to wind-in, wind-out, or hold in place their respective ones of the cables to deploy or retract the canopy to one of a plurality of positions, including a deployed position in which the canopy provides covered protection and a retracted position in which the canopy is, at least in part, retracted within an inner chamber defined by the canopy column.

In one aspect, the canopy has a triangular shape and the sets and rows are arranged so that the catenary cables are concentrically arranged with respect to the reference point.

In one aspect, the reference point is a null point at which, when the canopy is deployed, stress vectors applied on the canopy by the catenary cables balance to zero.

In one aspect, the canopy includes backbone cables extending respectively linearly from each corner of the canopy to the reference point.

In one aspect, the catenary cables are disposed within pockets of the canopy.

In one aspect, the catenary cables are affixed to the canopy.

In one aspect, inflection points of each one of the catenary cables of at least one of the sets are aligned along a radial axis extending from the reference point.

In one aspect, the canopy is movable to one of a plurality of positions, including a deployed position in which the canopy provides covered protection and a retracted position in which the canopy is, at least in part, retracted within a structure.

In one aspect, the catenary cables are concentrically arranged with respect to the reference point.

In one aspect, when the canopy is fully deployed, the catenary cables are under their respective predefined designed tensions so as to apply stress vectors on the canopy in directions away from the reference point.

In one aspect, when the canopy is fully deployed, the catenary cables are under their respective predefined designed tensions so as to limit deflection in a center region of the canopy while allowing for increased deflection on edges of the canopy.

In one aspect, the catenary cables are formed of a flexible material.

In one aspect, at least one of the rows of the catenary cables is arranged at edges of the canopy.

A canopy is provided. The canopy includes catenary cables arranged in rows with respect to a reference point of the canopy, with each one of the catenary cables being secured to the canopy so as to have a catenary curve when the canopy is fully deployed and each one of the catenary cables having opposing ends respectively coupled with the canopy, and wherein the catenary cables each have predefined design tensions, with the predefined design tensions of the catenary cables progressively increasing from one row to the next as the rows approach the reference point.

A canopy is provided. The canopy includes catenary cables arranged in rows with respect to a reference point of the canopy, with each one of the catenary cables being secured to the canopy so as to have a catenary curve when the canopy is fully deployed, and wherein the catenary cables are progressively more curved from one row to the next as the rows approach the reference point.

In the current disclosure, reference is made to various embodiments. However, it should be understood that the present disclosure is not limited to specific described embodiments. Instead, any combination of the following features and elements, whether related to different embodiments or not, is contemplated to implement and practice the teachings provided herein. Additionally, when elements of the embodiments are described in the form of "at least one of A and B," it will be understood that embodiments including element A exclusively, including element B exclusively, and including element A and B are each contemplated. Furthermore, although some embodiments may achieve advantages over other possible solutions or over the prior art, whether or not a particular advantage is achieved by a given embodiment is not limiting of the present disclosure. Thus, the aspects, features, embodiments and advantages disclosed herein are merely illustrative and are not considered elements or limitations of the appended claims except where explicitly recited in a claim(s).

As will be appreciated by one skilled in the art, embodiments described herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments described herein may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations or block diagrams of methods, apparatuses (systems), and computer program products according to embodiments of the present disclosure. It will be understood that each block of the flowchart illustrations or block diagrams, and combinations of blocks in the flowchart illustrations or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations or block diagrams.

The flowchart illustrations and block diagrams in the figures illustrate the architecture, functionality, and operation of possible implementations of systems, methods, and computer program products according to various embodiments of the present disclosure. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams or flowchart illustrations, and combinations of blocks in the block diagrams or flowchart illustrations, can be implemented by special purpose hardware-based systems that perform the specified functions or acts, or combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A canopy system, comprising:

a canopy;

cables respectively connected to the canopy; and a plurality of columns spaced from one another and including a canopy column and at least two cable columns, each one of the plurality of columns having a drive assembly arranged to wind-in, wind-out, or hold in place respective ones of the cables, wherein the drive assemblies are controllable in a coordinated manner to wind-in, wind- out, or hold in place their respective ones of the cables to deploy or retract the canopy to one of a plurality of positions, including a deployed position in which the canopy provides covered protection, a retracted position in which the canopy is, at least in part, retracted within an inner chamber defined by the canopy column, and a maintenance position in which the canopy is angled with respect to a horizontal reference plane with at least two corners of the canopy being arranged in respective lowered positions and at least one corner of the canopy being arranged in an elevated position.

2. The canopy system of claim 1, wherein the canopy column has a storage drum that is disposed within the inner chamber and rotatably-driven by the drive assembly of the canopy column, and wherein the cable arranged to be wound-in, wound-out, or held in place by the drive assembly of the canopy column is connected to the storage drum.

3. The canopy system of claim 2, wherein the storage drum defines a channel, relative to a canopy winding surface of the storage drum, within which the cable connected to the storage drum can be received when wound thereon, and the canopy winding surface is arranged to receive the canopy when wound thereon.

4. The canopy system of claim 3, wherein the canopy does not contact the cable when wound on the canopy winding surface, except for at a coupling interface between the cable and the canopy.

5. The canopy system of claim 1, wherein the canopy column has a canopy guide that guides the canopy into and out of the inner chamber.

6. The canopy system of claim 5, wherein the canopy guide includes a horizontally-oriented roller and a pair of vertically-oriented rollers arranged on opposite sides of the horizontally-oriented roller.

7. The canopy system of claim 6, wherein the horizontally-oriented roller and one or both of the pair of vertically-oriented rollers are actively driven.

8. The canopy system of claim 1, wherein at least one column of the plurality of columns is extendable along a vertical direction relative to a neutral position of the at least one column based at least in part on an environmental condition.

9. The canopy system of claim 1, wherein at least one column of the plurality of columns is themed such that a utilitarian aspect of the at least one column is disguised.

10. The canopy system of claim 1, wherein at least one column is arranged to lean in a direction opposite a force the canopy applies on the cable arranged to be wound-in or wound-out by the drive assembly of the at least one column.

11. The canopy system of claim 1, wherein the plurality of columns, the cables, and the canopy form a first canopy set, and wherein the system further comprises:

a second canopy set, comprising:

a second canopy;

second cables respectively connected to the second canopy;

a second canopy column having a drive assembly arranged to wind-in or wind- out one of the second cables; and at least two second drive assemblies each arranged to wind-in, wind-out, or hold in place respective ones of the second cables in coordination with the drive assembly of the second canopy column to deploy or retract the second canopy to one of a plurality of positions, including a deployed position in which the second canopy provides covered protection and a retracted position in which the second canopy is, at least in part, retracted within an inner chamber defined by the second canopy column, and wherein at least one of the at least two second drive assemblies is arranged within one of the at least two cable columns.

12. The canopy system of claim 1, wherein the plurality of columns, the cables, and the canopy form a first canopy set, and wherein the system further comprises:

a second canopy set, comprising:

a second canopy;

second cables respectively connected to the second canopy;

a second canopy column having a drive assembly arranged to wind-in or wind- out one of the second cables; and at least two second drive assemblies each arranged to wind-in, wind-out, or hold in place respective ones of the second cables in coordination with the drive assembly of the second canopy column to deploy or retract the second canopy to one of a plurality of positions, including a deployed position in which the second canopy provides covered protection and a retracted position in which the second canopy is, at least in part, retracted within an inner chamber defined by the second canopy column, and wherein at least one of the at least two second drive assemblies is arranged within the canopy column of the first canopy set.

13. The canopy system of claim 1, wherein the canopy is fully retractable within the inner chamber of the canopy column.

14. The canopy system of claim 1, wherein to move the canopy to the maintenance position, at least two of the drive assemblies wind-out their respective ones of the cables and at least one of the drive assemblies holds its respective one of the cables in place so that the canopy is angled with respect to the horizontal reference plane.

15. The canopy system of claim 1, wherein the canopy has catenary cables arranged in rows with respect to a reference point of the canopy, with each one of the catenary cables being secured to the canopy so as to have a catenary curve when the canopy is fully deployed and each one of the catenary cables having opposing ends respectively coupled with the canopy, and wherein the catenary cables each have predefined design tensions, with the predefined design tensions of the catenary cables progressively increasing from one row to the next as the rows approach the reference point.

16. The canopy system of claim 1, wherein the canopy is self-pleating such that, upon entry of the canopy into the inner chamber of the canopy column, the canopy automatically furls into shape to be wound upon a storage drum disposed within the inner chamber, and upon exit of the canopy from the inner chamber of the canopy column, the canopy automatically unfurls.

17. A canopy system comprising:

a canopy;

cables respectively connected to the canopy;

a plurality of columns spaced from one another and comprising a canopy column and at least two cable columns, the canopy column comprising an inner chamber and a storage drum disposed within the inner chamber; and a plurality of drive assemblies associated with the plurality of columns and controllable in a coordinated manner to wind-in, wind-out, or hold in place respective ones of the cables to deploy or retract the canopy to one of a plurality of positions, including a deployed position in which the canopy provides covered protection and a retracted position in which the canopy is, at least in part, retracted within the inner chamber, wherein the storage drum is configured to receive, within a channel, the cable associated with the canopy column, so that the canopy does not contact the cable when wound on the storage drum, except for at a coupling interface between the cable and the canopy.

* * * * *